US010089925B2

(12) United States Patent
Park et al.

(10) Patent No.: US 10,089,925 B2
(45) Date of Patent: Oct. 2, 2018

(54) ORGANIC LIGHT EMITTING DISPLAY DEVICE FOR PREVENTING ERRONEOUS LIGHT EMISSION

(71) Applicant: SAMSUNG DISPLAY CO., LTD., Yongin, Gyeonggi-Do (KR)

(72) Inventors: Kyong-Tae Park, Yongin (KR); Tae-Gon Kim, Yongin (KR); Dong-Yoon So, Yongin (KR); Sung-Ho Cho, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 112 days.

(21) Appl. No.: 14/727,720

(22) Filed: Jun. 1, 2015

(65) Prior Publication Data

US 2016/0078810 A1 Mar. 17, 2016

(30) Foreign Application Priority Data

Sep. 16, 2014 (KR) ..... 10-2014-0122728

(51) Int. Cl.
*G09G 3/30* (2006.01)
*G09G 3/32* (2016.01)
(Continued)

(52) U.S. Cl.
CPC ..... *G09G 3/3233* (2013.01); *G09G 3/3275* (2013.01); *G09G 3/3266* (2013.01);
(Continued)

(58) Field of Classification Search
CPC ..... G09G 2330/08; G09G 2330/10; G09G 2300/0413; G09G 2320/0295;
(Continued)

(56) References Cited

U.S. PATENT DOCUMENTS 8,237,637 B2 * 8/2012 Chung ..... G09G 3/3233 345/76
9,129,923 B1 * 9/2015 Han ..... H01L 27/3248
(Continued)

FOREIGN PATENT DOCUMENTS

CN 103810965 A 5/2014
EP 2 955 710 A2 12/2015
(Continued)

OTHER PUBLICATIONS

EPO Search Report dated Apr. 6, 2016, for corresponding European Patent application 15185184.7, (9 pages).
(Continued)

*Primary Examiner* — Xuemei Zheng
(74) *Attorney, Agent, or Firm* — Lewis Roca Rothgerber Christie LLP

(57) ABSTRACT

An organic light emitting display device includes data lines and an auxiliary data line, scan lines and emission control lines crossing the data lines and the auxiliary data line, display pixels at crossing regions of the data lines, the scan lines and the emission control lines, auxiliary pixels at crossing regions of the auxiliary data line, the scan lines and the emission control lines, and auxiliary lines coupled to the auxiliary pixels. Each of the auxiliary pixels includes a discharge transistor coupled to one of the auxiliary lines and a first power voltage line to which a first power voltage is supplied and a discharge transistor controller including a plurality of transistors and configured to control the discharge transistor.

20 Claims, 16 Drawing Sheets

(51) Int. Cl.
*G09G 3/3233* (2016.01)
*G09G 3/3275* (2016.01)
*G09G 3/3266* (2016.01)

(52) U.S. Cl.
CPC ..... *G09G 2300/043* (2013.01); *G09G 2300/0426* (2013.01); *G09G 2300/0819* (2013.01); *G09G 2300/0861* (2013.01); *G09G 2310/0248* (2013.01); *G09G 2310/0251* (2013.01); *G09G 2320/0233* (2013.01); *G09G 2330/08* (2013.01); *G09G 2330/10* (2013.01); *G09G 2330/12* (2013.01)

(58) Field of Classification Search
CPC .. G09G 3/3233; G09G 3/006; G09G 2330/12; H01L 2251/568; H01L 27/3248
See application file for complete search history.

(56) References Cited

U.S. PATENT DOCUMENTS

| | | | | |
|---|---|---|---|---|
| 2006/0158400 | A1 | 7/2006 | Masumoto et al. | |
| 2007/0024540 | A1 | 2/2007 | Ryu et al. | |
| 2008/0150846 | A1 | 6/2008 | Chung | |
| 2009/0027377 | A1 | 1/2009 | Kwon | |
| 2014/0027719 | A1 | 1/2014 | Kim | |
| 2015/0161943 | A1* | 6/2015 | Shim | G09G 3/3225 345/76 |

FOREIGN PATENT DOCUMENTS

| | | | |
|---|---|---|---|
| JP | 2005-309422 | | 11/2005 |
| KR | 10-0666639 | B1 | 1/2007 |
| KR | 100666639 | B1 * | 1/2007 |
| KR | 10-2013-0107909 | A | 10/2013 |

OTHER PUBLICATIONS

EPO Extended Search Report dated Sep. 15, 2016, for corresponding European Patent Application No. 15185184.7, (17 pages).

* cited by examiner

ORGANIC LIGHT EMITTING DISPLAY DEVICE FOR PREVENTING ERRONEOUS LIGHT EMISSION

CROSS-REFERENCE TO RELATED APPLICATION

This application claims priority to and the benefit of Korean Patent Application No. 10-2014-0122728, filed on Sep. 16, 2014, in the Korean Intellectual Property Office, the entire content of which is incorporated herein by reference in its entirety.

BACKGROUND

1. Field

An aspect of the present invention relates to an organic light emitting display device.

2. Description of the Related Art

With development of the information society, demand for display devices for displaying images is increasing in various forms. Therefore, various flat panel display devices such as liquid crystal displays, plasma display panels, organic light emitting display devices and the like have been utilized.

Among flat panel display devices, an organic light emitting display device includes a display panel having data lines, scan lines, and a plurality of pixels arranged in a form of a matrix where the data lines and the scan lines cross, a data driver for supplying data voltages to the data lines, and a scan driver for supplying scan signals to the scan lines. Also, the display panel further includes a power supply unit for supplying a plurality of power voltages. Each of the pixels controls, using a plurality of transistors, a current flowing from a first power voltage among the plurality of power voltages to the organic light emitting diode according to the data voltage supplied through the data line when the scan signal is supplied, thereby emitting light having a predetermined brightness.

Meanwhile, defects may occur at transistors of pixels during a manufacturing process of an organic light emitting display device, and as a result, the yield of the organic light emitting display device may be reduced. In order to improve the efficiency, a method of repairing defective pixels has been proposed in which auxiliary pixels are formed in organic light emitting display devices, in which the defective pixel is coupled to any one of the auxiliary pixels (Korean Patent No. 10-0666639).

The method of repairing includes disconnecting transistors of defective pixels from respective organic light emitting diodes and connecting transistors of auxiliary pixels and anode electrodes of the organic light emitting diodes of the defective pixels using auxiliary lines. As a result, the organic light emitting diodes of the defective pixels may emit light by driving the transistors of the auxiliary pixels.

However, parasitic capacitance may be formed between an auxiliary line and the anode electrodes of the organic light emitting diodes, and fringe capacitance may be formed between the auxiliary line and an adjacent scan line. Here, the voltage of the auxiliary line may change due to the fringe capacitance, causing organic light emitting diodes of the repaired pixels to emit light erroneously.

SUMMARY

Exemplary embodiments provide an organic light emitting display device capable of preventing or substantially preventing an organic light emitting diode of a repaired pixel from emitting light erroneously.

An organic light emitting display device according to an exemplary embodiment includes data lines and an auxiliary data line; scan lines and emission control lines crossing the data lines and the auxiliary data line; display pixels at crossing regions of the data lines, the scan lines and the emission control lines; auxiliary pixels at crossing regions of the auxiliary data line, the scan lines and the emission control lines; and auxiliary lines coupled to the auxiliary pixels, wherein each of the auxiliary pixels includes: a discharge transistor coupled to one of the auxiliary lines and a first power voltage line to which a first power voltage is supplied; and a discharge transistor controller including a plurality of transistors and configured to control (e.g., control turning-on and turning-off) the discharge transistor.

The discharge transistor controller may include first and second discharge control transistors coupled to a control electrode of the discharge transistor, wherein a control electrode of the first discharge control transistor and a control electrode of the second discharge control transistor may be coupled to different lines.

The control electrode of the first discharge control transistor may be coupled to one of the emission control lines, a first electrode may be coupled to one of the scan lines, and a second electrode may be coupled to the control electrode of the discharge transistor, the control electrode of the second discharge control transistor and a second electrode may be coupled to one of the scan lines, and a first electrode may be coupled to the control electrode of the discharge transistor.

The discharge transistor controller may include a capacitor coupled to the control electrode of the discharge transistor and a second power voltage line to which a second power voltage is supplied.

The control electrode of the first discharge control transistor may be coupled to one of the emission control lines, a first electrode may be coupled to a gate-off voltage line to which a gate-off voltage is supplied, a second electrode may be coupled to the control electrode of the discharge transistor, and the control electrode of the second discharge control transistor may be coupled to one of the scan lines, a first electrode may be coupled to the control electrode of the discharge transistor, and a second electrode may be coupled to a gate-on voltage line to which a gate-on voltage is supplied.

The discharge transistor controller may include a capacitor coupled to the control electrode of the discharge transistor and a gate-off voltage line to which a gate-off voltage is supplied, or coupled to the control electrode of the discharge transistor and a gate-on voltage line to which a gate-on voltage is supplied.

The discharge transistor controller may further include a third discharge control transistor coupled to the control electrode of the discharge transistor, wherein the control electrode of the first discharge control transistor, the control electrode of the second discharge control transistor and a control electrode of the third discharge control transistor may be coupled to different lines.

The control electrode of the first discharge control transistor may be coupled to one of the emission control lines, a first electrode may be coupled to one of the scan lines, a second electrode may be coupled to the control electrode of the discharge transistor, the control electrode of the second discharge control transistor and a second electrode may be coupled to one of the scan lines, a first electrode may be coupled to the control electrode of the discharge transistor, the control electrode of the third discharge control transistor and a second electrode may be coupled to another one of the scan lines, and a first electrode may be coupled to the control electrode of the discharge transistor.

The control electrode of the first discharge control transistor may be coupled to one of the emission control lines, a first electrode may be coupled to a gate-off voltage line to which a gate-off voltage is supplied, a second electrode may be coupled to the control electrode of the discharge transistor, wherein the control electrode of the second discharge control transistor may be coupled to one of the scan lines, a first electrode of the second discharge control transistor may be coupled to the control electrode of the discharge transistor, and a second electrode of the second discharge control transistor may be coupled to a gate-on voltage line to which a gate-on voltage is supplied, wherein the control electrode of the third discharge control transistor may be coupled to another one of the scan lines, a first electrode of the third discharge control transistor may be coupled to the control electrode of the discharge transistor, and a second electrode of the third discharge control transistor may be coupled to the gate-on voltage line.

The control electrode of the first discharge control transistor and a second electrode of the first discharge control transistor may be coupled to the control electrode of the discharge transistor, and a first electrode of the first discharge control transistor may be coupled to a pull-down control node of an emission stage configured to output an emission control signal to one of the emission control lines, wherein the control electrode of the second discharge control transistor and a second electrode of the second discharge control transistor may be coupled to one of the scan lines, and a first electrode of the second discharge control transistor may be coupled to the control electrode of the discharge transistor.

The control electrode of the first discharge control transistor and a second electrode of the first discharge control transistor may be coupled to the control electrode of the discharge transistor, and a first electrode of the first discharge control transistor may be coupled to a pull-down control node of an emission stage configured to output an emission control signal to one of the emission control lines, wherein the control electrode of the second discharge control transistor may be coupled to one of the scan lines, a first electrode of the second discharge control transistor may be coupled to the control electrode of the discharge transistor, and a second electrode of the second discharge control transistor may be coupled to a gate-on voltage line to which a gate-on voltage is supplied.

One of the auxiliary lines may be configured to couple one of the auxiliary pixels and one of the display pixels.

At least one of the display pixels may include: an organic light emitting diode; and a display pixel driver including a plurality of transistors and configured to supply a driving current to the organic light emitting diode.

The display pixel driver may include: a first transistor configured to control the driving current according to a voltage of a control electrode of the first transistor; a second transistor coupled to one of the data lines and a first electrode of the first transistor; a third transistor coupled to the control electrode of the first transistor and a second electrode of the first transistor; a fourth transistor coupled to the control electrode of the first transistor and a third power voltage line to which a third power voltage is supplied; a fifth transistor coupled between the first electrode of the first transistor and a second power voltage line to which a second power voltage is supplied; a sixth transistor coupled between the second electrode of the first transistor and an anode electrode of the organic light emitting diode; a seventh transistor coupled to the anode electrode of the organic light emitting diode and the third power voltage line; and a storage capacitor coupled between the control electrode of the first transistor and the second power voltage line.

Control electrodes of the second and third transistors may be coupled to one of the scan lines, control electrodes of the fourth and seventh transistors may be coupled to another one of the scan lines, and control electrodes of the fifth and sixth transistors may be coupled to one of the emission control lines.

At least one of the auxiliary pixels may further include an auxiliary pixel driver including a plurality of transistors and configured to supply a driving current to at least one of the auxiliary lines.

The auxiliary data line may include a plurality of auxiliary data lines, wherein the auxiliary pixel driver may include: a first transistor configured to control the driving current according to a voltage of a control electrode of the first transistor; a second transistor coupled to one of the auxiliary data lines and a first electrode of the first transistor; a third transistor coupled to the control electrode of the first transistor and a second electrode of the first transistor; a fourth transistor coupled to the control electrode of the first transistor and a third power voltage line to which a third power voltage is supplied; a fifth transistor coupled to the first electrode of the first transistor and a second power voltage line to which a second power voltage is supplied; a sixth transistor coupled to the second electrode of the first transistor and the at least one of the auxiliary lines; and a storage capacitor coupled to the control electrode of the first transistor and the second power voltage line.

Control electrodes of the second and third transistors may be coupled to one of the scan lines, a control electrode of the fourth transistor may be coupled to another one of the scan lines, and control electrodes of the fifth and sixth transistors may be coupled to one of the emission control lines.

The device may further include: a scan driver configured to supply scan signals to the scan lines and to supply emission control signals to the emission control lines; a first data driver configured to supply data voltages to the data lines; and a second data driver configured to supply auxiliary data voltages to the auxiliary data line.

The second data driver may include: an auxiliary data calculator configured to calculate auxiliary data from digital video data corresponding to a coordinate value of a repaired pixel from among the display pixels; a memory configured to store the auxiliary data and to be periodically updated with initialization data; and an auxiliary data voltage converter configured to receive the auxiliary data or the initialization data from the memory, to convert the auxiliary data or the initialization data into an auxiliary data voltage, and to output the auxiliary data voltage.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
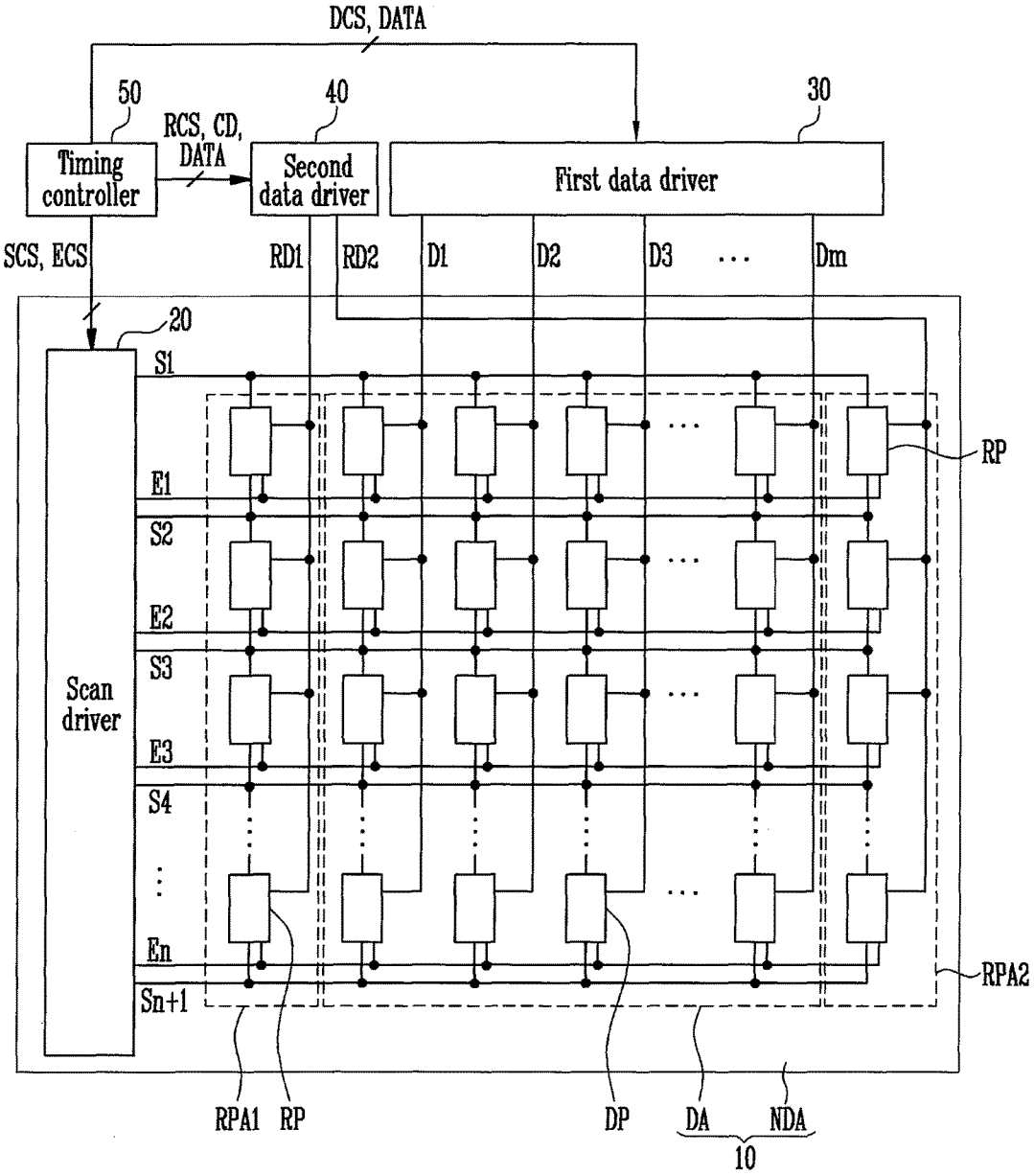
FIG. 1 is a block diagram showing an organic light emitting display device according to an exemplary embodiment.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "on" another element, it can be directly on the another element or be indirectly on the another element with one or more intervening elements interposed therebetween. In the drawings, the thickness or size of layers are exaggerated for clarity and not necessarily drawn to scale.

FIG. 1 is a block diagram showing an organic light emitting display device according to an exemplary embodiment. Referring to FIG. 1, the organic light emitting display device according to an exemplary embodiment includes a display panel 10, a scan driver 20, a first data driver 30, a second data driver 40, a timing controller 50, and the like.

In the display panel 10, there may be provided data lines D1 to Dm (where m is a positive integer of two or greater), auxiliary data lines RD1 and RD2, scan lines S1 to Sn+1 (where n is a positive integer of two or greater) and emission control lines E1 to En. The data lines D1 to Dm and the auxiliary data lines RD1 and RD2 may be formed side by side (e.g., may be parallel to each other). Each of the auxiliary data lines RD1 and RD2 may be formed outside of both sides of the data lines D1 to Dm. For example, the first auxiliary data line RD1 may be formed outside on one side of the data lines D1 to Dm, and the second auxiliary data line RD2 may be formed outside on the other side of the data lines D1 to Dm. The data lines D1 to Dm and the scan lines S1 to Sn+1 may be formed to cross each other. The auxiliary data lines RD1 and RD2 and the scan lines S1 to Sn+1 may also be formed to cross each other. The scan lines S1 to Sn+1 and the emission control lines E1 to En may be formed side by side (e.g., may be parallel to each other).

The display pane 10 may include a display area DA where there are display pixels displaying images and a non-display area NDA which may constitute an area that is not the display area DA. The non-display area NDA may include first and second auxiliary pixel areas RPA1 and RPA2 where auxiliary pixels RP are provided. The auxiliary pixels RP are for repairing the display pixels DP. The auxiliary pixels RP coupled to a first auxiliary data line RD1 may be provided in the first auxiliary pixel area RPA1, and the auxiliary pixels RP coupled to a second auxiliary data line RD2 may be provided in the second auxiliary data line RD2.

In the display area DA, the display pixels DP may be arranged in the form of a matrix at crossing regions of the data lines D1 to Dm and the scan lines S1 to Sn+1. Each of the display pixels DP may be coupled to any one of the data lines, any two of the scan lines and any one of the emission control lines.

In each of the auxiliary pixel regions RPA1 and RPA2, the auxiliary pixels RP may be arranged at crossing regions of the respective auxiliary data lines RD1 and RD2 and the scan lines S1 to Sn+1. The auxiliary pixels RP are pixels for repairing the display pixels DP at which defects occurred during a manufacturing process of the display panel 10. Each of the auxiliary pixels RP may be coupled to any one of the auxiliary data lines, any two of the scan lines, any one of the emission control lines and any one of the auxiliary lines RL. The auxiliary line RL may extend into the display area DA from the auxiliary pixel RP, and may be overlapped with the display pixels DP.

When defects occur at the display pixels DP, the defective display pixel may be coupled to the auxiliary line RL through a laser short-circuit process. Accordingly, the auxiliary pixel RP may be coupled to the defective display pixel DP via the auxiliary line RL, and the defective display pixel may be repaired using the auxiliary pixel RP. For convenience of illustration, the display pixels DP at which defects occurred and which are repaired may also be called repaired pixels.

A detailed description regarding the display pixels DP and the auxiliary pixels RP of the display panel 10 according to an exemplary embodiment will be described with reference to FIG. 2.

Also, a plurality of power voltage lines for supplying a plurality of power voltages to the display pixels DP and the auxiliary pixels RP may be provided in the display panel 10. For convenience of illustration, the plurality of power voltage lines are not shown in FIG. 1.

The scan driver 20 may include a scan signal output unit configured to output scan signals to the scan lines S1 to Sn+1 and an emission control signal output unit configured to output emission control signals to the emission control lines E1 to En. The scan signal output unit may receive a scan timing control signal SCS from the timing controller 50 and output the scan signals to the scan lines S1 to Sn+1 according to the scan timing control signal SCS. The emission control signal output unit may receive an emission timing control signal ECS from the timing controller 50 and output the emission control signals to emission control lines E1 to En according to the emission timing control signal ECS.

The scan signal output unit and the emission control signal output unit may be formed using an amorphous silicon gate in pixel (ASG) or a gate driver in panel (GIP) method in the non-display area NDA of the display panel 10. Each of the scan signal output unit and the emission control signal output unit may include scan stages that are dependently coupled. The scan stages may output the scan signals to the scan lines S1 to Sn+1 sequentially, and the emission stages may output the emission control signals to the emission control lines E1 to En sequentially. A detailed description of the emission stages according to some embodiments will be provided with reference to FIG. 18.

The first data driver 30 may include at least one source drive IC. The source drive IC may receive digital video data DATA and a source timing control signal DCS from the timing controller 50. The source drive IC may convert the digital video data DATA into data voltages in response to the source timing control signal DCS. The source drive IC may supply the data voltages to the data lines D1 to Dm synchronizing the data voltages to each of the scan signals. Accordingly, the data voltages may be supplied to the display pixels DP to which one or more scan signals are supplied.

The second data driver 40 may receive a repair control signal RCS, the digital video data DATA and coordinate data CD of repaired pixels from the timing controller 50. The second data driver 40 may generate auxiliary data voltages using the coordinate data CD of the repair control signal RCS, the digital video data DATA and the repaired pixels. The second data driver 40 may supply the auxiliary data voltages to the auxiliary data lines RD1 and RD2 by synchronizing each of the auxiliary data voltages to the scan signals. Accordingly, the auxiliary data voltages may be supplied to the auxiliary pixels RP to which one or more of the scan signals are supplied.

To repair the repaired pixel, the second data driver 40 may supply an auxiliary data voltage which is the same or substantially the same as the data voltage to be supplied to the repaired pixel to the auxiliary pixel coupled to the repaired pixel. A detailed description regarding the second data driver 40 will be provided with reference to FIGS. 2 through 4A and 4B.

The timing controller 50 may receive the digital video data DATA and timing signals (not shown) from outside. The timing signals (not shown) may include vertical sync signals, horizontal sync signals, data enable signals, dot clocks, and the like, but are not limited thereto. The timing controller 50 may generate timing control signals to control the scan driver 20 and the first data driver 30 based on the timing signals. The timing control signals may include a scan timing control signal SCS for controlling operation timing of the scan signal output unit, an emission timing control signal ECS for controlling operation timing of the emission control signal output unit of the scan driver 20, and a source timing control signal DCS for controlling operation timing of the first data driver 30. The timing controller 50 may output the scan timing control signal SCS and the emission timing control signal ECS to the scan driver 20 and may output the source timing control signal DCS and the digital video data DATA to the first data driver 30.

The timing controller 50 may generate a repair control signal RCS and the coordinate data CD of the repaired pixel. The repair control signal RCS may be a signal for instructing or indicating whether there is a repaired pixel or not. For example, if there is a repaired pixel, the repair control signal RCS may be generated as a first logic level voltage, and if there is no repaired pixel, the repair control signal RCS may be generated with a second logic level voltage. The coordinate data CD of the repaired pixel may be stored in a memory of the timing controller 50. The timing controller 50 may output the repair control signal RCS, the coordinate data CD of the repaired pixel, and the digital video data DATA to the second data driver 40.

The organic light emitting display device according to an exemplary embodiment may further include a power supply source (not shown). The power supply source (not shown) may supply a plurality of power voltages to a plurality of power voltage lines. For example, the power supply source (not shown) may supply first to fourth power voltages to the first to fourth power voltage lines. A detailed description regarding the plurality of power voltage lines and the plurality of power voltages will be provided with reference to FIG. 5. Also, the power supply source (not shown) may supply a gate-off voltage to a gate-off voltage line and a gate-on voltage to a gate-on voltage line. A detailed description of the gate-off voltage and the gate-on voltage will be provided with reference to FIG. 6.

Figure 2:
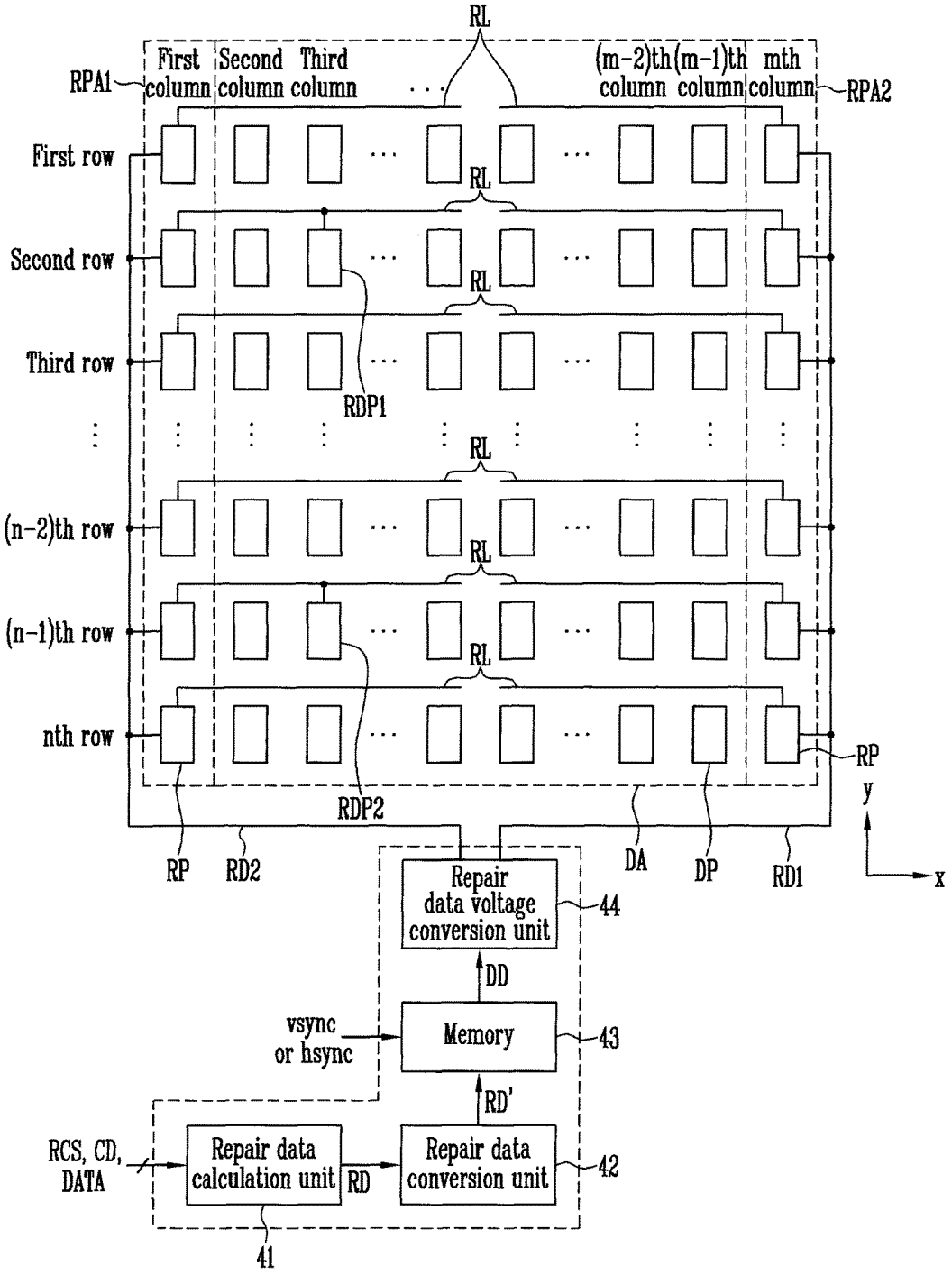
FIG. 2 is a block diagram showing in detail display pixels, auxiliary pixels, auxiliary lines, auxiliary data lines and a second data driver.

FIG. 2 is a block diagram showing in detail display pixels, auxiliary pixels, auxiliary lines, auxiliary data lines and a second data driver shown in FIG. 1. For convenience of illustration, FIG. 2 only shows the display pixels DP of the display panel 10, the auxiliary pixels RP, the auxiliary lines RL, the auxiliary data lines RD1 and RD2 and the second data driver 40.

Referring to FIG. 2, each of the display pixels DP may include the display pixel driver 110 and an organic light emitting diode OLED. The organic light emitting diode OLED may emit light (e.g., light having predetermined brightness) according to a driving current of the display pixel driver 110. An anode electrode of the organic light emitting diode OLED may be coupled to the display pixel driver 110, and a cathode electrode may be coupled to a fourth power voltage line VSSL to which a fourth power voltage is supplied. The fourth power voltage may be a low potential power voltage. A detailed description of the display pixel driver 110 will be provided with reference to FIG. 5.

Each of the auxiliary pixels may include an auxiliary pixel driver 210 and a discharge transistor DT. The auxiliary pixel driver 210 and the discharge transistor DT may be coupled to the auxiliary line RL. The auxiliary pixel driver 210 may supply a driving current to the auxiliary line RL. The discharge transistor DT may discharge the auxiliary line RL to the first power voltage. The discharge transistor DT may be coupled to the auxiliary line RL and the first power voltage line VINL1 to which the first power voltage is supplied. The control electrode of the discharge transistor DT may be coupled to various signal lines, which will be described with reference to FIGS. 5, 8, 10, 13 and 15.

The auxiliary line RL may be coupled to the auxiliary pixel RP and go across the display pixels DP by extending into the display area DA from the auxiliary pixel RP. For example, the auxiliary line RL as shown in FIG. 2 may be coupled to the auxiliary pixel RP of a p-th row (where p is a positive integer and $1 \leq p \leq n$) and may go across the display pixels DP of the p-th row/line. Also, as shown in FIG. 2, the auxiliary line RL may go across the anode electrodes of the organic light emitting diode OLED of the display pixels DP.

The auxiliary line RL may be coupled to any one of the display pixels DP of the display area DA. Here, the display pixel DP coupled to the auxiliary line RL corresponds to a defective pixel which needs to be repaired. In FIG. 2, the display pixel DP coupled to the auxiliary line RL is defined as repaired pixel RDP1 or RDP2. For example, the auxiliary line RL may be coupled to the anode electrode of the organic light emitting diode OLED of the repaired pixel RDP1 or RDP2. Here, the display pixel driver 110 of the repaired pixel RDP1 or RDP2 and the organic light emitting diode OLED may be disconnected.

The auxiliary pixels RP of the first auxiliary pixel area RPA1 may be coupled to the first auxiliary data line RD1, and the auxiliary pixels RP of the second auxiliary pixel area RPA2 may be coupled to the second auxiliary data line RD2. The display pixels DP of the display area DA may be coupled to the data lines D1 to Dm, but in FIG. 2, for convenience of illustration, the data lines D1 to Dm are omitted.

The second data driver 40 may include an auxiliary data calculation unit (or a repair data calculation unit or an auxiliary data calculator) 41, an auxiliary data conversion unit (or a repair data conversion unit or an auxiliary data converter) 42, a memory 43 and an auxiliary data voltage conversion unit (or a repair data voltage conversion unit or an auxiliary data voltage converter) 44. A method for driving the second data driver 40 will be described with reference to FIGS. 2 and 3.

Figure 3:
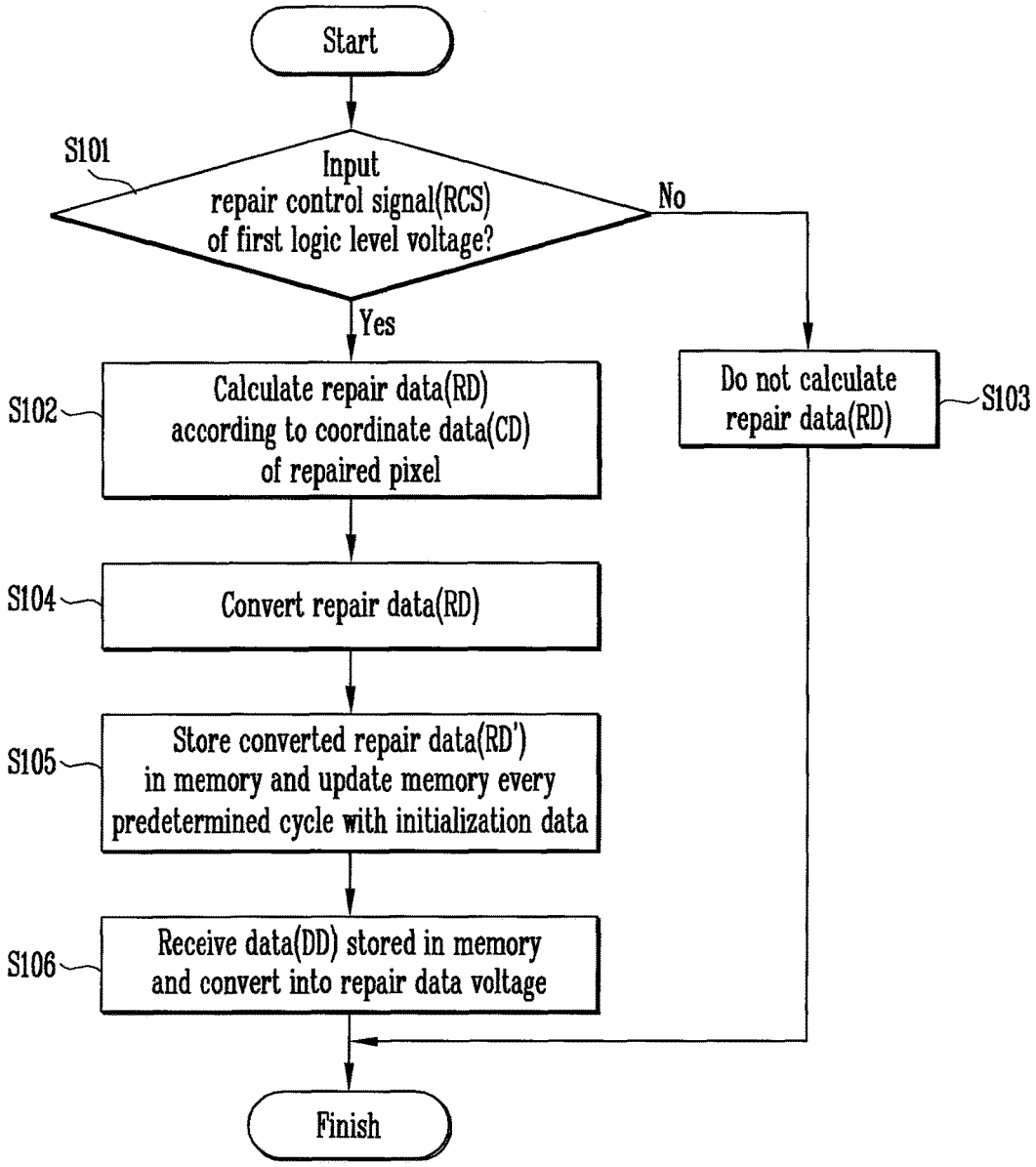
FIG. 3 is a flow chart diagram showing a method for driving the second data driver shown in FIG. 2.

FIG. 3 is a flow chart diagram showing a method for driving the second data driver shown in FIG. 2. Referring to FIG. 3, the method for driving the second data driver may include S101 to S106.

First, the auxiliary data calculation unit 41 may receive the repair control signal RCS, the digital video data DATA and the coordinate data CD of the repaired pixel RDP1 or RDP2. When the repair data calculation unit 41 receives the repair control signal RCS of the first logic level voltage, the auxiliary data calculation unit 41 may calculate the auxiliary data RD, and when the repair control signal RCS of the second logic level voltage is received, the auxiliary data calculation unit 41 may not calculate the auxiliary data RD. That is, when the repair control signal RCS of the first logic level voltage is input, the auxiliary data calculation unit 41 may calculate the auxiliary data RD from the digital video data DATA according to the coordinate data CD of the repaired pixel.

The auxiliary data calculation unit 41 may calculate the auxiliary data RD from the digital video data corresponding to the coordinate value of the repaired pixel RDP1 or RDP2. For example, when the repaired pixel RDP1 is located in a second row, second column as shown in FIG. 2, the coordinate value of the first repaired pixel RDP1 may be (2,2). In FIG. 2, only the rows and the columns of the display area DA are shown. Also, when n display pixels DP are arranged in a column direction (y-axis), the coordinate value of the second repaired pixel RDP1 may be (n−1, 2) because the second repaired pixel RDP may be located at the (n−1)-th row, second column.

The auxiliary data calculation unit 41 may calculate the auxiliary data RD to be supplied to the auxiliary pixel RP coupled to the first repaired pixel RDP1 from the digital video data corresponding to the coordinate value (2, 2) and calculate the auxiliary data RD to be supplied to the auxiliary pixel RP coupled to the second repaired pixel RDP2 from the digital video data corresponding to the coordinate value (n−1, 2). The auxiliary data calculation unit 41 may output the auxiliary data RD to the auxiliary data conversion unit 42. (S101, S102, S103.)

The auxiliary data conversion unit 42 may receive the auxiliary data RD from the auxiliary data calculation unit 41. The repaired pixel RDP1 or RDP2 may receive the auxiliary data voltage from the auxiliary pixel RP via the auxiliary line RL. Accordingly, the auxiliary data conversion unit 42 may convert the auxiliary data RD by adding data (e.g., predetermined data) to the auxiliary data RD by considering wire resistance of the auxiliary line RL and parasitic capacitance generated at the auxiliary line RL, and/or the like. The auxiliary data conversion unit 42 may output the converted auxiliary data RD' to the memory 43.

Meanwhile, in other embodiments, the auxiliary data conversion unit 42 may be omitted. In those embodiments, the auxiliary data conversion unit 41 may output the auxiliary data RD to the memory 43 (S104).

The memory 43 may receive from the auxiliary data conversion unit 42 the converted auxiliary data RD' and store it. The memory 43 may receive the auxiliary data RD from the auxiliary data calculation unit 41 and store it when the auxiliary data conversion unit 42 is omitted.

The memory 43 may be set to be updated to initialization data. For example, the memory 43 may be set to be updated to initialization data every predetermined period. For example, the memory 43 may receive a signal instructing a period (e.g., a predetermined period) from the timing controller 50. The signal instructing the period may be a vertical sync signal generating a pulse per frame period or a horizontal sync signal generating a pulse per horizontal period. One frame period refers to a period during which data voltages are supplied to all display pixels DP, and one horizontal period refers to a period during which data voltages are supplied to the display pixels DP of any one row. When the signal instructing the period is a vertical sync signal vsync, the memory 43 may be updated to the initialization data every frame period. When the signal instructing the period is a horizontal sync signal hsync, the memory 43 may be updated to the initialization data every one horizontal period. The memory 43 may be implemented as a register. The memory 43 may output stored data DD to the auxiliary data voltage conversion unit 44 (S105).

The auxiliary data voltage conversion unit 44 may receive and convert the data DD stored in the memory 43 into the auxiliary data voltage. The auxiliary data voltage conversion unit 44 may supply the auxiliary data voltages to the auxiliary data lines RD1 and RD2 by synchronizing them to the scan signals, respectively. Accordingly, the auxiliary data voltages supplied to the auxiliary data lines RD1 and RD2 may be respectively synchronized to the data voltages supplied to the data lines D1 to Dm and be supplied. That is, the auxiliary data voltage, to be supplied to the p-th auxiliary pixel RP, may be synchronized to the data voltages supplied to the display pixels DP of the p-th row and be supplied to the p-th auxiliary pixel RP (S106).

As described above, according to an exemplary embodiment, the auxiliary data RD may be calculated from the digital video data DATA corresponding to the coordinate value of the repaired pixel RDP1 or RDP2. As a result, an auxiliary data voltage which is the same or substantially the same as the data voltage to be supplied to the repaired pixel RDP1 or RDP2 may be supplied to the auxiliary pixel RP coupled to the repaired pixel RDP1 or RDP2 according to an exemplary embodiment of the present invention.

Figure 4A:
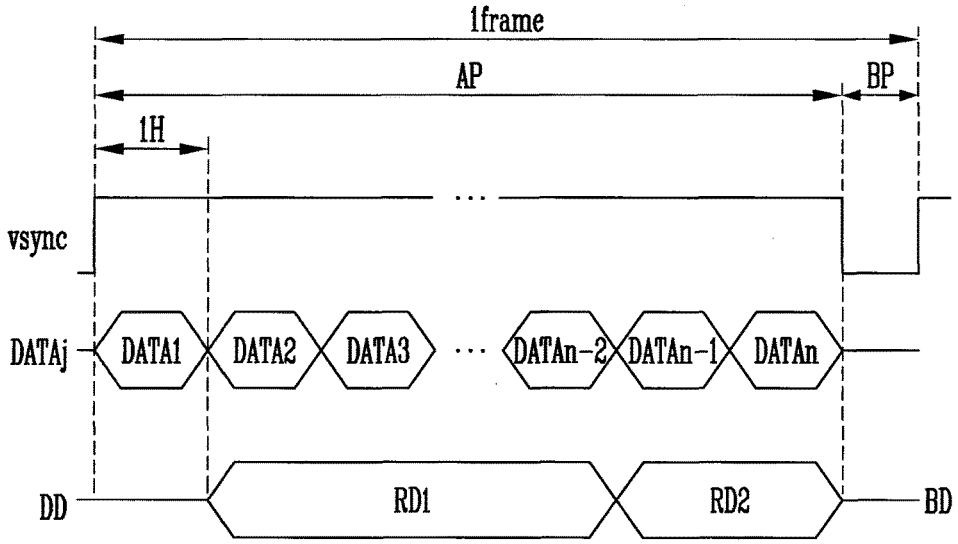
FIGS. 4A and 4B are exemplary diagrams showing data voltages output from the first data driver and auxiliary data voltages output from an auxiliary data voltage conversion unit of the second data driver shown in FIG. 2.

FIG. 4A is an exemplary diagram showing data voltages output form the first data driver and auxiliary data voltages output from the auxiliary data voltage conversion unit of the second data driver shown in FIG. 2. In FIG. 4A, only the vertical sync signal vsync, data voltages DVi output to an i-th data line Di (where i is a positive integer and $1 \leq i \leq m$) and auxiliary data voltages RDV output from the auxiliary data voltage conversion unit 44 are shown.

Referring to FIG. 4A, one frame period (1 frame) may include an active period AP during which the data voltages are supplied to the display pixels DP and a blank period BP which is a dormant period. The vertical sync signal may generate a pulse for one frame period (1 frame) as a cycle. The data voltages DVi output to the i-th data line Di may include first to n-th data voltages DV1 to DVn. Here, the auxiliary data voltage supplied to the auxiliary pixel RP of the p-th row may be synchronized to the data voltages supplied to the display pixels DP of the p-th row and be supplied.

As shown in FIG. 2, the first repaired pixel RDP1 may be located on the second row, and the second repaired pixel RDP2 may be located on the (n−1)-th row. Here, as shown in FIG. 4A, in the memory 43, the first auxiliary data voltage RDV1 can be supplied to the auxiliary data line RD1 or RD2 synchronized in a period during which the data voltage of second row DV2 is supplied to the i-th data line Di. Also, the second auxiliary data voltage RDV2 can be supplied to the auxiliary data line RD1 or RD2 synchronized in a period during which the data voltage of n−1th row DVn−1 is supplied to the-i-th data line Di.

Meanwhile, when the signal instructing the period (e.g., a predetermined period) is a vertical sync signal vsync, the memory 43 may be updated to initialization data BC every frame period. Therefore, the auxiliary data voltage conversion unit 44 may receive, as shown in FIG. 4A, the first auxiliary data RD1 from the memory 43 from the period in which the data voltage DV2 is supplied to the display pixel of the second row to the period in which the data voltage DVn−2 is supplied to the display pixel of the (n−2)-th row, convert the input first auxiliary data RD1 into the first auxiliary data voltage RDV1 and output it to the auxiliary data line RD1/RD2.

The auxiliary data voltage conversion unit 44 may receive, as shown in FIG. 4A, the second auxiliary data RD2 from the memory 43 from the period in which the data voltage DVn−1 is supplied to the display pixel of the (n−1)-th row to the period in which the data voltage DVn is supplied to the display pixel of the n-th row, convert the second auxiliary data RD2 into the second auxiliary data voltage RDV2 and output it to the auxiliary data line RD1 or RD2. Furthermore, the auxiliary data voltage conversion unit 44 may receive, as shown in FIG. 4A, the initialization data BD from the memory 43 during the period in which the data voltage DV1 is supplied to the display pixel of the first row, convert the input initialization data BD into an initialization data voltage BDV and output it to the auxiliary data line RD1 or RD2.

Eventually, as shown in FIG. 4A, each of the auxiliary data voltages supplied to the auxiliary data lines RD1 and RD2 may be synchronized to the data voltages supplied to the data lines D1 to Dm and be supplied.

Figure 4B:
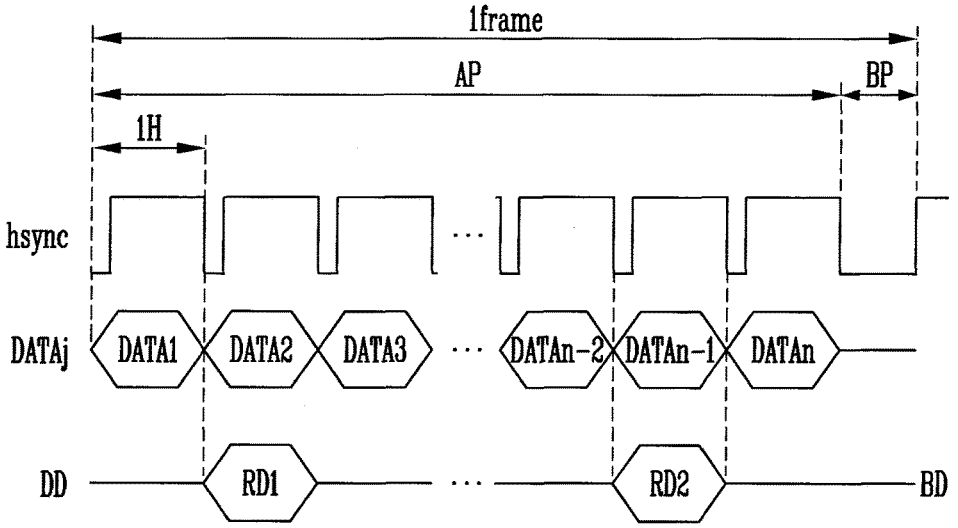

FIG. 4B is an exemplary diagram showing data voltages output from the first data driver and auxiliary data voltages output from the auxiliary data voltage conversion unit of the second data driver. In FIG. 4B, a horizontal sync signal hsync, the data voltages DVi output to the i-th data line Di and the auxiliary data voltages RDV output from the auxiliary data voltage conversion unit 44 are shown.

Referring to FIG. 4B, the frame period (1 frame) may include an active period AP during which the data voltages are supplied to the display pixels DP and a blank period BP which is a dormant period. The horizontal sync signal hsync may generate a pulse for the horizontal period (1H) as a cycle. The data voltages DVi output to the i-th data line Di may include first to n-th data voltages DV1 to DVn. Here, the auxiliary data voltage supplied to the auxiliary pixel RP of the p-th row may be synchronized to the data voltages supplied to the display pixels DP of the p-th row and be supplied.

As shown in FIG. 2, the first repaired pixel RDP1 may be located on the second row, and the second repaired pixel RDP2 may be located on the (n−1)-th row. Here, in the memory 43, the first auxiliary data voltage RDV1 can be supplied to the auxiliary data line RD1 or RD2 synchronized in a period during which the data voltage of second row DV2 is supplied to the-i-th data line Di. Also, the second auxiliary data voltage RDV2 can be supplied to the auxiliary data line RD1 or RD2 synchronized in a period during which the data voltage of n−1th row DVn−1 is supplied to the-i-th data line Di.

Meanwhile, when the signal instructing the period (e.g., a predetermined period) is the horizontal sync signal hsync, the memory 43 may be updated to the initialization data BD every horizontal period (1H). Therefore, the auxiliary data voltage conversion unit 44 may receive, as shown in FIG. 4B, the first auxiliary data RD1 from the memory 43 only during the period in which the data voltage DV2 is supplied to the display pixel of the second row, convert the input first auxiliary data RD1 into the first auxiliary data voltage RDV1 and output it to the auxiliary data line RD1/RD2.

Also, the auxiliary data voltage conversion unit 44 may receive, as shown in FIG. 4B, the second auxiliary data RD2 from the memory 43 only during the period in which the data voltage DVn−1 is supplied to the display pixel of the (n−1)-th row, convert the second auxiliary data RD2 into the second auxiliary data voltage RDV2 and output it to the auxiliary data line RD1 or RD2. Furthermore, the auxiliary data voltage conversion unit 44 may receive, as shown in FIG. 4B, the initialization data BD from the memory 43 during all periods except for the period during which the data voltage DV2 is supplied to the display pixel of the second row and the period during which the data voltage (DVn−1) is supplied to the display pixel of the (n−1)-th row, convert the input initialization data BD into the initialization data voltage BDV and output it to the auxiliary data line RD1 or RD2.

In the end, as shown in FIG. 4B, each of the auxiliary data voltages supplied to the auxiliary data lines RD1 and RD2 may be synchronized to the data voltages supplied to the data lines D1 to Dm and be supplied.

Also, as shown in FIG. 4B, the initialization data voltage BDV may be supplied to the auxiliary pixels not coupled to the repaired pixels RDP1 and RDP2. As a result, in an exemplary embodiment of the present invention, the display pixels DP of the display area may be prevented from being affected by voltage change of the auxiliary lines coupled to the auxiliary pixels not coupled to the repaired pixels RDP1 and RDP2. This is to prevent or substantially prevent the voltage change of the auxiliary line RL from occurring as a result of a driving current being supplied to the auxiliary line RL when the auxiliary pixel RP receives the auxiliary data voltage.

Figure 5:
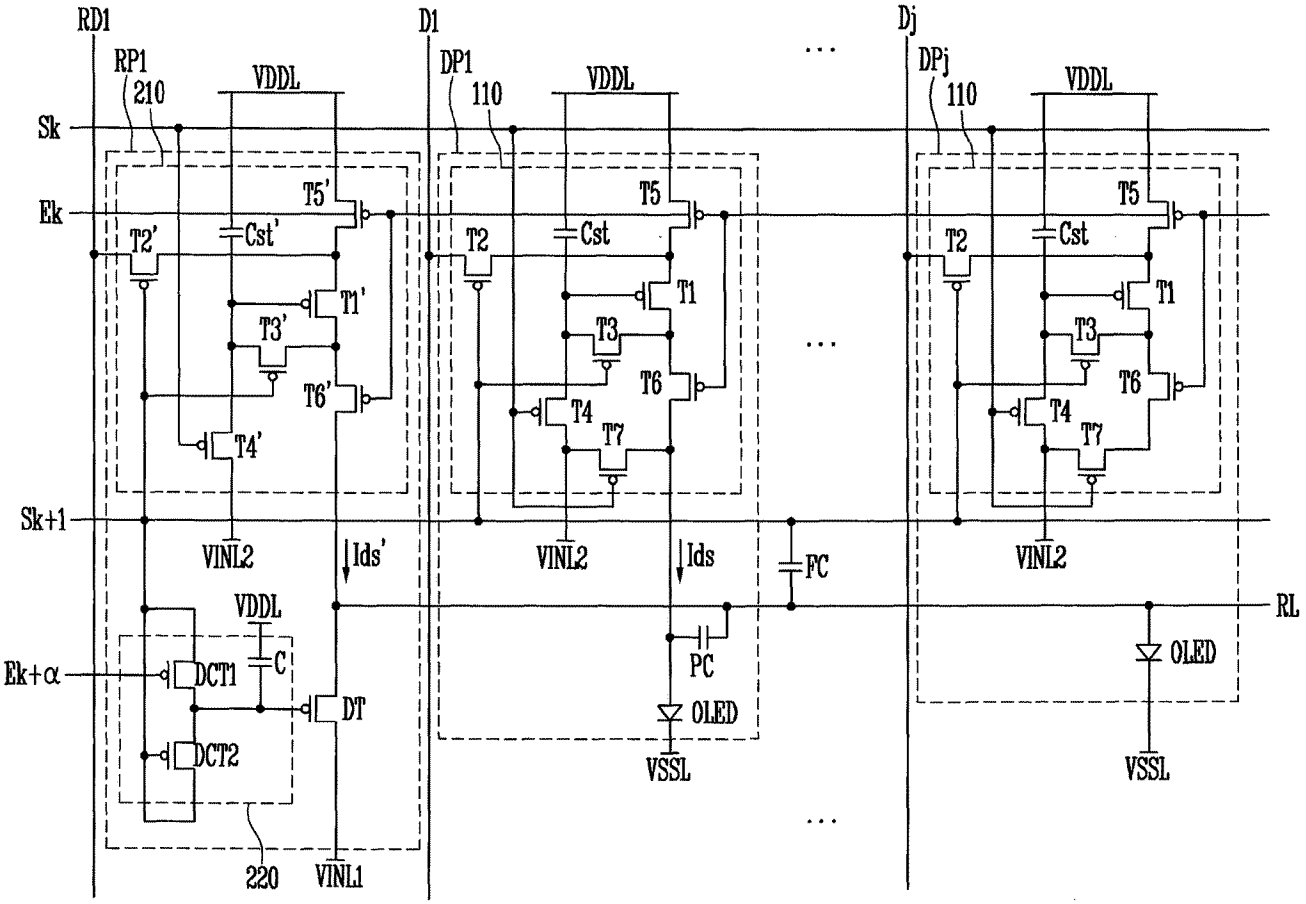
FIG. 5 is a circuit diagram showing in detail display pixels and auxiliary pixels according to an exemplary embodiment.

FIG. 5 is a circuit diagram showing in detail display pixels and auxiliary pixels according to an exemplary embodiment. In FIG. 5, for convenience of illustration, only k-th and (k+1)-th scan lines Sk and Sk+1 (where k is a positive integer and $1 \leq k \leq n$), a first auxiliary data line RD1 and first and j-th data lines D1 and Dj (where j is a positive integer and $2 \leq j \leq m$) and k-th and (k+α)-th emission control lines Ek and Ek+α are shown. Also, in FIG. 5, for convenience of illustration, only a first auxiliary pixel RP1 coupled to the first auxiliary data line RD1, the first display pixel DP1 coupled to the first data line D1, and the j-th display pixel DPj coupled to the j-th data line Dj are shown. In FIG. 5, the first display pixel DP1 is shown as a pixel at which no defect occurred during the manufacturing process, and the j-th pixel DPj is shown as a repaired pixel RDP at which one or more defects occurred during the manufacturing process and was repaired. Hereinafter, the first auxiliary pixel RP1, the first display pixel DP1 and the j-th display pixel DPj will be described with reference to FIG. 5.

Referring to FIG. 5, the first auxiliary pixel RP1 may be coupled to the j-th display pixel DPj corresponding to the repaired pixel RDP via the auxiliary line RL. For example, the auxiliary line RL may extend into the display area DA from the first auxiliary pixel RP1. The auxiliary line RL may be coupled to the organic light emitting diode OLED of the j-th display pixel DPj.

Each of the display pixels DP1 and DPj may include the organic light emitting diode OLED and the display pixel driver 110.

The display pixel driver 110 may be coupled to the organic light emitting diode OLED and may supply a driving current to the organic light emitting diode OLED. The display pixel driver 110 may be coupled to a plurality of scan lines, one or more data lines, one or more emission control lines and a plurality of power lines. For example, the display pixel driver 110 may be coupled to the k-th and (k+1)-th scan lines Sk and Sk+1, the data line D1 or Dj, the k-th emission control line Ek and the second and third power voltage lines VDDL and VINL2. The second power voltage may be supplied to the second power voltage line VDDL, and the third power voltage may be supplied to the third power voltage line VINL2. The second power voltage may be a high potential power voltage, and the third power voltage may be an initialization power voltage for initializing the display pixel driver 110.

Also, the display pixel driver 110 may include a plurality of transistors. For example, the display pixel driver 110 may include first to seventh transistors T1, T2, T3, T4, T5, T6 and T7, and a storage capacitor Cst.

The first transistor T1 may control the driving current (drain-source current) Ids according to a voltage of the control electrode (e.g., according to a voltage applied at its control electrode). The driving current Ids, flowing via a channel of the first transistor T1, is, as shown in Formula 1, in proportion to the square of the difference between the voltage between the control electrode of the first transistor T1 and the first electrode (voltage between gate-source) and the threshold voltage.

$$I_{ds}=k'\cdot(V_{gs}-V_{th})^2 \qquad \text{Formula I}$$

In Formula I, k' is a proportional number determined by structure and physical properties of the first transistor T1, Vgs is a voltage between the control electrode and the first electrode of the first transistor T1, and Vth refers to a threshold voltage of the first transistor T1.

The second transistor T2 may be coupled to the first electrode of the first transistor T1 and the first auxiliary data line RD1. The second transistor T2 may couple the first electrode of the first transistor T1 and the data line D1 or Dj by being turned on by the scan signal of the (k+1)-th scan line Sk+1. The data voltage of the data line D1 or Dj may be supplied to the first electrode of the first transistor T1. The control electrode of the second transistor T2 may be coupled to the (k+1)-th scan line Sk+1, the first electrode may be coupled to the data line D1 or Dj, and the second electrode may be coupled to the first electrode of the first transistor T1. Here, the control electrode may be a gate electrode, the first electrode may be a source electrode or a drain electrode, and the second electrode may be an electrode different from the first electrode (e.g., the other one of the source electrode and the drain electrode). For example, if the first electrode is a source electrode, the second electrode may be a drain electrode, and vice versa.

The third transistor T3 may be coupled to the control electrode and the second electrode of the first transistor T1. The third transistor T3 may couple the control electrode of the first transistor T1 and the second electrode by being turned on by the (k+1)-th scan line Sk+1. Here, since the control electrode of the first transistor T1 and the second electrode are coupled, the first transistor T1 may be driven as a diode (e.g., the first transistor T1 may be diode-connected). The control electrode of the third transistor T3 may be coupled to the (k+1)-th scan line Sk+1, the first electrode may be coupled to the second electrode of the first transistor T1, and the second electrode may be coupled to the control electrode of the first transistor T1.

The fourth transistor T4 may be coupled to the control electrode of the first transistor T1 and the third power voltage line VINL2 to which the third power voltage is supplied. The fourth transistor T4 may couple the control electrode of the first transistor and the third power voltage line VINI2 by being turned on by the scan signal of the k-th scan line Sk. The control electrode of the first transistor T1 may be initialized with the third power voltage. The control electrode of the fourth transistor T4 may be coupled to the k-th scan line Sk, the first electrode may be coupled to the control electrode of the first transistor T1, and the second electrode may be coupled to the third power voltage line VINI2.

The fifth transistor T5 may be coupled to the second power voltage line VDDL and the first electrode of the first transistor T1. The fifth transistor T5 may couple the second power voltage line VDDL and the first electrode of the first transistor T1 by being turned on by the emission control signal of the k-th emission control line Ek. As a result, the second power voltage may be supplied to the first electrode of the first transistor T1. The control electrode of the fifth transistor T5 may be coupled to the k-th emission control line Ek, the first electrode may be coupled to the second power voltage line VDDL, and the second electrode may be coupled to the first electrode of the first transistor T1.

The sixth transistor T6 may be coupled to the second electrode of the first transistor T1 and the organic light emitting diode OLED. The sixth transistor T6 may couple the second electrode of the first transistor T1 and the organic light emitting diode OLED by being turned on by the emission control signal of the k-th emission control line Ek. The control electrode of the sixth transistor T6 may be coupled to the k-th emission control Ek, the first electrode may be coupled to the second electrode of the first transistor T1, and the second electrode may be coupled to the organic light emitting diode OLED.

When the fifth and sixth transistors T5 and T6 are turned on, the driving current Ids of the display pixel driver 110 may be supplied to the organic light emitting diode OLED. As a result, the organic light emitting diode OLED of the first display pixel DP1 may emit light.

The seventh transistor may be coupled between the anode electrode of the organic light emitting diode OLED and the third power voltage line VINL2. The seventh transistor T7 may couple the anode electrode of the organic light emitting diode OLED and the third power voltage line VINL2 by being turned on by the scan signal of the k-th scan line Sk. As a result, the anode electrode of the organic light emitting diode OLED may be discharged to the third power voltage (e.g., through the third power voltage line VINL2). The control electrode of the seventh transistor T7 may be coupled to the k-th scan line Sk, the first electrode may be coupled to the anode electrode of the organic light emitting diode OLED, and the second electrode may be coupled to the third power voltage line VINL2.

The organic light emitting diode OLED may emit light according to the driving current Ids of the display pixel driver 110. The amount of the emission of the organic light emitting diode OLED may be in proportion to the driving current Ids. The anode electrode of the organic light emitting diode OLED may be coupled to the first electrode of the second transistor T2 and the second electrode of the seventh transistor T7, and the cathode electrode may be coupled to the fourth power voltage line VSSL. The fourth power voltage may be supplied to the fourth power voltage line VSSL. The fourth power voltage may be a low potential power voltage.

The storage capacitor Cst may be coupled to the control electrode of the first transistor T1 and the second power voltage line VDDL, maintaining the voltage of the control electrode of the first transistor T1. The electrode on one side (e.g., a first terminal) of the storage capacitor Cst may be coupled to the control electrode of the first transistor T1, and the electrode on the other side (e.g., a second terminal) of the storage capacitor Cst may be coupled to the second power voltage line VDDL.

The first auxiliary pixel RP1 may include an auxiliary pixel driver 210, a discharge transistor DT, and a discharge transistor controller 220. The first auxiliary pixel RP1 may not include an organic light emitting diode OLED.

The auxiliary pixel driver 210 may supply the driving current by being coupled to the organic light emitting diode OLED of the j-th display pixel DPj via the auxiliary line RL. The auxiliary pixel driver 210 may be coupled to a plurality of scan lines, an auxiliary data line, a plurality of emission control lines, and a plurality of power lines. For example, the auxiliary pixel driver 210 may be coupled to the k-th and (k+1)-th scan lines Sk and Sk+1, a first auxiliary data line RD1, a k-th and (k+α)-th emission control lines Ek and Ek+α, and second and third power voltage lines VDDL and VINL2. Also, the auxiliary pixel driver 210 may include a plurality of transistors. For example, the auxiliary pixel driver 210 may include first to sixth transistors T1', T2', T3', T4', T5' and T6'.

The first, third, fourth and fifth transistors T1', T3', T4' and T5' of the auxiliary pixel driver 210 and the storage capacitor Cst' may be formed substantially the same as the first, third, fourth and fifth transistors T1, T3, T4 and T5 and the storage capacitor Cst. Accordingly, a detailed description on the first, third, fourth and fifth transistors T1', T3', T4' and T5' of the auxiliary pixel driver 210 and the storage capacitor Cst' will be omitted.

The second transistor T2' may be coupled to the first electrode of the first transistor T1' and the first auxiliary data line RD1. The second transistor T2' may couple the first electrode of the first transistor T1' and the first auxiliary data line RD1 by being turned on by the scan signal of the (k+1)-th scan line Sk+1. As a result, the auxiliary data voltage of the first auxiliary data line RD1 may be supplied to the first electrode of the first transistor T1'. The control electrode of the second transistor T2' may be coupled to the k-th scan line Sk, the first electrode may be coupled to the j-th data line Dj, and the second electrode may be coupled to the first electrode of the first transistor T1'.

The sixth transistor T6' may be coupled to the second electrode of the first transistor T1' and the auxiliary line RL. The sixth transistor T6' may couple the second electrode of the first transistor T1' and the auxiliary line RL by being turned on by the emission control signal of the k-th emission control line Ek. The control electrode of the sixth transistor T6' may be coupled to the k-th emission control line Ek, the first electrode may be coupled to the second electrode of the first transistor T1', and the second electrode may be coupled to the auxiliary line RL. When the fourth and fifth transistors T4' and T5' are turned on, the driving current Ids' may be supplied to the organic light emitting diode OLED of the j-th display pixel DPj via the auxiliary line RL, and thus the organic light emitting diode OLED of the j-th display pixel DPj may emit light.

The discharge transistor DT may be coupled to the auxiliary line RL and the first power voltage line VINL1. The first power voltage may be supplied to the first power voltage line VINL1. The first power voltage may be an initialization power voltage for initializing the auxiliary line RL. The first power voltage may be the same or substantially the same as the third power voltage or a different voltage from the third power voltage.

For example, the discharge transistor DT may be coupled to the auxiliary line RL and the first power voltage line VINL1 by being turned on by the voltage supplied to the control electrode of the discharge transistor DT. As a result, the voltage of the auxiliary line RL may be discharged to the first power voltage. That is, the discharge transistor DT may perform a role of discharging the auxiliary line RL. The control electrode of the discharge transistor DT may be coupled to the discharge transistor controller 220, the first electrode may be coupled to the auxiliary line RL, and the second electrode may be coupled to the first power voltage line VINL1.

The discharge transistor controller 220 may control turning on and turning off of the discharge transistor DT. The discharge transistor controller 220 may include a plurality of transistors. Also, the discharge transistor controller 220 may further include a capacitor C. The discharge transistor controller 220 may include first and second discharge control transistors DCT1 and DCT2 and the capacitor C as shown in FIG. 5.

Each of the first and second discharge control transistors DCT1 and DCT2 may be coupled to the control electrode of the discharge transistor DT. Here, the control electrode of the first discharge control transistor DCT1 and the control electrode of the second discharge control transistor DCT2 may be coupled to different lines.

For example, the first discharge control transistor DCT1 may be coupled to the control electrode of the discharge transistor DT and the (k+1)-th scan line Sk+1. The control electrode of the first discharge control transistor DCT1 may be coupled to the (k+α)-th emission control line Ek+α (where a is an integer and $-5 \leq \alpha \leq 30$), the first electrode may be coupled to the (k+1)-th scan line Sk+1, and the second electrode may be coupled to the control electrode of the discharge transistor DT. Here, if a is smaller than −5, the auxiliary line RL may be discharged before the voltage of the auxiliary line RL is changed due to parasitic capacitances PC and fringe capacitance FC, and thus there will be no effect that could be obtained by discharging the auxiliary line RL. If a is greater than 30, the auxiliary line RL may be discharged after there is a change in voltage of the auxiliary line RL due to parasitic capacitances PC and fringe capacitance FC, and thus erroneous emission of the repaired pixel RDP due to voltage change of the auxiliary line RL may be observed by the user.

The second discharge control transistor DCT2 may be coupled to the control electrode of the discharge transistor DT and the (k+1)-th scan line Sk+1. The control electrode of the second discharge control transistor DCT2 and the second electrode may be coupled to the (k+1)-th scan line Sk+1, and the first electrode may be coupled to the control electrode of the discharge transistor DT. That is, the second discharge control transistor DCT2 may be driven as a diode.

The capacitor C may be coupled to the control electrode of the discharge transistor DT and the second power voltage line VDDL and maintain the voltage of the control electrode of the discharge transistor DT. The electrode on one side of the capacitor C may be coupled to the control electrode of the discharge transistor DT, and the electrode on the other side of the capacitor C may be coupled to the second power voltage line VDDL. In some embodiments, the capacitor C may be omitted.

Meanwhile, the display pixel driver 110 of the display pixels DP1 except for the j-th display pixel DPj corresponding to the repaired pixel may be coupled to the organic light emitting diode OLED and supply the driving current to the organic light emitting diode OLED. However, the display pixel driver 110 of the j-th display pixel DPj may not be coupled to the organic light emitting diode OLED. That is, since the display pixel driver 110 of the j-th display pixel DPj may not perform its role due to defects, the display pixel driver 110 and the organic light emitting diode OLED may be disconnected through the laser short-circuit process and the anode electrode of the organic light emitting diode OLED of the j-th display pixel DPj may be coupled to the auxiliary line RL. As a result, the anode electrode of the organic light emitting diode OLED of the j-th display pixel DPj may be coupled to the auxiliary pixel driver 210 of the first auxiliary pixel RP1 via the auxiliary line RL. Therefore, the organic light emitting diode OLED of the j-th display pixel DPj may receive the driving current from the auxiliary pixel driver 210 of the first auxiliary pixel RP1 and emit light. As a result, the j-th display pixel DPj may be repaired.

For convenience of illustration, in FIG. 5, only the first auxiliary pixel RP1 is shown, and each of the auxiliary pixels may be implemented substantially the same as the first auxiliary pixel RP1. Also, for convenience of illustration, in FIG. 5, only the first display pixel DP1 is illustrated as a display pixel at which no defect occurred, and each of the display pixels at which no defect occurred may be implemented substantially the same as the first display pixel DP1. Also, for convenience of illustration, in FIG. 5, only the j-th display pixel DPj is shown as the repaired pixel, and each of the repaired pixels may be implemented substantially the same as the j-th display pixel DPj.

Meanwhile, since the auxiliary line RL and the anode electrodes of the organic light emitting diodes of the display pixels may be overlapped with each other, parasitic capacitances PC may be formed between the auxiliary line RL and the anode electrodes of the organic light emitting diodes OLED of the display pixels as shown in FIG. 5. Also, since the auxiliary line RL may be formed side by side and adjacent to the k-th scan line Sk, fringe capacitance FC may be formed between the auxiliary line RL and the k-th scan line Sk. The voltage of the auxiliary line RL may change due to the parasitic capacitances PC and the fringe capacitance FC, and as a result, there may arise a problem where the organic light emitting diode OLED of the j-th display pixel DPj corresponding to the repaired pixel erroneously emitting light.

However, the auxiliary line RL may be discharged to the first power voltage using the discharge transistor DT according to an exemplary embodiment. As a result, according to an exemplary embodiment, the voltage of the auxiliary line RL may be prevented from being changed due to the parasitic capacitances PC and the fringe capacitance FC. Therefore, according to an exemplary embodiment, the organic light emitting diode OLED may be prevented or substantially prevented from erroneously emitting light. A detailed description thereof will be provided with reference to FIG. 6.

Figure 6:
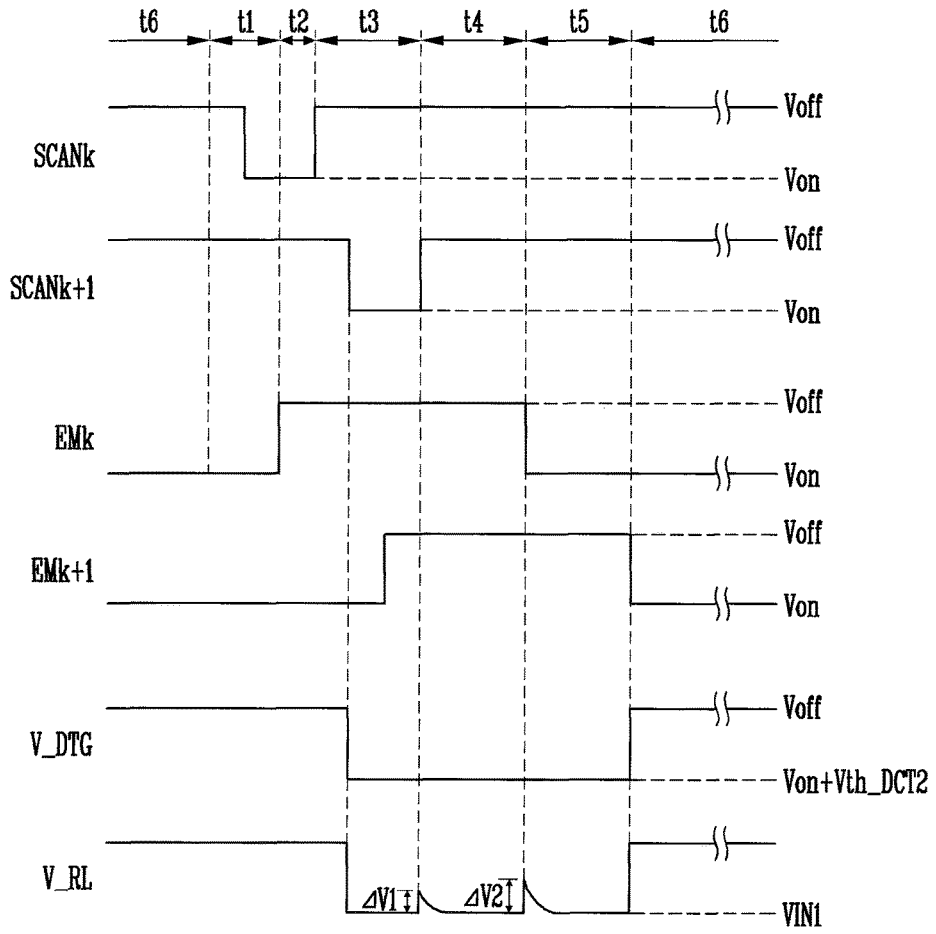
FIG. 6 is a waveform diagram showing signals supplied to display pixels and auxiliary pixels shown in FIG. 5, a voltage of a control electrode of a discharge transistor and a voltage of an auxiliary line.

FIG. 6 is a waveform diagram showing signals supplied to display pixels and auxiliary pixels shown in FIG. 5, a voltage of a control electrode of a discharge transistor and a voltage of an auxiliary line. FIG. 6 shows the k-th scan signal SCANk supplied to the k-th scan line Sk, the (k+1)-th scan signal SCANk+1 supplied to the (k+1)-th scan line Sk+1, the k-th emission control signal EMk supplied to the k-th emission control line Ek, the (k+1)-th emission control signal EMk+1 supplied to the (k+1)-th emission control line Ek+1, the voltage V_DTG supplied to the control electrode of the discharge transistor DT, and the voltage V_RL of the auxiliary line RL. Meanwhile, in FIG. 6, although the (k+1)-th emission control signal EMk+1 supplied to the (k+1)-th emission control line Ek+1 is illustrated as an example of the (k+α)-th emission control signal Ek+α supplied to the (k+α)-th emission control line Ek+α, it is not limited thereto.

Referring to FIG. 6, one frame period may be divided into first to sixth periods t1 to t6. The k-th scan signal SCANk may be generated as the gate-on voltage Von during the first and second periods t1 and t2, and the (k+1)-th scan signal SCANk+1 may be generated as the gate-on voltage Von during the third period t3. The scan signals may be generated as the gate-on voltage Von sequentially. The k-th emission signal EMk may be generated as the gate-off voltage Voff during the second to fourth periods t2 to t4, and the (k+1)-th emission signal EMk+1 may be generated as the gate-off voltage Voff during the third to fifth periods t3 to t5. The emission control signals may be generated as the gate-off voltage Voff sequentially. The gate-off voltage Voff refers to a voltage capable of turning off the transistors of the display pixels and the auxiliary pixels, and the gate-on voltage Von refers to a voltage capable of turning on the transistors of the display pixels and the auxiliary pixels.

Hereinafter, with reference to FIGS. 5 and 6, the driving method of the first auxiliary pixel RP1 and the j-th display pixel DPj and the driving method of the first display pixel DP1 will be described in detail.

The method for driving the first display pixel DP1 will be described in detail.

First, a first period t1 is a period during which an on-bias is applied to a first transistor T1.

During the first period t1, a k-th scan signal SCANk of the gate-on voltage Von may be supplied to a k-th scan line Sk, and a k-th emission control signal EMk of the gate-on voltage Von may be supplied to a k-th emission control line Ek. Therefore, fourth to seventh transistors T4, T5, T6 and T7 may be turned on during the first period t1.

Due to the fourth transistor T4 being turned on, a control electrode of the first transistor T1 may be initialized to a third power voltage VIN2 of a third power voltage line VINL2. Due to the fifth to seventh transistors T5, T6 and T7 being turned on, a current path may be formed through which a current flows from the second power voltage line VDDL to the third power voltage line VINL2 via the fifth transistor T5, the first transistor T1, the sixth transistor T6 and the seventh transistor T7. Since the first transistor T1 may be formed of a P type, if a difference Vgs in voltage between the control electrode and the first electrode of the first transistor T1 is lower than a threshold voltage Vth of the first transistor T1 (Vgs<Vth), the first transistor T1 may be turned on. Since the third power voltage VIN2 is set sufficiently lower than the second power voltage VDD, the difference in voltage between the control electrode and the first electrode of the first transistor T1 during the first period t1 (Vgs=VIN2−VDD) is lower than the threshold voltage Vth of the first transistor T1, and as a result, a current may flow through the current path.

During the first period t1, the control electrode of the first transistor T1 may be discharged to the third power voltage, and the on bias may be applied to the first transistor T1. As a result, according to an exemplary embodiment, before a data voltage is supplied to the control electrode of the first transistor T1, the on bias may be applied to the first transistor T1, and thus, problems in which image quality is deteriorated due to hysteresis characteristics of the first transistor T1 may be overcome or reduced.

Second, a second period t2 refers to a period during which the control electrode of the first transistor T1 and an anode electrode of the organic light emitting diode OLED are initialized.

During the second period t2, the k-th scan signal SCANk of the gate-on voltage Von may be supplied to the k-th scan line Sk, and the k-th emission control signal EMk of the gate-off voltage Voff is supplied to the k-th emission control line Ek. Therefore, during the second period t2, the fourth and seventh transistors T4 and T7 may be turned on.

Due to the fourth transistor T4 being turned on, the control electrode of the first transistor T1 may be initialized to the third power voltage of the third power voltage line VINL2. Due to the seventh transistor T7 being turned on, the anode electrode of the organic light emitting diode OLED may be initialized to the third power voltage of the third power voltage line VINL2.

Third, a third period t3 refers to a period during which a data voltage and a threshold voltage are sampled at the control electrode of the first transistor T1.

During the third period t3, the (k+1)-th scan signal SCANk+1 of the gate-on voltage Von may be supplied to the (k+1)-th scan line Sk+1. As a result, during the third period t3, the second and third transistors T2 and T3 may be turned on.

Due to the second transistor T2 being turned on, a data voltage Vdata of a first data line D1 may be supplied to the first electrode of the first transistor T1. Due to the third transistor T3 being turned on, since the control electrode and the second electrode of the first transistor T1 are coupled to each other, the first transistor T1 may be driven as a diode. In other words, the first transistor T1 may be diode-connected.

Since the voltage difference between the control electrode and the first electrode of the first transistor T1 (Vgs=VIN2−Vdata) is lower than the threshold voltage Vth, in the first transistor T1, the current may flow until the voltage difference Vgs between the control electrode and the first electrode reaches the threshold voltage Vth of the first transistor T1. As a result, the voltage of the control electrode of the first transistor T1 increases to "Vdata+Vth" in the third period t3.

Fourth, the fourth period t4 refers to a period during which sampling of the data voltage and the threshold voltage is completed at the control electrode of the first transistor T1.

During the fourth period t4, the (k+1)-th scan signal SCANk+1 of the gate-off voltage Voff may be supplied to the (k+1)-th scan line Sk+1. As a result, during the fourth period t4, all of the transistors of the display pixel driver 110 may be turned off.

During the fourth period t4, "Vdata+Vth" corresponding to the voltage of the control electrode of the first transistor T1 may be stored in the storage capacitor Cst.

Fifth, the fifth period t5 refers to a period during which the organic light emitting diode OLED emits light.

During the fifth period t5, the k-th emission signal Ek of the gate-on voltage Von may be supplied to the k-th emission control line Ek. As a result, the fifth and sixth transistors T5 and T6 may be turned on during the fifth period t5.

Due to the fifth and sixth transistors T5 and T6 being turned on, a driving current Ids may flow via the first transistor T1 according to the voltage of the control electrode. The control electrode of the first transistor T1 may maintain "Vdata+Vth" due to the storage capacitor Cst. Here, the driving current Ids flowing via the first transistor T1 may be defined as Formula 2 below.

$$I_{ds}=k'\cdot(V_{gs}-V_{th})^2=k'\cdot((V\text{data}+Vth)-VDD-Vth)^2 \quad \text{Formula 2}$$

In Formula 2, k' refers to a proportional number determined by structure and physical properties of the first transistor T1, Vgs refers to a voltage between gate-source of the first transistor T1, Vth refers to a threshold voltage of the first transistor T1, VDD refers to a second power voltage, and Vdata refers to a data voltage. The voltage of the control electrode of the first transistor T1 is {Vdata+Vth}, and a source voltage Vs is Vdd. Formula 3 may be derived from Formula 2.

$$I_{ds}=k'\cdot(Vdata-VDD)^2 \quad \text{Formula 3}$$

Eventually, the driving current Ids may not depend on the threshold voltage Vth of the first transistor 1 as shown in Formula 3. That is, the threshold voltage Vth of the first transistor T1 may be compensated. The driving current Ids of the display pixel driver 110 may be supplied to the organic light emitting diode OLED. As a result, the organic light emitting diode OLED may emit light.

Sixth, the sixth period t6 refers to a period during which the organic light emitting diode OLED may emit light.

During the sixth period t6, the k-th emission control signal EMk of the gate-on voltage Von may be supplied to the k-th emission control line Ek. As a result, since the fifth and sixth transistors T5 and T6 are turned on during the sixth period t6, the organic light emitting diode OLED may emit light as in the case of the fifth period t5.

Hereinafter, the method for driving the first auxiliary pixel RP1 and the j-th display pixel DPj will be described in detail.

First, the first period t1 refers to a period during which the on bias is applied to the first transistor T1'.

During the first period t1, the k-th scan signal SCANk of the gate-on voltage Von may be supplied to the k-th scan line Sk, the k-th emission control signal EMk of the gate-on voltage Von may be supplied to the k-th emission control line Ek, and the (k+1)-th emission control signal EMk+1 of the gate-on voltage Von may be supplied to the (k+1)-th emission control line Ek+1. Accordingly, during the first period t1, the fourth through sixth transistors T4', T5' and T6' and a first discharge control transistor DCT1 may be turned on.

Due to the first discharge control transistor DCT1 being turned on, the (k+1)-th scan signal Sk+1 of the gate-off voltage Voff may be supplied to the control electrode of the discharge transistor DT. Accordingly, during the first period t1, the discharge transistor DT may be turned off.

Also, due to the fourth transistor T4' being turned on, the control electrode of the first transistor T1' may be initialized to the third power voltage VIN2 of the third power voltage line VINL2. Due to the fifth to sixth transistors T5' and T6' being turned on, a current path may be formed through which a current flows from the second power voltage line VDDL to the auxiliary line RL via the fifth transistor T5', the first transistor T1', and the sixth transistor T6'. Since the third power voltage VIN2 is set sufficiently lower than the second power voltage VDD, the difference in voltage between the control electrode and the first electrode of the first transistor T1' during the first period t1 (Vgs=VIN2−VDD) is lower than the threshold voltage Vth of the first transistor T1', and as a result, a current may flow through the current path.

During the first period t1, the control electrode of the first transistor T1' may be discharged to the third power voltage, and the on bias may be applied to the first transistor T1'. As a result, according to an exemplary embodiment, before the data voltage is supplied to the control electrode of the first transistor T1', the on bias may be applied to the first transistor T1', and thus, problems in which image quality is deteriorated due to hysteresis characteristics of the first transistor T1' may be overcome or reduced.

Second, the second period t2 refers to a period during which the control electrode of the first transistor T1' and an anode electrode of the organic light emitting diode OLED are initialized.

During the second period t2, the k-th scan signal SCANk of the gate-on voltage Von may be supplied to the k-th scan line Sk, the k-th emission control signal EMk of the gate-off voltage Voff may be supplied to the k-th emission control line Ek, and the (k+1)-th emission control signal EMk+1 of the gate-on voltage Von may be supplied to the (k+1)-th emission control line Ek+1. Therefore, during the second period t2, the fourth transistor T4' and the first discharge control transistor DCT1 may be turned on.

Due to the fourth transistor T4' being turned on, the control electrode of the first transistor T1' may be initialized to the third power voltage of the third power voltage line VINL2.

Also, due to the discharge control transistor DCT1 being turned on, during the second period t2, the (k+1)-th scan signal Sk+1 of the gate-off voltage Voff may be supplied to the control electrode of the discharge transistor DT. Therefore, during the second period t2, the discharge transistor DT may be turned off.

Third, the third period t3 refers to a period during which a data voltage and a threshold voltage are sampled at the control electrode of the first transistor T1 and the auxiliary line RL is discharged to the first power voltage VIN1.

During the third period t3, the (k+1)-th scan signal SCANk+1 of the gate-on voltage Von may be supplied to the (k+1)-th scan line Sk+1, and the (k+1)-th emission control signal EMk+1 of the gate-off voltage Voff may be supplied to the (k+1)-th emission control line Ek+1. As a result, during the third period t3, the second and third transistors T2' and T3' may be turned on, the first discharge control transistor DCT1 may be turned off, and the second discharge control transistor DCT2 may be turned on.

Due to the second transistor T2' being turned on, the data voltage Vdata (or auxiliary data voltage that is substantially the same as Vdata) of the first auxiliary data line RD1 may be supplied to the first electrode of the first transistor T1'. Due to the third transistor T3' being turned on, since the control electrode and the second electrode of the first transistor T1' are coupled to each other, the first transistor T1' may be driven as a diode. In other words, the first transistor T1' may be diode-connected.

Since the voltage difference between the control electrode and the first electrode of the first transistor T1' (Vgs=VIN2−Vdata) is lower than the threshold voltage Vth, in the first transistor T1', the current may flow until the voltage difference Vgs between the control electrode and the first electrode reaches the threshold voltage Vth of the first transistor T1'. As a result, the voltage of the control electrode of the first transistor T1' increases to "Vdata+Vth" in the third period t3.

Due to the first discharge control transistor DCT1 being turned off and the second discharge control transistor DCT2 being turned on, during the third period t3, a voltage Von+Vth_DCT2 which is a sum of the gate-on voltage Von and the threshold voltage Vth_DCT2 of the second discharge control transistor DCT2 may be supplied to the control electrode of the discharge transistor DT. Accordingly, during the third period t3, the discharge transistor DT may be turned on. As a result, the auxiliary line RL may be discharged to the first power voltage VIN1 since it is coupled to the first power voltage line VINL1.

Fourth, the fourth period t4 refers to a period during which sampling of the data voltage and the threshold voltage is completed at the control electrode of the first transistor T1.

During the fourth period t4, the (k+1)-th scan signal SCANk+1 of the gate-off voltage Voff may be supplied to the (k+1)-th scan line Sk+1. As a result, during the fourth period t4, all of the transistors of the auxiliary pixel driver 210 may be turned off.

During the fourth period t4, "Vdata+Vth" corresponding to the voltage of the control electrode of the first transistor T1' may be stored in the storage capacitor Cst.

During the fourth period t4, since the control electrode of the discharge transistor DT may be floated or may maintain "Von+Vth_DCT2" due to the capacitor C, the discharge transistor DT may be turned on. As a result, during the fourth period t4, the auxiliary line RL may be discharged to the first power voltage VIN1 since it is coupled to the first power voltage line VINL1.

Meanwhile, since the (k+1)-th scan line Sk+1 and the auxiliary line RL may be formed side by side, fringe capacitance FC may be formed between the (k+1)-th scan line Sk+1 and the auxiliary line RL as shown in FIG. 5. Voltage change of the (k+1)-th scan line Sk+1 may be reflected in the auxiliary line RL due to the fringe capacitance FC. Therefore, when the (k+1)-th scan signal SCANk+1 increases to the gate-off voltage Voff from the gate-on voltage Von during the fourth period t4, the voltage of the auxiliary line RL may increase by tV1 as the voltage change of the (k+1)-th scan line Sk+1 due to the fringe capacitance FC is reflected. However, since the auxiliary line RL is coupled to the first power voltage line VINL1 during the fourth period t4, even if the voltage change of the (k+1)-th scan line Sk+1 is reflected due to the fringe capacitance FC, the auxiliary line RL is discharged to the first power voltage VIN1.

Fifth, the fifth period t5 refers to a period during which the auxiliary line RL is discharged to the first power voltage.

During the fifth period t5, the k-th emission signal Ek of the gate-on voltage Von may be supplied to the k-th emission control line Ek. As a result, the fifth and sixth transistors T5' and T6' may be turned on during the fifth period t5.

Due to the fifth and sixth transistors T5' and T6' being turned on, the first transistor T1' may allow a driving current Ids' to flow according to the voltage of the control electrode. The control electrode of the first transistor T1' may maintain "Vdata+Vth" due to the storage capacitor Cst. Here, the driving current Ids' flowing via the first transistor T1' may be defined as Formula 2. Also, Formula 3 may be derived from Formula 2.

Eventually, the driving current Ids' may not depend on the threshold voltage Vth of the first transistor T1' as shown in Formula 3. That is, the threshold voltage Vth of the first transistor T1' may be compensated.

Also, during the fifth period t5, since the control electrode of the discharge transistor DT may be floated or may maintain "Von+Vth_DCT2" due to the capacitor C, the discharge transistor DT may be turned on. As a result, during the fifth period t5, the auxiliary line RL may be discharged to the first power voltage VINL1 since it is coupled to the first power voltage line VINL1. Therefore, during the fifth period t5, the driving current Ids' of the auxiliary pixel driver 210 may be discharged to the first power voltage line VINL1 via the discharge transistor DT. Therefore, during the fifth period t5, the organic light emitting diode OLED of the j-th display pixel DPj may not emit light.

Meanwhile, since the auxiliary line RL may overlap the anode electrodes of the organic light emitting diode OLED of the display pixels DP1, parasitic capacitance PC may be formed between the auxiliary line RL and the anode electrodes of the organic light emitting diode OLED of the display pixels DP1 as shown in FIG. 5. Voltage change of the anode electrodes of the organic light emitting diode OLED may be reflected in the auxiliary line RL due to parasitic capacitance. Since the driving currents are supplied to the anode electrodes of the organic light emitting diode OLED of the display pixels DP1 due to the k-th emission control signal EMk of the gate-on voltage during the fifth period t5, the voltage of the auxiliary line RL may increase by ΔV2 as the voltage change of the anode electrodes of the organic light emitting diode OLED of the display pixels DP1 due to the parasitic capacitance PC is reflected. However, since the auxiliary line RL is coupled to the first power voltage line VINL1 during the fifth period t5, even if the voltage change of the anode electrodes of the organic light emitting diode OLED of the display pixels DP1 is reflected due to the parasitic capacitance PC, the auxiliary line RL is discharged to the first power voltage VIN1.

Sixth, the sixth period t6 refers to a period during which the organic light emitting diode OLED may emit light.

During the sixth period t6, the k-th emission control signal EMk of the gate-on voltage Von may be supplied to the k-th emission control line Ek, and the (k+1)-th emission control signal EMk+1 of the gate-on voltage Von may be supplied to the (k+1)-th emission control line Ek+1. As a result, during the sixth period t6, the fifth and sixth transistors T5' and T6' may be turned on, and the first discharge control transistor DCT1 may be turned on.

Due to the first discharge control transistor DCT1 being turned on, the (k+1)-th scan signal SCANk+1 of the gate-off voltage Voff may be supplied to the control electrode of the discharge transistor DT. Accordingly, during the sixth period t6, the discharge transistor DT may be turned off.

Due to the fifth and sixth transistors T5' and T6' being turned on, the driving current Ids' of the auxiliary pixel driver 210 may be supplied to the organic light emitting diode OLED of the j-th display pixel DPj via the auxiliary line RL. Therefore, the organic light emitting diode OLED of the j-th display pixel DPj may emit light.

As examined above, according to an exemplary embodiment, the voltage of the auxiliary line RL may be prevented or substantially prevented from changing due to parasitic capacitances PC and the fringe capacitance FC. As a result, the organic light emitting diode OLED of the j-th display pixel DPj may be prevented or substantially prevented from erroneously emitting light due to the parasitic capacitances PC and the fringe capacitance FC.

Figure 7:
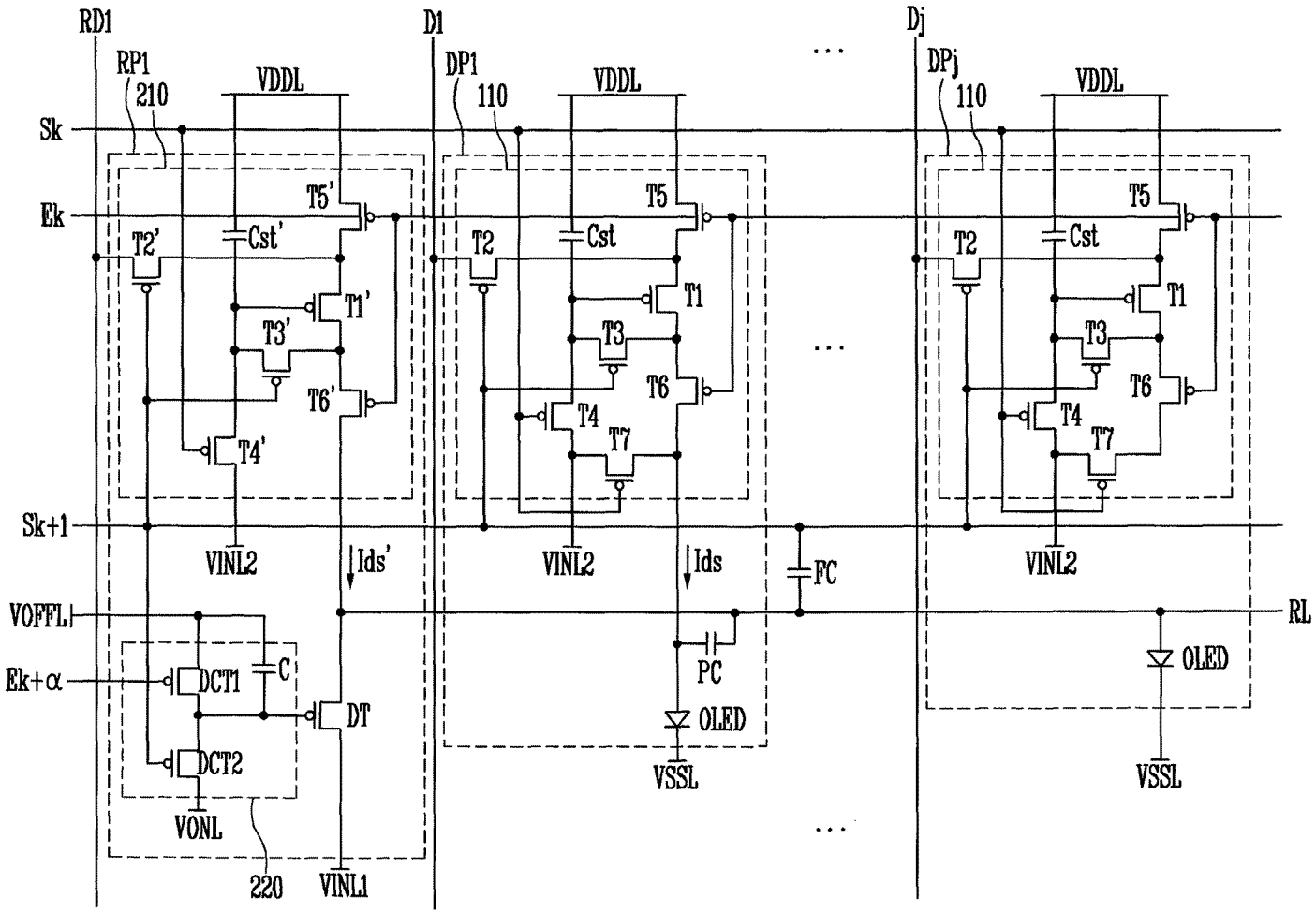
FIG. 7 is a circuit diagram showing display pixels and an auxiliary pixel in detail according to another exemplary embodiment.

FIG. 7 is a circuit diagram showing display pixels and an auxiliary pixel in detail according to another exemplary embodiment. For convenience of illustration, in FIG. 7, only the k-th and (k+1)-th scan lines Sk and Sk+1, the first auxiliary data line RD1, the first and j-th data lines D1 and Dj, and the k-th and (k+α)-th emission control lines Ek and Ek+α are shown. Also, for convenience of illustration, in FIG. 7, the first auxiliary pixel RP1 coupled to the first auxiliary data line RD1, the first display pixel DP1 coupled to the first data line D1, and the j-th display pixel DPj coupled to the j-th data line Dj are shown. In FIG. 7, the first display pixel DP1 is a pixel at which no defect occurred during a manufacturing process, and the j-th display pixel DPj is a repaired pixel RDP at which defects occurred during the manufacturing process and has been repaired.

Referring to FIG. 7, the first auxiliary pixel RP1 may be coupled to the j-th display pixel DPj corresponding to the repaired pixel RDP via the auxiliary line RL. For example, the auxiliary line RL may be formed by extending into the display area DA from the first auxiliary pixel RP1. The auxiliary line RL may be coupled to the organic light emitting diode OLED of the j-th display pixel DPj.

Each of the display pixels DP1 and DPj may include the organic light emitting diode OLED and the display pixel driver 110. The display pixels DP1 and DPj shown in FIG. 7 may be substantially the same as the display pixels DP1 and DPj shown in FIG. 5. Therefore, a detailed description of the display pixels DP1 and DPj shown in FIG. 7 will be omitted.

The first auxiliary pixel RP1 may include an auxiliary pixel driver 210, a discharge transistor DT, and a discharge transistor controller 220. The first auxiliary pixel RP1 may not include an organic light emitting diode OLED.

The auxiliary pixel driver 210 and the discharge transistor DT of the first auxiliary pixel RP1 shown in FIG. 7 may be substantially the same as the auxiliary pixel driver 210 and the discharge transistor DT of the first auxiliary pixel RP1 shown in FIG. 5. Therefore, a detailed description of the auxiliary pixel driver 210 and the discharge transistor DT of the first auxiliary pixel RP1 shown in FIG. 7 will be omitted.

The discharge transistor controller 220 may control turning on and turning off of the discharge transistor DT. The discharge transistor controller 220 may include a plurality of transistors. Also, the discharge transistor controller 220 may further include a capacitor. The discharge transistor controller 220 may include first and second discharge control transistors DCT1 and DCT2 and a capacitor C as shown in FIG. 7.

Each of the first and second discharge control transistors DCT1 and DCT2 may be coupled to the control electrode of the discharge transistor DT. Here, the control electrode of the first discharge control transistor DCT1 and the control electrode of the second discharge control transistor DCT2 may be coupled to different lines.

For example, the first discharge control transistor DCT1 may be coupled to the control electrode of the discharge transistor DT and a gate-off voltage line VOFFL to which a gate-off voltage is supplied. The control electrode of the first discharge control transistor DCT1 may be coupled to the (k+α)-th emission control line Ek+α, the first electrode may be coupled to the (k+1)-th scan line Sk+1, and the second electrode may be coupled to the control electrode of the discharge transistor DT. Regarding a in the (k+α)-th emission control line Ek+α, the description was previously provided with reference to FIG. 5.

The second discharge control transistor DCT2 may be coupled to the control electrode of the discharge transistor DT and the gate-on voltage line VONL to which the gate-on voltage is supplied. The control electrode of the second discharge control transistor DCT2 may be coupled to the (k+1)-th scan line Sk+1, the first electrode may be coupled to the control electrode of the discharge transistor DT, and the second electrode may be coupled to the gate-on voltage line VONL.

The capacitor C may be coupled to the control electrode of the discharge transistor DT and the gate-off voltage line VOFFL and maintain the voltage of the control electrode of the discharge transistor DT. The electrode on one side (e.g., a first terminal) of the capacitor C may be coupled to the control electrode of the discharge transistor DT, and the electrode on the other side (e.g., a second terminal) of the capacitor C may be coupled to the gate-off voltage line VOFFL. The capacitor C may be omitted in some embodiments.

The signals supplied to the display pixels DP1 and DPj and the first auxiliary pixel RP1 shown in FIG. 7 are substantially the same as those shown in FIG. 6. Also, the method for driving the display pixels DP1 and DPj and the first auxiliary pixel RP1 shown in FIG. 7 is substantially the same as the description provided with reference to FIGS. 5 and 6. Therefore, a detailed description of the method for driving the display pixels DP1 and DPj and the first auxiliary pixel RP1 shown in FIG. 7 will be omitted.

Figure 8:
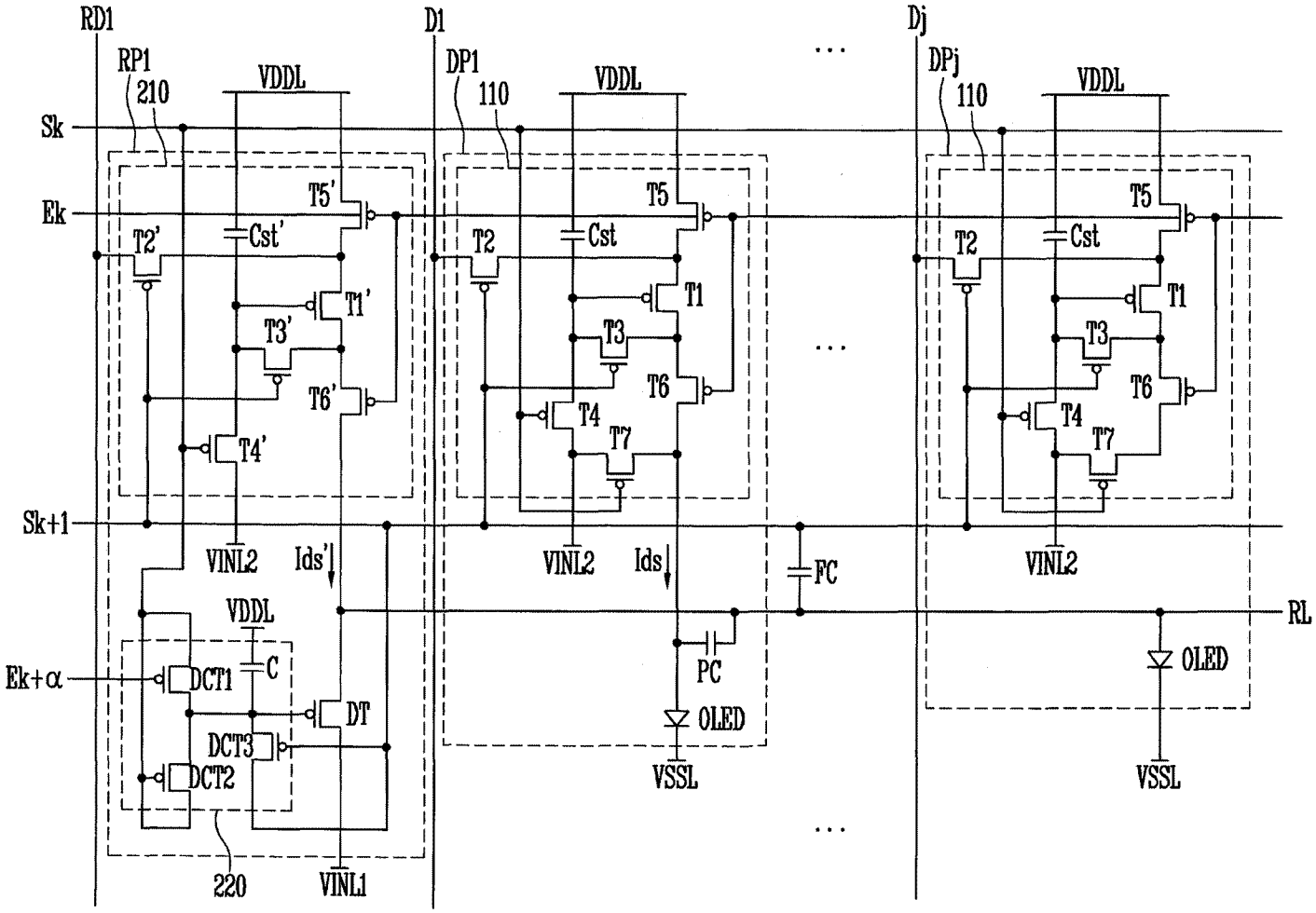
FIG. 8 is a circuit diagram showing in detail display pixels and an auxiliary pixel according to another exemplary embodiment.

FIG. 8 is a circuit diagram showing in detail display pixels and an auxiliary pixel according to another exemplary embodiment. For convenience of illustration, in FIG. 8, only the k-th and (k+1)-th scan lines Sk and Sk+1, the first auxiliary data line RD1, the first and j-th data lines D1 and Dj, and the k-th and (k+α)-th emission control lines Ek and Ek+α are shown. Also, for convenience of illustration, in FIG. 8, the first auxiliary pixel RP1 coupled to the first auxiliary data line RD1, the first display pixel DP1 coupled to the first data line D1, and the j-th display pixel DPj coupled to the j-th data line Dj are shown. In FIG. 8, the first display pixel DP1 is a pixel at which no defect occurred during a manufacturing process, and the j-th display pixel DPj is a repaired pixel RDP at which defects occurred during the manufacturing process and has been repaired.

Referring to FIG. 8, the first auxiliary pixel RP1 may be coupled to the j-th display pixel DPj corresponding to the repaired pixel RDP via the auxiliary line RL. For example, the auxiliary line RL may be formed by extending into the display area DA from the first auxiliary pixel RP1. The auxiliary line RL may be coupled to the organic light emitting diode OLED of the j-th display pixel DPj.

Each of the display pixels DP1 and DPj may include the organic light emitting diode OLED and the display pixel driver 110. The display pixels DP1 and DPj shown in FIG. 8 may be substantially the same as the display pixels DP1 and DPj shown in FIG. 5. Therefore, a detailed description of the display pixels DP1 and DPj shown in FIG. 8 will be omitted.

The first auxiliary pixel RP1 may include the auxiliary pixel driver 210, the discharge transistor DT, and the discharge transistor controller 220. The first auxiliary pixel RP1 may not include an organic light emitting diode OLED.

The auxiliary pixel driver 210 and the discharge transistor DT of the first auxiliary pixel RP1 shown in FIG. 8 may be substantially the same as the auxiliary pixel driver 210 and the discharge transistor DT of the first auxiliary pixel RP1 shown in FIG. 5. Therefore, a detailed description of the auxiliary pixel driver 210 and the discharge transistor DT of the first auxiliary pixel RP1 shown in FIG. 8 will be omitted.

The discharge transistor controller 220 may control turning on and turning off of the discharge transistor DT. The discharge transistor controller 220 may include a plurality of transistors. Also, the discharge transistor controller 220 may further include a capacitor. The discharge transistor controller 220 may include first to third discharge control transistors DCT1, DCT2 and DCT3 and a capacitor C as shown in FIG. 8.

Each of the first to third discharge control transistors DCT1, DCT2 and DCT3 may be coupled to the control electrode of the discharge transistor DT. Here, the control electrode of the first discharge control transistor DCT1, the control electrode of the second discharge control transistor DCT2 and the control electrode of the third discharge control transistor DCT3 may be coupled to different lines.

For example, the first discharge control transistor DCT1 may be coupled to the control electrode of the discharge transistor DT and the k-th scan line Sk. The control electrode of the first discharge control transistor DCT1 may be coupled to the (k+α)-th emission control line Ek+α, the first electrode may be coupled to the (k+1)-th scan line Sk+1, and the second electrode may be coupled to the control electrode of the discharge transistor DT. Regarding a in the (k+α)-th emission control line Ek+α, the description was previously provided with reference to FIG. 5.

The second discharge control transistor DCT2 may be coupled to the control electrode of the discharge transistor DT and the k-th scan line Sk. The control electrode of the second discharge control transistor DCT2 and the second electrode may be coupled to the k-th scan line Sk, and the first electrode may be coupled to the control electrode of the discharge transistor DT. That is, the second discharge control transistor DCT2 may be driven as a diode. In other words, the second discharge control transistor DCT2 may be diode-connected.

The third discharge control transistor DCT3 may be coupled to the control electrode of the discharge transistor DT and the (k+1)-th scan line Sk+1. The control electrode of the third discharge control transistor DCT3 and the second electrode may be coupled to the (k+1)-th scan line Sk+1, and the first electrode may be coupled to the control electrode of the discharge transistor DT. That is, the third discharge control transistor DCT3 may be driven as a diode. Any one of the second and third discharge control transistors DCT2 and DCT3 may be omitted in some embodiments.

The capacitor C may be coupled to the control electrode of the discharge transistor DT and the second power voltage line VDDL and maintain the voltage of the control electrode of the discharge transistor DT. The electrode on one side (e.g., a first terminal) of the capacitor C may be coupled to the control electrode of the discharge transistor DT, and the electrode on the other side (e.g., a second terminal) of the capacitor C may be coupled to the second power voltage line VDDL. The capacitor C may be omitted in some embodiments.

Figure 9:
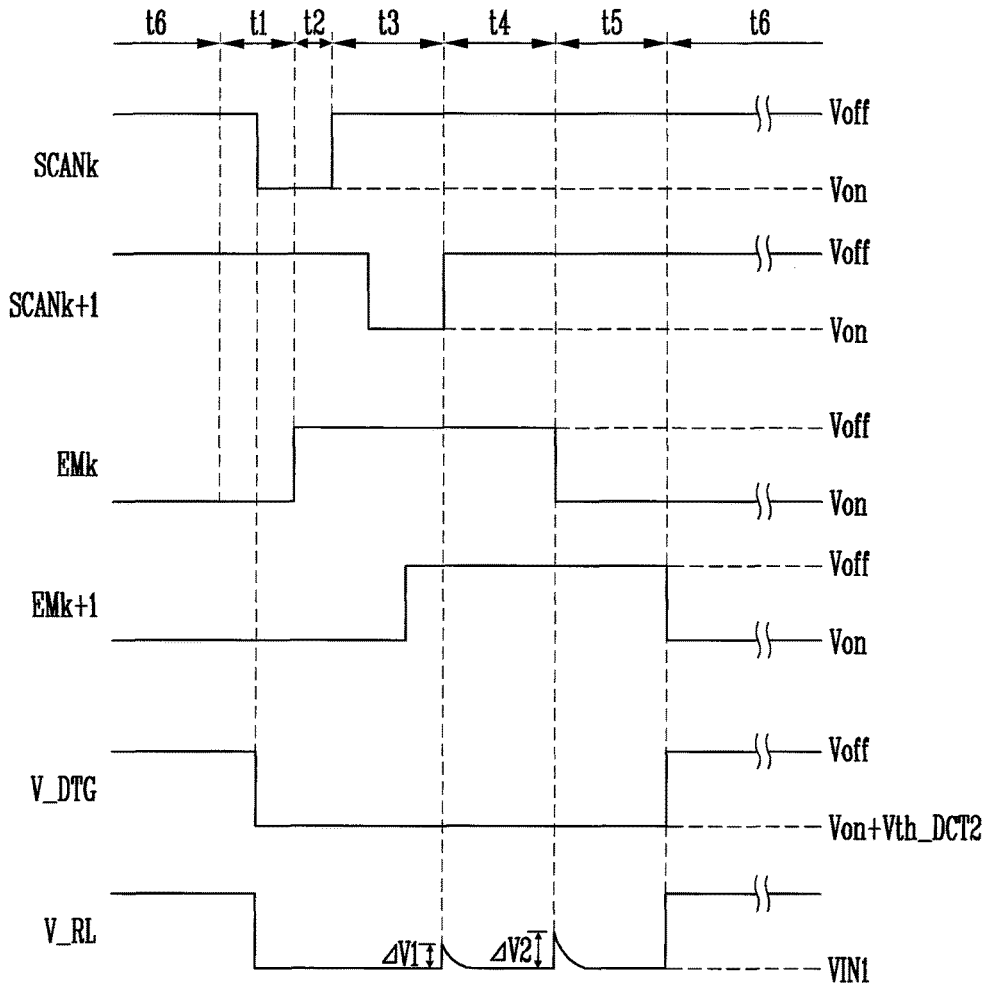
FIG. 9 is a waveform diagram showing signals supplied to display pixels and auxiliary pixels shown in FIG. 8, a voltage of a control electrode of a discharge transistor and a voltage of an auxiliary line.

FIG. 9 is a waveform diagram showing signals supplied to display pixels and auxiliary pixels shown in FIG. 8, a voltage of a control electrode of a discharge transistor and a voltage of an auxiliary line. FIG. 9 shows the k-th scan signal SCANk supplied to the k-th scan line Sk, the (k+1)-th scan signal SCANk+1 supplied to the (k+1)-th scan line Sk+1, the k-th emission control signal EMk supplied to the k-th emission control line Ek, the (k+1)-th emission control signal Ek+1 supplied to the (k+1)-th emission control line Ek+1, the voltage V_DTG supplied to the control electrode of the discharge transistor DT, and the voltage V_RL of the auxiliary line RL. Meanwhile, in FIG. 9, although the (k+1)-th emission control signal EMk+1 supplied to the (k+1)-th emission control line EMk+1 is illustrated as an example of the (k+α)-th emission control signal EMk+α supplied to the (k+α)-th emission control line Ek+α, it is not limited thereto.

The k-th scan signal SCANk, the (k+1)-th scan signal SCANk+1, the k-th emission control signal EMk and the (k+1)-th emission control signal EMk+1 shown in FIG. 9 are substantially the same as the k-th scan signal SCANk, the (k+1)-th scan signal SCANk+1, the k-th emission control signal EMk and the (k+1)-th emission control signal EMk+1 shown in FIG. 6. Therefore, a detailed description of the k-th scan signal SCANk, the (k+1)-th scan signal SCANk+1, the k-th emission control signal EMk and the (k+1)-th emission control signal EMk+1 shown in FIG. 9 will be omitted.

Hereinafter, with reference to FIGS. 8 and 9, the driving method of the first auxiliary pixel RP1 and the j-th display pixel DPj and the driving method of the first display pixel DP1 will be described in detail.

First, the method of driving the first display pixel DP1 as shown in FIGS. 8 and 9 is substantially the same as the method for driving the first display pixel DP1 as shown in FIGS. 5 and 6. Therefore, a detailed description of the method of driving the first display pixel DP1 as shown in FIGS. 8 and 9 will be omitted.

The method for driving the first auxiliary pixel RP1 and the j-th display pixel DPj will be described in detail.

First, the first period t1 is a period during which the on-bias is applied to the first transistor T1' and the auxiliary line RL is discharged to the first power voltage VIN1.

During the first period t1, the k-th scan signal SCANk of the gate-on voltage Von may be supplied to the k-th scan line Sk, the k-th emission control signal EMk of the gate-on voltage Von may be supplied to the k-th emission control line Ek, and the (k+1)-th emission control signal EMk+1 of the gate-on voltage Von may be supplied to the (k+1)-th emission control line Ek+1. Therefore, the fourth to sixth transistors T4', T5' and T6' and the first and second discharge control transistors DCT1 and DCT2 may be turned on during the first period t1.

Due to the first and second discharge control transistors DCT1 and DCT2 being turned on, during first period t1, the sum voltage Von+Vth_DCT2 of the gate-on voltage Von and the threshold voltage Vth_DCT2 of the second discharge control transistor DCT2 may be supplied to the control electrode of the discharge transistor DT. Or, the sum voltage Von+Vth_DCT1 of the gate-on voltage Von and the threshold voltage Vth_DCT1 of the first discharge control transistor DCT1 may be supplied to the control electrode of the discharge transistor DT during the first period t1. Therefore, the discharge transistor DT may be turned on during the first period t1. As a result, the auxiliary line RL may be discharged to the first power voltage VIN1 since it is coupled to the first power voltage line VINL1.

Also, due to the fourth transistor T4' being turned on, the control electrode of the first transistor T1' may be initialized with the third power voltage VIN2 of the third power voltage line VINL2. Due to the fifth and sixth transistors T5' and T6' being turned on, a current path through which a current flows from the second power voltage line VDDL to the first power voltage line VINL1 via the fifth transistor T5', the first transistor T1', the sixth transistor T6' and the discharge transistor DT. Since the third power voltage VIN2 is set sufficiently lower than the second power voltage VDD, during the first period t1, the voltage difference (Vgs=VIN2-VDD) between the control electrode of the first transistor T1' and the first electrode is lower than the threshold voltage Vth of the first transistor T1', and as a result, a current may flow through the current path.

During the first period t1, the control electrode of the first transistor T1' may be discharged to the third power voltage, and the on bias may be applied to the first transistor T1'. As a result, according to an exemplary embodiment, before a data voltage is supplied to the control electrode of the first transistor T1', the on bias may be applied to the first transistor T1'. And thus, problems in which image quality is deteriorated due to hysteresis characteristics of the first transistor T1' may be overcome or reduced.

Second, the second period t2 refers to a period during which the control electrode of the first transistor T1' and an anode electrode of the organic light emitting diode OLED are initialized, and the auxiliary line RL is initialized to the first power voltage VIN1.

During the second period t2, the k-th scan signal SCANk of the gate-on voltage Von may be supplied to the k-th scan line Sk, the k-th emission control signal EMk of the gate-off voltage Voff is supplied to the k-th emission control line Ek, and the (k+1)-th emission control signal EMk_1 of the gate-on voltage Von is supplied to the (k+1)-th emission control signal Ek+1. Therefore, during the second period t2, the fourth transistor T4' and the first and second discharge control transistors DCT1 and DCT2 may be turned on.

Due to the fourth transistor T4' being turned on, the control electrode of the first transistor T1' may be initialized to the third power voltage of the third power voltage line VINL2.

Also, due to the first and second discharge control transistors DCT1 and DCT2 being turned on, the voltage of the control electrode of the discharge transistor DT may maintain "Von+Vth_DCT2" or "Von+Vth_DCT1" during the second period t2.

Therefore, the discharge transistor DT may be turned on during the second period t2. As a result, the auxiliary line RL may be discharged to the first power voltage VIN1 since it is coupled to the first power voltage line VINL1.

Third, the third period t3 refers to a period during which a data voltage and a threshold voltage are sampled in the control electrode of the first transistor T1', and the auxiliary line RL is discharged to the first power voltage.

During the third period t3, the (k+1)-th scan signal SCANk+1 of the gate-on voltage Von may be supplied to the (k+1)-th scan line Sk+1, and the (k+1)-th emission control signal EMk+1 of the gate-off voltage Voff is supplied to the (k+1)-th emission control line Ek+1. As a result, during the third period t3, the second and third transistors T2' and T3' may be turned on, the first and second discharge control transistors DCT1 and DCT2 may be turned off, and the third discharge control transistor DCT3 may be turned on.

Due to the second transistor T2' being turned on, the data voltage Vdata (or auxiliary data voltage that is substantially the same as Vdata) of the first auxiliary data line RD1 may be supplied to the first electrode of the first transistor T1'. Due to the third transistor T3' being turned on, since the control electrode and the second electrode of the first transistor T1' are coupled to each other, the first transistor T1' may be driven as a diode. In other words, the first transistor T1' may be diode-connected.

Since the voltage difference between the control electrode and the first electrode of the first transistor T1' (Vgs=VIN2−Vdata) is lower than the threshold voltage Vth, in the first transistor T1', the current may flow until the voltage difference Vgs between the control electrode and the first electrode reaches the threshold voltage Vth of the first transistor T1'. As a result, the voltage of the control electrode of the first transistor T1' increases to "Vdata+Vth" in the third period t3.

Due to the first and second discharge control transistors DCT1 and DCT2 being turned off and the third discharge control transistor DCT3 being turned on, the control electrode of the discharge transistor DT may maintain "Von+Vth_DCT2", "Von+Vth_DCT1" or the sum voltage Von+Vth_DCT3 of the gate-on voltage Von and the threshold voltage Vth_DCT3 of the third discharge control transistor DCT3 during the third period t3. Therefore, the discharge transistor DT may be turned on during the third period t3. As a result, the auxiliary line RL may be discharged to the first power voltage VIN1 since it is coupled to the first power voltage line VINL1.

Fourth, the fourth period t4 refers to a period during which sampling of the data voltage and the threshold voltage is completed at the control electrode of the first transistor T1' and the auxiliary line RL is discharged to the first power voltage.

During the fourth period t4, the (k+1)-th scan signal SCANk+1 of the gate-off voltage Voff may be supplied to the (k+1)-th scan line Sk+1. As a result, during the fourth period t4, all of the transistors of the display pixel driver 210 may be turned off.

During the fourth period t4, "Vdata+Vth" corresponding to the voltage of the control electrode of the first transistor T1' may be stored in the storage capacitor Cst.

During the fourth period t4, since the control electrode of the discharge transistor DT may be floated or may maintain "Von+Vth_DCT2", "Von+Vth_DCT1" or "Von+Vth_DCT3", the discharge transistor DT may be turned on. As a result, during the fourth period t4, the auxiliary line RL may be discharged to the first power voltage VIN1 since it is coupled to the first power voltage line VINL1.

Meanwhile, since the (k+1)-th scan line Sk+1 and the auxiliary line RL are formed side by side, fringe capacitance FC may be formed between the (k+1)-th scan line Sk+1 and the auxiliary line RL as shown in FIG. 8. As for the auxiliary line RL, the voltage of the (k+1)-th scan line Sk+1 may change due to the fringe capacitance FC. Therefore, when the (k+1)-th scan signal SCANk+1 increases to the gate-off voltage Voff from the gate-on voltage Von during the fourth period t4, the voltage of the auxiliary line RL may increase by ΔV1 as the voltage change of the (k+1)-th scan line Sk+1 due to the fringe capacitance FC is reflected. However, since the auxiliary line RL is coupled to the first power voltage line VINL1 during the fourth period t4, even if voltage change of the (k+1)-th scan line Sk+1 is reflected due to the fringe capacitance FC, the auxiliary line RL is discharged to the first power voltage VIN1.

Fifth, the fifth period t5 refers to a period during which the auxiliary line RL is discharged to the first power voltage.

During the fifth period t5, the k-th emission signal Ek of the gate-on voltage Von may be supplied to the k-th emission control line Ek. As a result, the fifth and sixth transistors T5' and T6' may be turned on during the fifth period t5.

Due to the fifth and sixth transistors T5' and T6' being turned on, the driving current Ids' may flow via the first transistor T1' according to the voltage of the control electrode. The control electrode of the first transistor T1' may maintain "Vdata+Vth" due to the storage capacitor Cst. Here, the driving current Ids' flowing via the first transistor T1' may be defined as Formula 2. Also, Formula 3 may be derived from Formula 2.

Eventually, the driving current Ids' may not depend on the threshold voltage Vth of the first transistor T1' as shown in Formula 3. That is, the threshold voltage Vth of the first transistor T1' may be compensated.

Also, during the fifth period t5, since the control electrode of the discharge transistor DT may be floated or may maintain "Von+Vth_DCT2", "Von+Vth_DCT1" or "Von+Vth_DCT3" due to the capacitor C, the discharge transistor DT may be turned on. As a result, during the fifth period t5, the auxiliary line RL may be discharged to the first power voltage VINL1 since it is coupled to the first power voltage line VINL1. Therefore, during the fifth period t5, the driving current Ids' of the auxiliary pixel driver 210 may be discharged to the first power voltage line VINL1 via the discharge transistor DT. Therefore, during the fifth period t5, the organic light emitting diode OLED of the j-th display pixel DPj may not emit light.

Meanwhile, since the auxiliary line RL may overlap the anode electrodes of the organic light emitting diodes OLED of the display pixels DP, parasitic capacitance PC may be formed between the auxiliary line RL and the anode electrodes of the organic light emitting diodes OLED of the display pixels DP as shown in FIG. 8. Voltage change of the anode electrodes of the organic light emitting diodes may be reflected in the auxiliary line due to the fringe capacitance FC. Since the driving currents are supplied to the anode electrodes of the organic light emitting diodes OLED of the display pixels DP due to the k-th emission control signal EMk of the gate-on voltage during the fifth period t5, the voltage of the auxiliary line RL may increase by ΔV2 as the voltage change of the anode electrodes of the organic light emitting diodes OLED of the display pixels DP due to the parasitic capacitance PC is reflected. However, since the auxiliary line RL is coupled to the first power voltage line VINL1 during the fifth period t5, even if voltage change of the anode electrodes of the organic light emitting diode OLED of the display pixels DP is reflected due to the parasitic capacitance PC, the auxiliary line RL is discharged to the first power voltage VIN1.

Sixth, the sixth period t6 refers to a period during which the organic light emitting diode OLED may emit light.

During the sixth period t6, the k-th emission control signal EMk of the gate-on voltage Von may be supplied to the k-th emission control line Ek, and the (k+1)-th emission control signal EMk+1 of the gate-on voltage Von may be supplied to the (k+1)-th emission control line Ek+1. As a result, during the sixth period t6, the fifth and sixth transistors T5' and T6' may be turned on, and the first discharge control transistor DCT1 may be turned on.

Due to the first discharge control transistor DCT1 being turned on, the k-th scan signal SCANk of the gate-off voltage Voff may be supplied to the control electrode of the discharge transistor DT. Accordingly, during the sixth period t6, the discharge transistor DT may be turned off.

Due to the fifth and sixth transistors T5' and T6' being turned on, the driving current Ids' of the auxiliary pixel driver 210 may be supplied to the organic light emitting diode OLED of the j-th display pixel DPj via the auxiliary line RL. Therefore, the organic light emitting diode OLED of the j-th display pixel DPj may emit light.

As examined above, according to an exemplary embodiment, the voltage of the auxiliary line RL may be prevented or substantially prevented from changing due to parasitic capacitances PC and the fringe capacitance FC. As a result, the organic light emitting diode OLED of the j-th display pixel DPj may be prevented or substantially prevented from erroneously emitting light due to the parasitic capacitances PC and the fringe capacitance FC.

Figure 10:
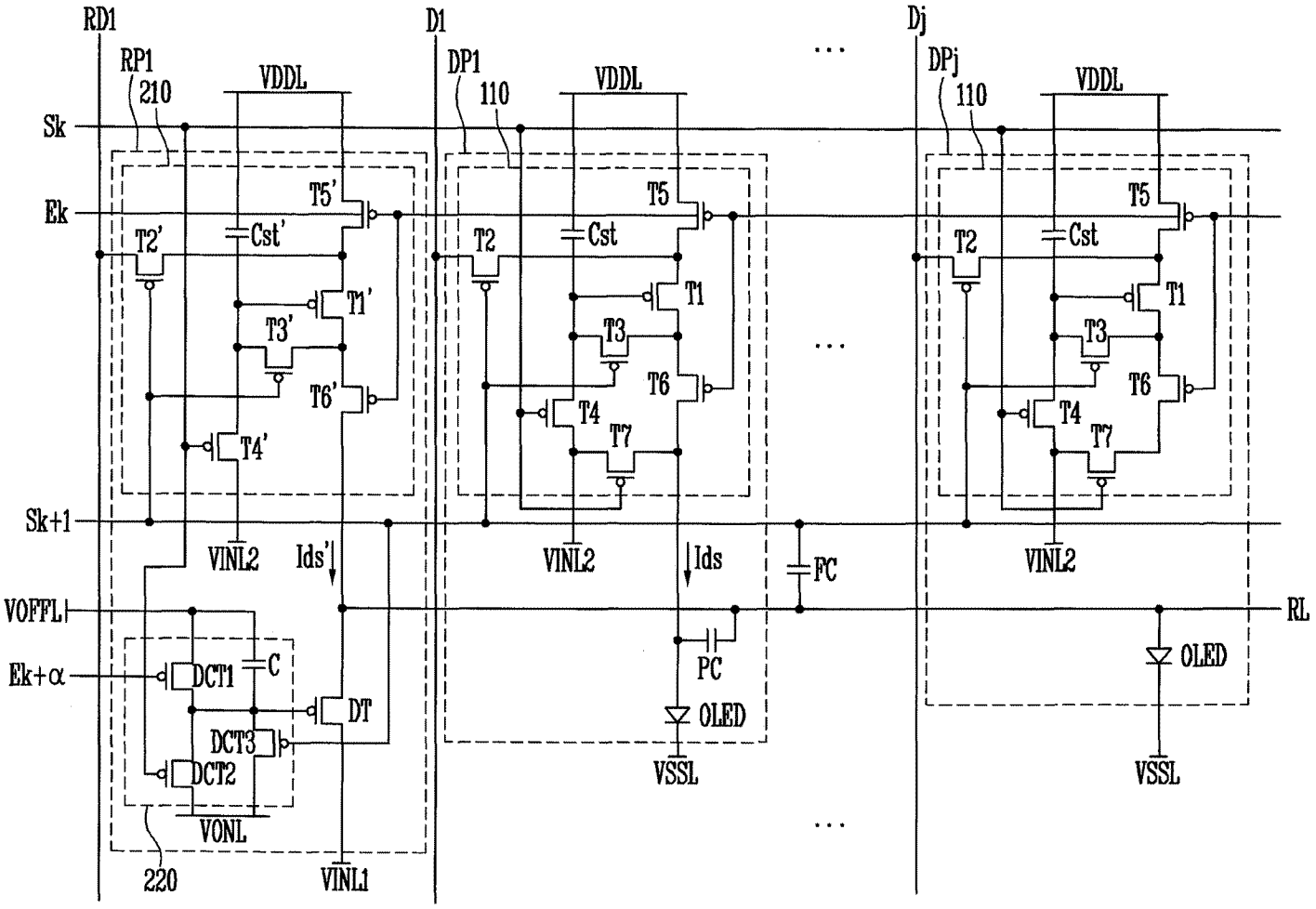
FIG. 10 is a circuit diagram showing in detail display pixels and an auxiliary pixel according to another exemplary embodiment.

FIG. 10 is a circuit diagram showing in detail display pixels and an auxiliary pixel according to another exemplary embodiment. For convenience of illustration, in FIG. 10, only the k-th and (k+1)-th scan lines Sk and Sk+1, the first auxiliary data line RD1, the first and j-th data lines D1 and Dj, and the k-th and (k+α)-th emission control lines Ek and Ek+α are shown. Also, for convenience of illustration, in FIG. 10, the first auxiliary pixel RP1 coupled to the first auxiliary data line RD1, the first display pixel DP1 coupled to the first data line D1, and the j-th display pixel DPj coupled to the j-th data line Dj are shown. In FIG. 10, the first display pixel DP1 is a pixel at which no defect occurred during a manufacturing process, and the j-th display pixel DPj is a repaired pixel RDP at which defects occurred during the manufacturing process and has been repaired.

Referring to FIG. 10, the first auxiliary pixel RP1 may be coupled to the j-th display pixel DPj corresponding to the repaired pixel RDP via the auxiliary line RL. For example, the auxiliary line RL may be formed by extending into the display area DA from the first auxiliary pixel RP1. The auxiliary line RL may be coupled to the organic light emitting diode OLED of the j-th display pixel DPj.

Each of the display pixels DP1 and DPj may include the organic light emitting diode OLED and the display pixel driver 110. The display pixels DP1 and DPj shown in FIG. 10 may be substantially the same as the display pixels DP1 and DPj shown in FIG. 5. Therefore, a detailed description of the display pixels DP1 and DPj shown in FIG. 10 will be omitted.

The first auxiliary pixel RP1 may include the auxiliary pixel driver 210, the discharge transistor DT, and the discharge transistor controller 220. The first auxiliary pixel RP1 may not include an organic light emitting diode OLED.

The auxiliary pixel driver 210 and the discharge transistor DT of the first auxiliary pixel RP1 shown in FIG. 10 may be substantially the same as the auxiliary pixel driver 210 and the discharge transistor DT of the first auxiliary pixel RP1 shown in FIG. 5. Therefore, a detailed description of the auxiliary pixel driver 210 and the discharge transistor DT of the first auxiliary pixel RP1 shown in FIG. 10 will be omitted.

The discharge transistor controller 220 may control turning on and turning off of the discharge transistor DT. The discharge transistor controller 220 may include a plurality of transistors. Also, the discharge transistor controller 220 may include a capacitor. The discharge transistor controller 220 may include first to third discharge control transistors DCT1, DCT2 and DCT3 and the capacitor C as shown in FIG. 10.

Each of the first to third discharge control transistors DCT1, DCT2 and DCT3 may be coupled to the control electrode of the discharge transistor DT. Here, the control electrode of the first discharge control transistor DCT1, the control electrode of the second discharge control transistor DCT2 and the control electrode of the third discharge control transistor DCT3 may be coupled to different lines.

For example, the first discharge control transistor DCT1 may be coupled to the control electrode of the discharge transistor DT and the gate-off voltage line VOFFL to which the gate-off voltage is supplied. The control electrode of the first discharge control transistor DCT1 may be coupled to the (k+α)-th emission control line Ek+α, the first electrode may be coupled to the k-th scan line Sk, and the second electrode may be coupled to the control electrode of the discharge transistor DT. Regarding a in the (k+α)-th emission control line Ek+α, the description was previously provided with reference to FIG. 5.

The second discharge control transistor DCT2 may be coupled to the control electrode of the discharge transistor DT and the gate-on voltage line VONL to which the gate-on voltage is supplied. The control electrode of the second discharge control transistor DCT2 may be coupled to the k-th scan line Sk, the first electrode may be coupled to the control electrode of the discharge transistor DT, and the second electrode may be coupled to the gate-on voltage line VONL.

The third discharge control transistor DCT3 may be coupled to the control electrode of the discharge transistor DT and the gate-on voltage line VONL to which the gate-on voltage is supplied. The control electrode of the third discharge control transistor DCT3 may be coupled to the k-th scan line Sk, the first electrode may be coupled to the control electrode of the discharge transistor DT, and the second electrode may be coupled to the gate-on voltage line VONL. Any one of the second and third discharge control transistors DCT2 and DCT3 may be omitted.

The capacitor C may be coupled to the control electrode of the discharge transistor DT and the gate-off voltage line VOFFL and maintain the voltage of the control electrode of the discharge transistor DT. The electrode on one side (e.g., a first terminal) of the capacitor C may be coupled to the control electrode of the discharge transistor DT, and the electrode on the other side (e.g., a second terminal) of the capacitor C may be coupled to the gate-off voltage line VOFFL. The capacitor C may be omitted in some embodiments.

The signals supplied to the display pixels DP1 and DPj and the auxiliary pixel RP1 shown in FIG. 10 are substantially the same as what is shown in FIG. 9. Also, the method for driving the display pixels DP1 and DPj and the auxiliary pixels RP1 shown in FIG. 10 is substantially the same as the description provided with reference to FIGS. 8 and 9. Therefore, the detailed description of the method for driving the display pixels DP1 and DPj and the auxiliary pixel RP1 shown in FIG. 10 will be omitted.

Figure 11:
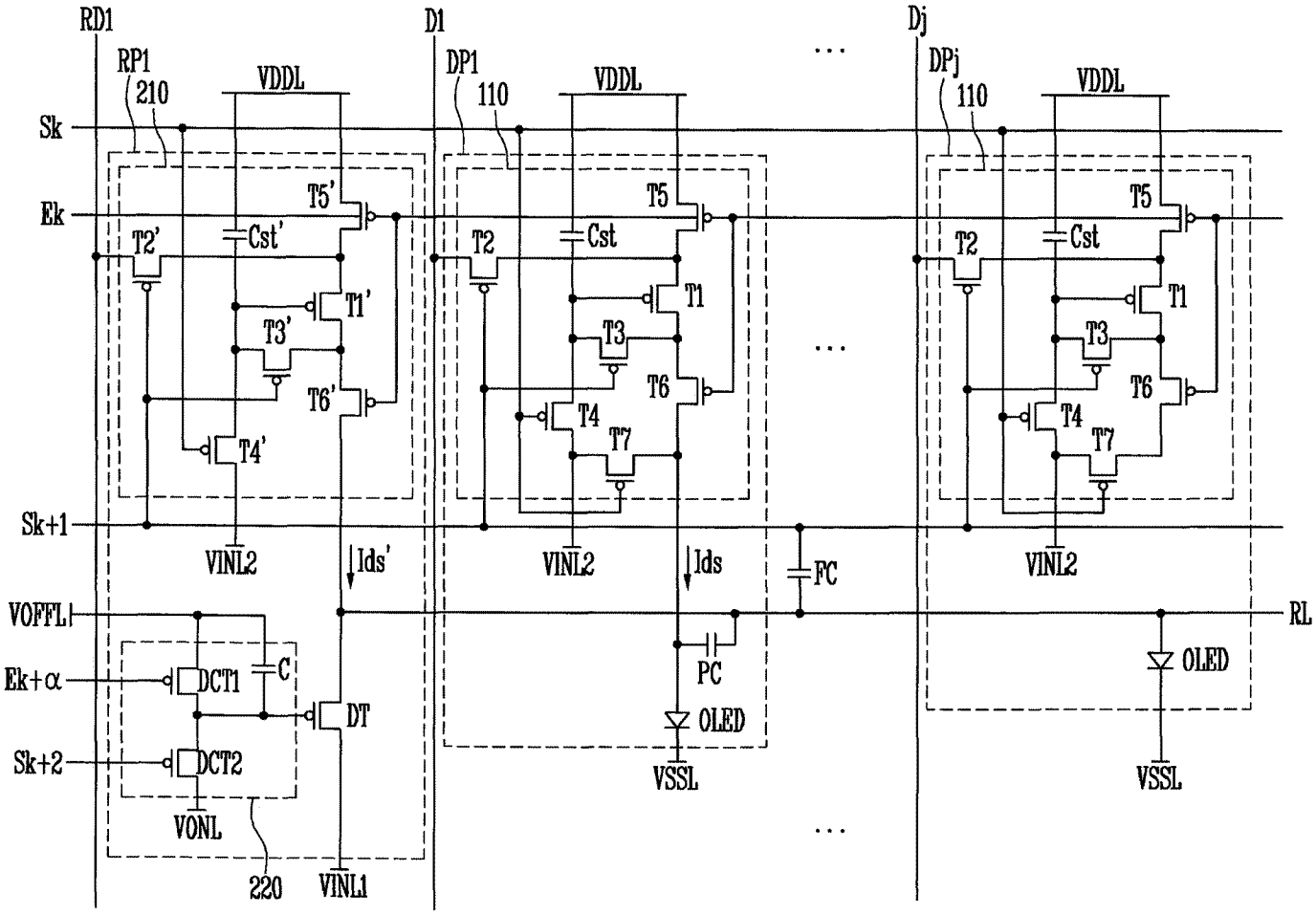
FIG. 11 is a circuit diagram showing in detail display pixels and an auxiliary pixel according to another exemplary embodiment.

FIG. 11 is a circuit diagram showing in detail display pixels and an auxiliary pixel according to another exemplary embodiment. For convenience of illustration, in FIG. 11, only the k-th to (k+2)-th scan lines Sk, Sk+1 and Sk+2, the first auxiliary data line RD1, the first and j-th data lines D1 and Dj, and the k-th and (k+α)-th emission control lines Ek and Ek+α are shown. Also, for convenience of illustration, in FIG. 11, only the first auxiliary pixel RP1 coupled to the first auxiliary data line RD1, the first display pixel DP1 coupled to the first data line D1, and the j-th display pixel DPj coupled to the j-th data line Dj are shown. In FIG. 11, the first display pixel DP1 is a pixel at which no defect occurred during a manufacturing process, and the j-th display pixel DPj is a repaired pixel RDP at which defects occurred during the manufacturing process and has been repaired.

Referring to FIG. 11, the first auxiliary pixel RP1 may be coupled to the j-th display pixel DPj corresponding to the repaired pixel RDP via the auxiliary line RL. For example, the auxiliary line RL may be formed by extending into the display area DA from the first auxiliary pixel RP1. The auxiliary line RL may be coupled to the organic light emitting diode OLED of the j-th display pixel DPj.

Each of the display pixels DP1 and DPj may include the organic light emitting diode OLED and the display pixel driver 110. The display pixels DP1 and DPj shown in FIG. 11 may be substantially the same as the display pixels DP1 and DPj shown in FIG. 5. Therefore, a detailed description of the display pixels DP1 and DPj shown in FIG. 11 will be omitted.

The first auxiliary pixel RP1 may include the auxiliary pixel driver 210, the discharge transistor DT, and the discharge transistor controller 220. The first auxiliary pixel RP1 may not include an organic light emitting diode OLED.

The auxiliary pixel driver 210 and the discharge transistor DT of the first auxiliary pixel RP1 shown in FIG. 11 may be substantially the same as the auxiliary pixel driver 210 and the discharge transistor DT of the first auxiliary pixel RP1 shown in FIG. 5. Therefore, a detailed description of the auxiliary pixel driver 210 and the discharge transistor DT of the first auxiliary pixel RP1 shown in FIG. 11 will be omitted.

The discharge transistor controller 220 may control turning on and turning off of the discharge transistor DT. The discharge transistor controller 220 may include a plurality of transistors. Also, the discharge transistor controller 220 may include a capacitor. The discharge transistor controller 220 may include the first and second discharge control transistors DCT1 and DCT2 and the capacitor C as shown in FIG. 11.

Each of the first and second discharge control transistors DCT1 and DCT2 may be coupled to the control electrode of the discharge transistor DT. Here, the control electrode of the first discharge control transistor DCT1 and the control electrode of the second discharge control transistor DCT2 may be coupled to different lines.

For example, the first discharge control transistor DCT1 may be coupled to the control electrode of the discharge transistor DT and the gate-off voltage line VOFFL to which the gate-off voltage is supplied. The control electrode of the first discharge control transistor DCT1 may be coupled to the (k+α)-th emission control line Ek+α, the first electrode may be coupled to the k-th scan line Sk, and the second electrode may be coupled to the control electrode of the discharge transistor DT. Regarding α in the (k+α)-th emission control line Ek+α, the detailed description was previously provided with reference to FIG. 5.

The second discharge control transistor DCT2 may be coupled to the control electrode of the discharge transistor DT and the gate-on voltage line VONL to which the gate-on voltage is supplied. The control electrode of the second discharge control transistor DCT2 may be coupled to the (k+2)-th scan line Sk+2, the first electrode may be coupled to the control electrode of the discharge transistor DT, and the second electrode may be coupled to the gate-on voltage line VONL.

The capacitor C may be coupled to the control electrode of the discharge transistor DT and the gate-off voltage line VOFFL and maintain the voltage of the control electrode of the discharge transistor DT. The electrode on one side (e.g., a first terminal) of the capacitor C may be coupled to the control electrode of the discharge transistor DT, and the electrode on the other side (e.g., a second terminal) of the capacitor C may be coupled to the gate-off voltage line VOFFL. The capacitor C may be omitted in some embodiments.

Figure 12:
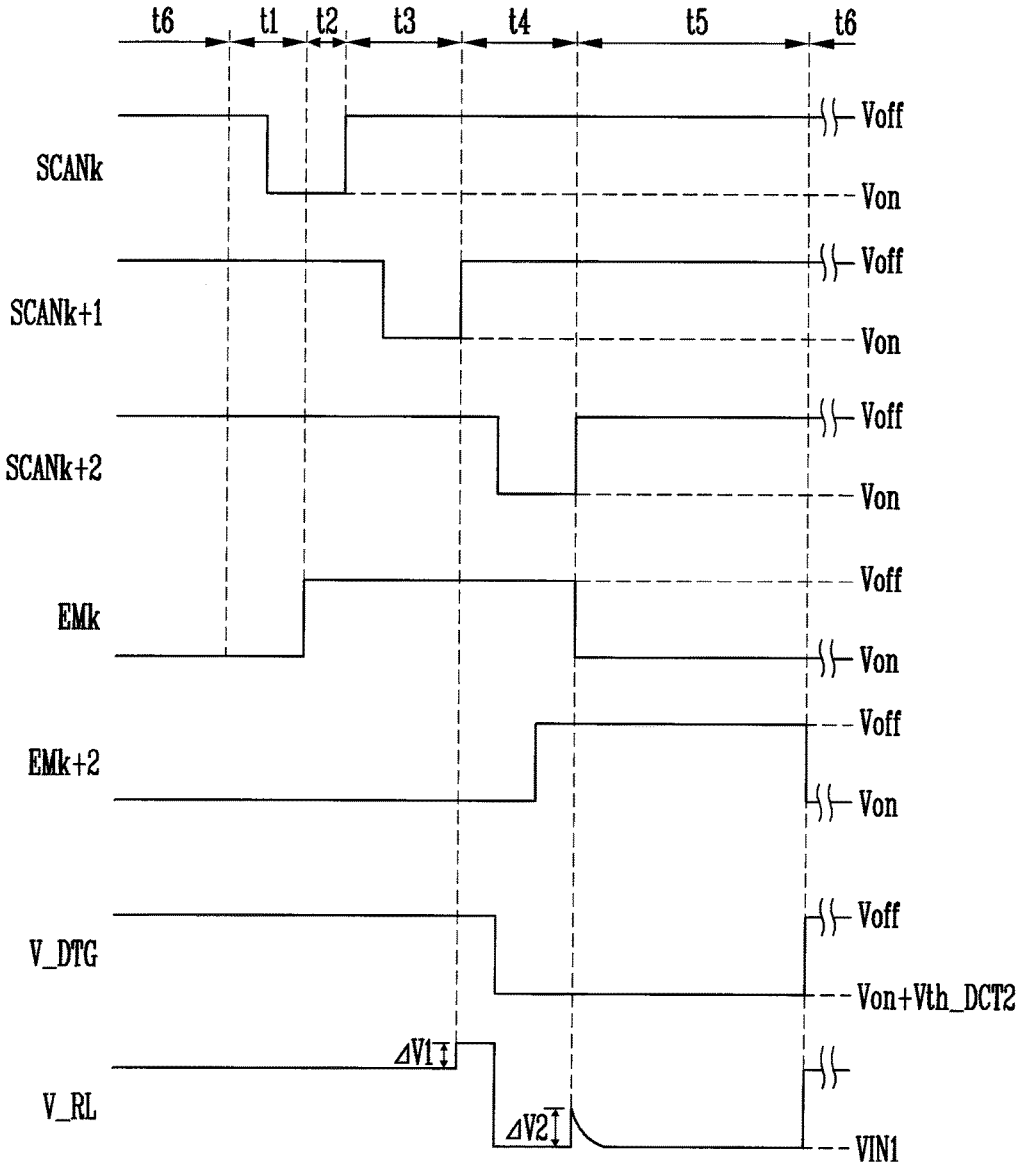
FIG. 12 is a waveform diagram showing signals supplied to display pixels and auxiliary pixels shown in FIG. 11, a voltage of a control electrode of a discharge transistor and a voltage of an auxiliary line.

FIG. 12 is a waveform diagram showing signals supplied to display pixels and auxiliary pixels shown in FIG. 11, a voltage of a control electrode of a discharge transistor and a voltage of an auxiliary line. FIG. 12 shows the k-th scan signal SCANk supplied to the k-th scan line Sk, the (k+1)-th scan signal SCANk+1 supplied to the (k+1)-th scan line Sk+1, the (k+2)-th scan signal SCANk+2 supplied to the (k+2)-th scan line Sk+2, the k-th emission control signal EMk supplied to the k-th emission control line Ek, the (k+2)-th emission control signal EMk+2 supplied to the (k+2)-th emission control line Ek+2, the voltage V_DTG supplied to the control electrode of the discharge transistor DT, and the voltage V_RL of the auxiliary line RL. Meanwhile, in FIG. 12, although the (k+2)-th emission control signal EMk+2 supplied to the (k+2)-th emission control line Ek+2 is illustrated as an example of the (k+α)-th emission control signal EMk+α supplied to the (k+α)-th emission control line Ek+α, it is not limited thereto.

Referring to FIG. 12, the frame period may be divided into first to sixth periods t1 to t6. The k-th scan signal SCANk may be generated as the gate-on voltage Von during the first and second periods t1 and t2, the (k+1)-th scan signal SCANk+1 may be generated as the gate-on voltage Von during the third period t3, and the (k+2)-th scan signal SCANk+2 may be generated as the gate-on voltage Von during the fourth period t4. The scan signals may be generated as the gate-on voltage Von sequentially. The k-th emission signal EMk may be generated as the gate-off voltage Voff during the second to fourth periods t2 to t4, and the (k+1)-th emission signal EMk+1 may be generated as the gate-off voltage Voff during the fourth to fifth periods t4 and t5. The emission control signals may be generated as the gate-off voltage Voff sequentially.

Hereinafter, with reference to FIGS. 11 and 12, the driving method of the first auxiliary pixel RP1 and the j-th display pixel DPj and the driving method of the first display pixel DP1 will be described in detail.

The method for driving the display pixel DP1 according to FIGS. 11 and 12 is substantially the same as the method for driving the first display pixel DP1 according to FIGS. 5 and 6. Thus, a detailed description of the method for driving the first display pixel DP1 according to FIGS. 11 and 12 will be omitted.

Next, a detailed description of the method for driving the first auxiliary pixel RP1 and the j-th display pixel DPj will be provided.

First, the first period t1 is a period during which the on-bias is applied to the first transistor T1'.

During the first period t1, the k-th scan signal SCANk of the gate-on voltage Von may be supplied to the k-th scan line Sk, the k-th emission control signal EMk of the gate-on voltage Von may be supplied to the k-th emission control line Ek, and the (k+1)-th emission control signal EMk+2 of the gate-on voltage Von may be supplied to the (k+2)-th emission control line Ek+2. Therefore, the fourth to sixth transistors T4', T5' and T6' and the first discharge control transistor DCT1 may be turned on during the first period t1.

Due to the first discharge control transistor DCT1 being turned on, the gate-off voltage Voff may be supplied to the control electrode of the discharge transistor DT during the first period t1. Therefore, the discharge transistor DT may be turned off during the first period t1.

Due to the fourth transistor T4' being turned on, the control electrode of the first transistor T1 may be initialized to the third power voltage VIN2 of the third power voltage line VINL2. Due to the fifth to sixth transistors T5' and T6' being turned on, a current path may be formed through which a current flows from the second power voltage line VDDL to the auxiliary line RL via the fifth transistor T5', the first transistor T1' and the sixth transistor T6'. Since the third power voltage VIN2 is set sufficiently lower than the second power voltage VDD, the difference in voltage between the control electrode and the first electrode of the first transistor T1' during the first period t1 (Vgs=VIN2−VDD) is lower than the threshold voltage Vth of the first transistor T1'. As a result, a current may flow through the current path.

During the first period t1, the control electrode of the first transistor T1' may be discharged to the third power voltage, and the on bias may be applied to the first transistor T1'. As a result, according to an exemplary embodiment, before a data voltage is supplied to the control electrode of the first transistor T1', the on bias may be applied to the first transistor T1'. And thus, problems in which image quality is deteriorated due to hysteresis characteristics of the first transistor T1' may be overcome or reduced.

Second, the second period t2 refers to a period during which the control electrode of the first transistor T1' and the anode electrode of the organic light emitting diode OLED are initialized.

During the second period t2, the k-th scan signal SCANk of the gate-on voltage Von may be supplied to the k-th scan line Sk, the k-th emission control signal EMk of the gate-off voltage Voff may be supplied to the k-th emission control line Ek, and the (k+2)-th emission control signal EMk+2 of the gate-on voltage Von may be supplied to the (k+2)-th emission control line Ek+2. Therefore, during the second period t2, the fourth transistor T4' and the first discharge control transistor DCT1 may be turned on.

Due to the fourth transistor T4' being turned on, the control electrode of the first transistor T1' may be initialized to the third power voltage of the third power voltage line VINL2.

Due to the first discharge control transistor DCT1 being turned on, the gate-off voltage Voff may be supplied to the control electrode of the discharge transistor DT. Therefore, during the second period t2, the discharge transistor DT may be turned off.

Third, the third period t3 refers to a period during which a data voltage and a threshold voltage are sampled at the control electrode of the first transistor T1'.

During the third period t3, the (k+1)-th scan signal SCANk+1 of the gate-on voltage Von may be supplied to the (k+1)-th scan line Sk+1, and the (k+2)-th emission control signal EMk+2 of the gate-on voltage Von may be supplied to the (k+2)-th emission control line Ek+2. As a result, during the third period t3, the second and third transistors T2' and T3' may be turned on, and the first discharge control transistor DCT1 may be turned on.

Due to the second transistor T2' being turned on, a data voltage Vdata (or auxiliary data voltage that is substantially the same as Vdata) of the first auxiliary data line RD1 may be supplied to the first electrode of the first transistor T1'. Due to the third transistor T3' being turned on, since the control electrode and the second electrode of the first transistor T1' are coupled to each other, the first transistor T1' may be driven as a diode. In other words, the first transistor T1' may be diode-connected.

Since the voltage difference between the control electrode and the first electrode of the first transistor T1' (Vgs=VIN2−Vdata) is lower than the threshold voltage Vth, in the first transistor T1', the current may flow until the voltage difference Vgs between the control electrode and the first electrode reaches the threshold voltage Vth of the first transistor T1'. As a result, the voltage of the control electrode of the first transistor T1' increases to "Vdata+Vth" in the third period t3.

Due to the first discharge control transistor DCT1 being turned on, the gate-off voltage Voff may be supplied to the control electrode of the discharge transistor DT during the third period t3. Therefore, the discharge transistor DT may be turned off during the third period t3.

Fourth, the fourth period t4 refers to a period during which sampling of the data voltage and the threshold voltage is completed at the control electrode of the first transistor T1'.

During the fourth period t4, the (k+1)-th scan signal SCANk+1 of the gate-off voltage Voff may be supplied to the (k+1)-th scan line Sk+1, the (k+2)-th scan signal SCANk+2 of the gate-on voltage Von may be supplied to the (k+2)-th scan line Sk+2, and the (k+2)-th emission control signal EMk+2 of the gate-off voltage may be supplied to the (k+2)-th emission control line Ek+2. As a result, during the fourth period t4, all of the transistors of the auxiliary pixel driver 210 may be turned off, the first discharge control transistor DCT1 may be turned off, and the second discharge control transistor DCt2 may be turned on.

During the fourth period t4, "Vdata+Vth" corresponding to the voltage of the control electrode of the first transistor T1' may be stored in the storage capacitor Cst.

Due to second discharge control transistor DCT2 being turned on, the sum voltage Vth_DCT2 of the gate-on voltage Von and the second discharge control transistor DCT2 may be supplied to the control electrode of the discharge transistor DT during the fourth period t4. Therefore, the discharge transistor DT may be turned on during the fourth period t4. As a result, during the fourth period t4, the auxiliary line RL may be discharged to the first power voltage VIN1 since it is coupled to the first power voltage line VINL1.

Meanwhile, since the (k+1)-th scan line Sk+1 and the auxiliary line RL are formed side by side, fringe capacitance FC may be formed between the (k+1)-th scan line Sk+1 and the auxiliary line RL as shown in FIG. 11. The voltage change of the (k+1)-th scan line Sk+1 may be reflected in the auxiliary line RL due to the fringe capacitance FC. Therefore, when the (k+1)-th scan signal SCANk+1 increases to the gate-off voltage Voff from the gate-on voltage Von during the fourth period t4, the voltage of the auxiliary line RL may increase by ΔV1 as the voltage change of the (k+1)-th scan line Sk+1 due to the fringe capacitance FC is reflected. However, since the auxiliary line RL is coupled to the first power voltage line VINL1 during the fourth period t4, even if voltage change of the (k+1)-th scan line Sk+1 is reflected due to the fringe capacitance FC, the auxiliary line RL is discharged to the first power voltage VIN1.

Fifth, the fifth period t5 refers to a period during which the auxiliary line RL is discharged to the first power voltage.

During the fifth period t5, the (k+2)-th scan signal SCANk+2 of the gate-off voltage Voff may be supplied to the (k+2)-th scan line Sk+2, and the k-th emission signal EMk of the gate-on voltage Von may be supplied to the k-th emission control line Ek. As a result, during the fifth period t5, the fifth and sixth transistors T5' and T6' may be turned on, and the second discharge transistor DCT2 may be turned off.

Due to the fifth and sixth transistors T5' and T6' being turned on, the driving current Ids' may flow via the first transistor T1 according to the voltage of the control electrode. The control electrode of the first transistor T1' may maintain "Vdata+Vth" due to the storage capacitor Cst. Here, the driving current Ids' flowing via the first transistor T1' may be defined as Formula 2. Also, Formula 3 may be derived from Formula 2.

Eventually, the driving current Ids' may not depend on the threshold voltage Vth of the first transistor T1' as shown in Formula 3. That is, the threshold voltage Vth of the first transistor T1' may be compensated.

Also, during the fifth period t5, since the control electrode of the discharge transistor DT may be floated or may maintain "Von+Vth_DCT2" due to the capacitor C, the discharge transistor DT may be turned on. As a result, during the fifth period t5, the auxiliary line RL may be discharged to the first power voltage VIN1 since it is coupled to the first power voltage line VINL1. Therefore, during the fifth period t5, the driving current Ids' of the auxiliary pixel driver 210 may be discharged to the first power voltage line VINL1 via the discharge transistor DT. Therefore, during the fifth period t5, the organic light emitting diode OLED of the j-th display pixel DPj may not emit light.

Meanwhile, since the auxiliary line RL may overlap the anode electrodes of the organic light emitting diode OLED of the display pixels DP1, parasitic capacitance PC may be formed between the auxiliary line RL and the anode electrodes of the organic light emitting diode OLED of the display pixels DP1 as shown in FIG. 11. The voltage change of the anode electrodes of the organic light emitting diode OLED may be reflected in the auxiliary line RL due to parasitic capacitance PC. Since the driving currents are supplied to the anode electrodes of the organic light emitting diode OLED of the display pixels DP1 due to the k-th emission control signal EMk of the gate-on voltage during the fifth period t5, the voltage of the auxiliary line RL may increase by ΔV2 as the voltage change of the anode electrodes of the organic light emitting diode OLED of the display pixels DP1 due to the parasitic capacitance PC is reflected. However, since the auxiliary line RL is coupled to the first power voltage line VINL1 during the fifth period t5, even if voltage change of the anode electrodes of the organic light emitting diode OLED of the display pixels DP1 is reflected due to the parasitic capacitance PC, the auxiliary line RL is discharged to the first power voltage VIN1. Sixth, the sixth period t6 refers to a period during which the organic light emitting diode OLED may emit light.

During the sixth period t6, the k-th emission control signal EMk of the gate-on voltage Von may be supplied to the k-th emission control line Ek, and the (k+2)-th emission control signal EMk+2 of the gate-on voltage Von may be supplied to the (k+2)-th emission control line Ek+2. As a result, during the sixth period t6, the fifth and sixth transistors T5' and T6' may be turned on, and the first discharge control transistor DCT1 may be turned on.

Due to the first discharge control transistor DCT1 being turned on, the gate-off voltage Voff may be supplied to the control electrode of the discharge transistor DT. Accordingly, during the sixth period t6, the discharge transistor DT may be turned off.

Due to the fifth and sixth transistors T5' and T6' being turned on, the driving current Ids' of the auxiliary pixel driver 210 may be supplied to the organic light emitting diode OLED of the j-th display pixel DPj via the auxiliary line RL. Therefore, the organic light emitting diode OLED of the j-th display pixel DPj may emit light.

As examined above, according to an exemplary embodiment, the voltage of the auxiliary line RL may be prevented or substantially prevented from changing due to parasitic capacitances PC and the fringe capacitance FC. As a result, the organic light emitting diode OLED of the j-th display pixel DPj may be prevented or substantially prevented from erroneously emitting light due to the parasitic capacitances PC and the fringe capacitance FC.

Figure 13:
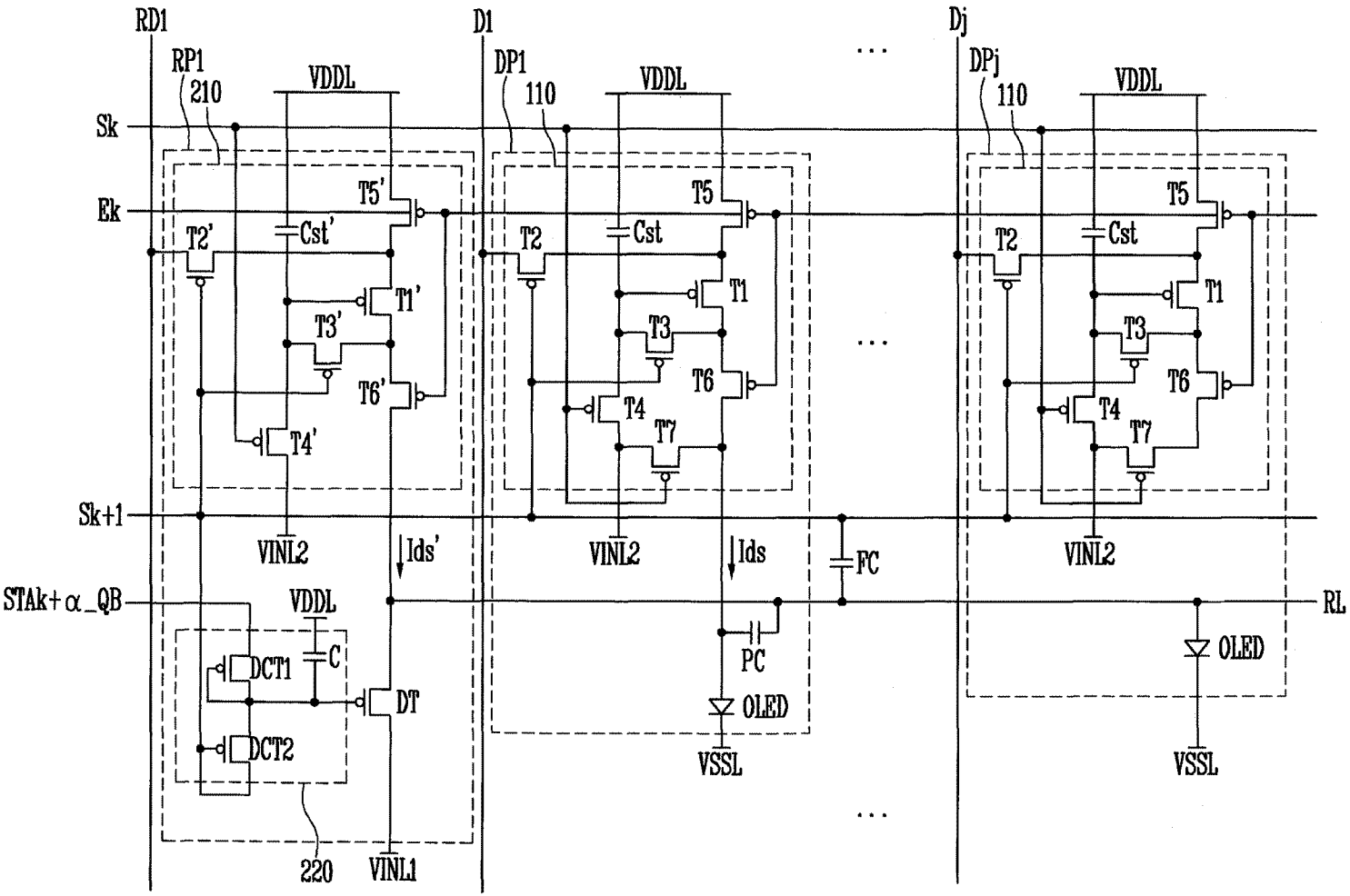
FIG. 13 is a circuit diagram showing in detail display pixels and an auxiliary pixel according to another exemplary embodiment.

FIG. 13 is a circuit diagram showing in detail display pixels and an auxiliary pixel according to another exemplary embodiment. For convenience of illustration, in FIG. 13, only the k-th and (k+1)-th scan lines Sk and Sk+1, the first auxiliary data line RD1, the first and j-th data lines D1 and Dj, the k-th emission control line Ek, and a pull-down control node (STAk+α_QB) of the (k+α)-th emission stage are shown. A detailed description of the pull-down control node STAk+α_QB of the (k+α)-th emission stage will be described below with reference to FIG. 14. Also, for convenience of illustration, in FIG. 13, the first auxiliary pixel RP1 coupled to the first auxiliary data line RD1, the first display pixel DP1 coupled to the first data line D1, and the j-th display pixel DPj coupled to the j-th data line Dj are shown. In FIG. 13, the first display pixel DP1 is a pixel at which no defect occurred during a manufacturing process, and the j-th display pixel DPj is a repaired pixel RDP at which defects occurred during the manufacturing process and has been repaired.

Referring to FIG. 13, the first auxiliary pixel RP1 may be coupled to the j-th display pixel DPj corresponding to the repaired pixel RDP via the auxiliary line RL. For example, the auxiliary line RL may be formed by extending into the display area DA from the first auxiliary pixel RP1. The auxiliary line RL may be coupled to the organic light emitting diode OLED of the j-th display pixel DPj.

Each of the display pixels DP1 and DPj may include the organic light emitting diode OLED and the display pixel driver 110. The display pixels DP1 and DPj shown in FIG. 13 may be substantially the same as the display pixels DP1 and DPj shown in FIG. 5. Therefore, a detailed description of the display pixels DP1 and DPj shown in FIG. 13 will be omitted.

The first auxiliary pixel RP1 may include the auxiliary pixel driver 210, the discharge transistor DT, and the discharge transistor controller 220. The first auxiliary pixel RP1 may not include an organic light emitting diode OLED.

The auxiliary pixel driver 210 and the discharge transistor DT of the first auxiliary pixel RP1 shown in FIG. 13 may be substantially the same as the auxiliary pixel driver 210 and the discharge transistor DT of the first auxiliary pixel RP1 shown in FIG. 5. Therefore, a detailed description of the auxiliary pixel driver 210 and the discharge transistor DT of the first auxiliary pixel RP1 shown in FIG. 13 will be omitted.

The discharge transistor controller 220 may control turning on and turning off of the discharge transistor DT. The discharge transistor controller 220 may include a plurality of transistors. Also, the discharge transistor controller 220 may include a capacitor. The discharge transistor controller 220 may include first and second discharge control transistors DCT1 and DCT2 and a capacitor C as shown in FIG. 13.

Each of the first and second discharge control transistors DCT1 and DCT2 may be coupled to the control electrode of the discharge transistor DT. Here, the control electrode of the first discharge control transistor DCT1 and the control electrode of the second discharge control transistor DCT2 may be coupled to different lines.

For example, the first discharge control transistor DCT1 may be coupled to the control electrode of the discharge transistor DT and the pull-down control node STAk+α_QB of the (k+α)-th emission stage. The control electrode of the first discharge control transistor DCT1 and the second electrode may be coupled to the control electrode of the discharge transistor DCT, and the first electrode may be coupled to the pull-down control node STAk+α_QB of the (k+α)-th emission stage. The a in the pull-down control node STAk+α_QB of the (k+α)-th emission stage is substantially the same as the description previously provided with reference to FIG. 5.

The second discharge control transistor DCT2 may be coupled to the control electrode of the discharge transistor DT and the (k+α)-th scan line Sk+1. The control electrode and the second electrode of the second discharge control transistor DCT2 may be coupled to the (k+1)-th scan line Sk+1, and the first electrode may be coupled to the control electrode of the discharge transistor DT. That is, the second discharge control transistor DCT2 may be driven as a diode. In other words, the second discharge control transistor DCT2 may be diode-connected.

The capacitor C may be coupled to the control electrode of the discharge transistor DT and the second power voltage line VDDL and maintain the voltage of the control electrode of the discharge transistor DT. The electrode on one side (e.g., a first terminal) of the capacitor C may be coupled to the control electrode of the discharge transistor DT, and the electrode on the other side (e.g., a second terminal) of the capacitor C may be coupled to the second power voltage line VDDL. The capacitor C may be omitted in some embodiments.

Figure 14:
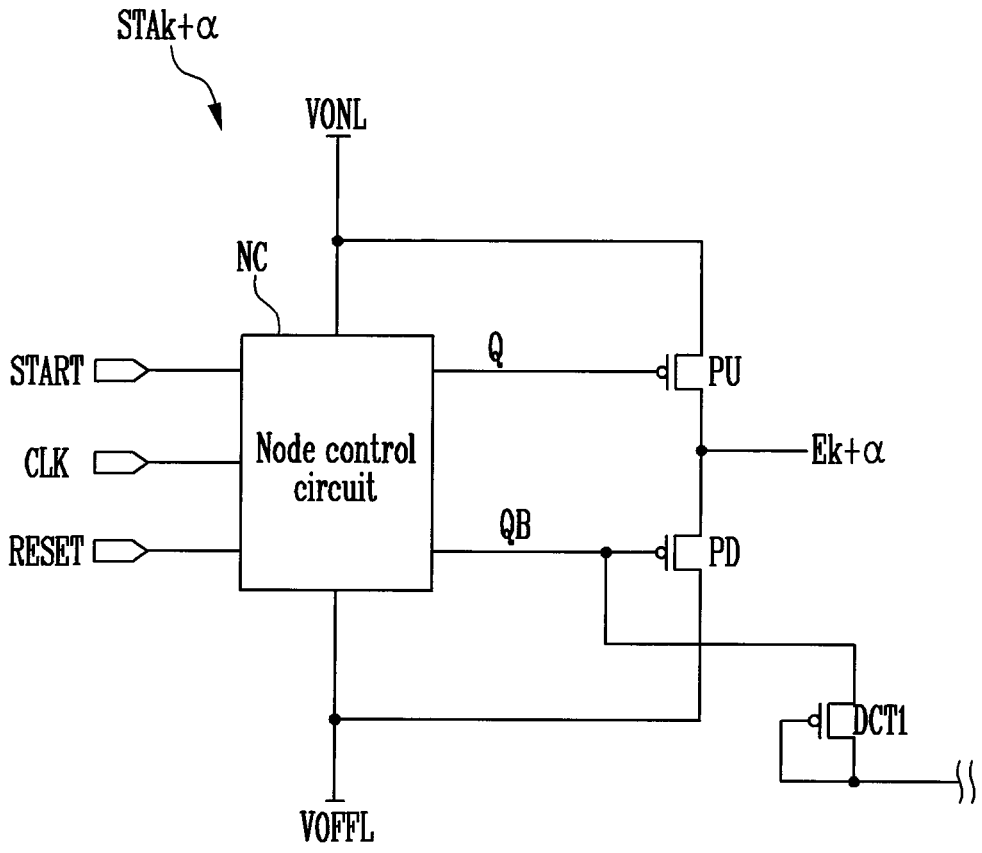
FIG. 14 is a circuit diagram showing an example of a (k+α)-th emission stage of a scan driver configured to output a (k+α)-th emission control signal shown in FIG. 13.

FIG. 14 is a circuit diagram showing an example of a (k+α)-th emission stage of a scan driver configured to output a (k+α)-th emission control signal shown in FIG. 13. Referring to FIG. 14, the (k+α)-th emission stage STAk+α configured to output the (k+α)-th emission control signal to the (k+α)-th emission control line Ek+α may include a pull-up control node Q, a pull-down control node QB, a pull-up transistor PU, a pull-down transistor PD, and a node control circuit NC.

The pull-up transistor PU may control coupling of the gate-on voltage VONL and the (k+α)-th emission control line Ek+α according to the voltage of the pull-up control node Q. A control electrode of the pull-up transistor PU may be coupled to the pull-up control node Q, a first electrode may be coupled to the (k+α)-th emission control line Ek+α, and a second electrode may be coupled to a clock terminal CLK.

The pull-down transistor PD may control coupling of the gate-off voltage line VOFFL and the (k+α)-th emission control line Ek+α according to the voltage of the pull-down control node QB. The control electrode of the pull-down transistor PD may be coupled to the pull-down control node QB, the first electrode may be coupled to the gate-off voltage line VOFFL, and the second electrode may be coupled to the (k+α)-th emission control line Ek+α.

The node control circuit NC may control the voltage of the pull-up control node Q and the voltage of the pull-down control node QB. The node control circuit NC may include a plurality of signal input terminals. For example, a start terminal START into which a start signal is input, the clock terminal CLK into which a clock signal is input, and a reset terminal RESET into which a reset signal is input. Also, the node control circuit NC may be coupled to the gate-on voltage line VONL and the gate-off voltage line VOFFL. The start signal may be a gate start signal or a carry signal of a previous emission stage. The clock signal may be any one of a plurality of clock signals. A reset signal may be a carry signal of a next emission stage. The gate-on voltage line may supply the gate-on voltage, and the gate-off voltage line may supply the gate-off voltage. The gate-on voltage may refer to a voltage capable of turning on the transistors included in the emission stages and the display pixels and the auxiliary pixels. The gate-off voltage may refer to a voltage capable of turning off the transistors included in the emission stages, the display pixels and the auxiliary pixels.

Hereinafter, the previous emission stage may refer to being positioned on an upper portion of (e.g., located before) the current emission stage. The previous emission stage of the (k+α)-th emission stage may refer to any one of the first to (k+α−1)-th emission stages STA1 to STAk+α−1. The next emission stage may refer to being positioned in a lower portion of (e.g., located after) the current emission stage. For example, the rear emission stage of the (k+α)-th emission stage STAk+α may refer to any one of the (k+α+1)-th to n-th emission stages STAk+α+1 to STAn.

The node control circuit NC may supply the gate-on voltage to the pull-up control node Q in response to the start signal input into the start terminal START and may supply the gate-off voltage to the pull-down control node QB. Therefore, the pull-up transistor PU may be turned on by the gate-on voltage of the pull-up control node Q, and the pull-down transistor PD may be turned off by the gate-off voltage of the pull-down control node QB. As a result, the gate-on voltage of the gate-on voltage line VONL may be output to the (k+α)-th emission control line Ek+α.

The node control circuit NC may supply the gate-off voltage to the pull-up control node Q in response to a reset signal input into the reset terminal RESET and may supply the gate-on voltage to the pull-down control node QB. Therefore, the pull-up transistor PU may be turned off by the gate-off voltage of the pull-up control node Q, and the pull-down transistor PD may be turned on by the gate-on voltage of the pull-down control node QB. As a result, the gate-off voltage of the gate-on voltage line VONL may be output to the (k+α)-th emission control line Ek+α.

The pull-down control node QB of the (k+α)-th emission stage STAk+α may be coupled to the first electrode of the first discharge control transistor DCT1 of the discharge transistor controller 220 as shown in FIG. 14.

In FIG. 14, although the node control circuit NC is shown as including only the start terminal START, the clock terminal CLK and the reset terminal RESET, it is not limited thereto. Also, in FIG. 14, for convenience of illustration, only the (k+α)-th emission stage STAk+α is shown, and each of the emission stages coupled to the emission control lines E1 to En may be implemented in a substantially the same manner as the (k+α)-th emission stage STAk+α. Also, each of the scan stages coupled to the scan lines S1 to Sn+1 may be implemented in a similar manner as the (k+α)-th emission stage STAk+α.

Figure 15:
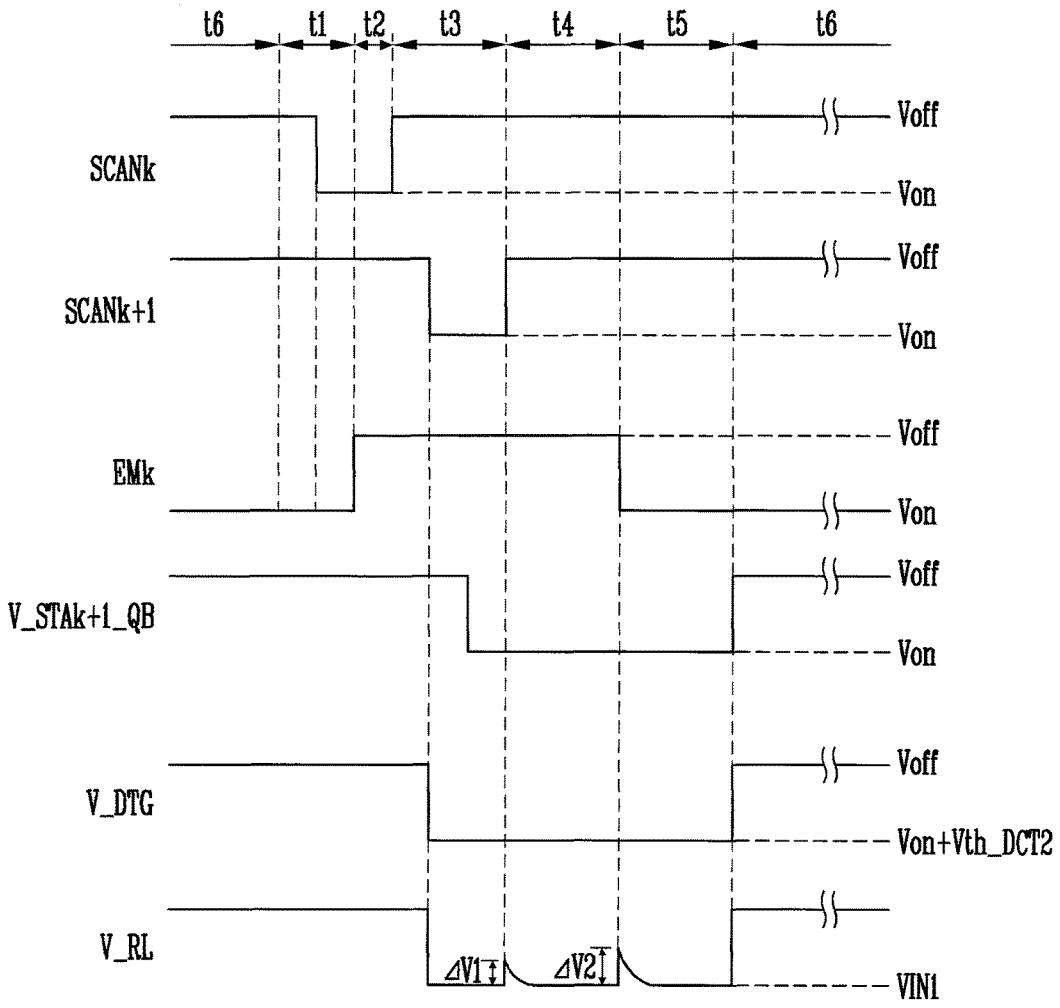
FIG. 15 is a waveform diagram showing signals supplied to display pixels and auxiliary pixels shown in FIG. 13, a voltage of a control electrode of a discharge transistor and a voltage of an auxiliary line.

FIG. 15 is a waveform diagram showing signals supplied to display pixels and auxiliary pixels shown in FIG. 13, a voltage of a control electrode of a discharge transistor and a voltage of an auxiliary line. FIG. 15 shows the k-th scan signal SCANk supplied to the k-th scan line Sk, the (k+1)-th scan signal SCANk+1 supplied to the (k+1)-th scan line Sk+1, the k-th emission control signal EMk supplied to the k-th emission control line Ek, the voltage V_EMk+1_QB of the pull-down control node of the (k+1)-th emission stage coupled to the (k+1)-th emission control line Ek+1, the voltage V_DTG supplied to the control electrode of the discharge transistor DT, and the voltage V_RL of the auxiliary line RL. Meanwhile, in FIG. 15, although the voltage V_EMk+1_QB of the pull-down control node of the (k+1)-th emission stage is illustrated as an example of the pull-down control node V_STAk+α_QB of the (k+α)-th emission stage, it is not limited thereto.

Referring to FIG. 15, the frame period may be divided into first to sixth periods t1 to t6. The k-th scan signal SCANk may be generated as the gate-on voltage Von during the first and second periods t1 and t2, and the (k+1)-th scan signal SCANk+1 may be generated as the gate-on voltage Von during the third period t3. The scan signals may be generated as the gate-on voltage Von sequentially. The k-th emission signal EMk may be generated as the gate-off voltage Voff during the second to fourth periods t2 to t4, and the voltage V_EMk+1_QB of the pull-down control node of the (k+1)-th emission stage may be generated as the gate-on voltage Von during the third to fifth periods t3 to t5.

Hereinafter, with reference to FIGS. 13 and 15, the driving method of the first auxiliary pixel RP1 and the j-th display pixel DPj and the driving method of the first display pixel DP1 will be described in detail.

The method for driving the display pixel DP1 according to FIGS. 13 and 15 is substantially the same as the method for driving the first display pixel DP1 according to FIGS. 5 and 6. Thus, a detailed description of the method for driving the first display pixel DP1 according to FIGS. 13 and 15 will be omitted.

Next, a detailed description of the method for driving the first auxiliary pixel RP1 and the j-th display pixel DPj will be provided.

First, the first period t1 is a period during which the on-bias is applied to the first transistor T1'.

During the first period t1, the k-th scan signal SCANk of the gate-on voltage Von may be supplied to the k-th scan line Sk, the k-th emission control signal EMk of the gate-on voltage Von may be supplied to the k-th emission control line Ek, and the (k+1)-th emission control signal EMk+1 of the gate-on voltage Von may be supplied to the (k+1)-th emission control line Ek+1. Therefore, the fourth to sixth transistors T4', T5' and T6' may be turned on during the first period t1.

Due to the fourth transistor T4' being turned on, the control electrode of the first transistor T1 may be initialized to the third power voltage VIN2 of the third power voltage line VINL2. Due to the fifth and sixth transistors T5' and T6' being turned on, a current path may be formed through which a current flows from the second power voltage line VDDL to the first power voltage line VINL1 via the fifth transistor T5', the first transistor T1', the sixth transistor T6' and the discharge transistor DT. Since the third power voltage VIN2 is set sufficiently lower than the second power voltage VDD, the difference in voltage between the control electrode and the first electrode of the first transistor T1' during the first period t1 (Vgs=VIN2−VDD) is lower than the threshold voltage Vth of the first transistor T1'. As a result, a current may flow through the current path.

During the first period t1, the control electrode of the first transistor T1' may be discharged to the third power voltage, and the on bias may be applied to the first transistor T1'. As a result, according to an exemplary embodiment, before a data voltage is supplied to the control electrode of the first transistor T1', the on bias may be applied to the first transistor T1'. And thus, problems in which image quality is deteriorated due to hysteresis characteristics of the first transistor T1' may be overcome.

Second, the second period t2 refers to a period during which the control electrode of the first transistor T1' and the anode electrode of the organic light emitting diode OLED are initialized.

During the second period t2, the k-th scan signal SCANk of the gate-on voltage Von may be supplied to the k-th scan line Sk, and the k-th emission control signal EMk of the gate-off voltage Voff may be supplied to the k-th emission control line Ek. Therefore, during the second period t2, the fourth transistor T4' may be turned on.

Due to the fourth transistor T4' being turned on, the control electrode of the first transistor T1' may be initialized to the third power voltage of the third power voltage line VINL2.

Third, the third period t3 refers to a period during which a data voltage and a threshold voltage are at the control electrode of the first transistor T1', and the auxiliary line RL is discharged to the first power voltage.

During the third period t3, the (k+1)-th scan signal SCANk+1 of the gate-on voltage Von may be supplied to the (k+1)-th scan line Sk+1, and the voltage V_EMk+1_QB of the pull-down control node of the (k+1)-th emission stage of the gate-on voltage Von is supplied. As a result, during the third period t3, the second and third transistors T2' and T3' may be turned on, and the first and second discharge control transistors DCT1 and DCT2 may be turned on.

Due to the second transistor T2' being turned on, the data voltage Vdata (or auxiliary data voltage that is substantially the same as Vdata) of the first auxiliary data line RD1 may be supplied to the first electrode of the first transistor T1'. Due to the third transistor T3' being turned on, since the control electrode and the second electrode of the first transistor T1' are coupled to each other, the first transistor T1' may be driven as a diode. In other words, the first transistor T1' may be diode-connected.

Since the voltage difference between the control electrode and the first electrode of the first transistor T1' (Vgs=VIN2−Vdata) is lower than the threshold voltage Vth, in the first transistor T1', the current may flow until the voltage difference Vgs between the control electrode and the first electrode reaches the threshold voltage Vth of the first transistor T1'. As a result, the voltage of the control electrode of the first transistor T1' increases to "Vdata+Vth" in the third period t3.

Due to the first and second discharge control transistors DCT2 being turned on, the sum voltage Von+Vth_DCT2 of the gate-on voltage Von and the threshold voltage Vth_DCT2 of the second discharge control transistor DCT2 may be supplied to the control electrode of the discharge transistor DT during the third period t3. Or, the sum voltage Von+Vth_DCT2 of the gate-on voltage Von and the threshold voltage Vth_DCT1 of the first discharge control transistor DCT1 may be supplied to the control electrode of the discharge transistor DT during the third period t3. Therefore, the discharge transistor DT may be turned on during the third period t3. As a result, the auxiliary line RL may be discharged to the first power voltage VIN1 since it is coupled to the first power voltage line VINL1.

Fourth, the fourth period t4 refers to a period during which sampling of the data voltage and the threshold voltage is completed at the control electrode of the first transistor T1', and the auxiliary line RL is discharged to the first power voltage.

During the fourth period t4, the (k+1)-th scan signal SCANk+1 of the gate-off voltage Voff may be supplied to the (k+1)-th scan line Sk+1. As a result, during the fourth period t4, all of the transistors of the auxiliary pixel driver 210 may be turned off. During the fourth period t4, "Vdata+Vth" corresponding to the voltage of the control electrode of the first transistor T1' may be stored in the storage capacitor Cst.

During the fourth period t4, the voltage V_EMk+1_QB of the pull-down control node of the (k+1)-th emission stage of the gate-on voltage Von may be supplied. During the fourth period t4, since "Von+Vth_DCT2" or "Von+Vth_DCT1" is maintained, the first discharge control transistor DCT1 and the discharge transistor DT may be turned on. As a result, during the fourth period t4, the auxiliary line RL may be discharged to the first power voltage VIN1 since it is coupled to the first power voltage line VINL1.

Meanwhile, since the (k+1)-th scan line Sk+1 and the auxiliary line RL are formed side by side, fringe capacitance FC may be formed between the (k+1)-th scan line Sk+1 and the auxiliary line RL as shown in FIG. 13. The voltage change of the (k+1)-th scan line Sk+1 may be reflected in the auxiliary line RL due to the fringe capacitance FC. Therefore, when the (k+1)-th scan signal SCANk+1 increases to the gate-off voltage Voff from the gate-on voltage Von during the fourth period t4, the voltage of the auxiliary line RL may increase by ΔV1 as the voltage change of the (k+1)-th scan line Sk+1 due to the fringe capacitance FC is reflected. However, since the auxiliary line RL is coupled to the first power voltage line VINL1 during the fourth period t4, even if voltage change of the (k+1)-th scan line Sk+1 is reflected due to the fringe capacitance FC, the auxiliary line RL is discharged to the first power voltage VIN1.

Fifth, the fifth period t5 refers to a period during which the auxiliary line RL is discharged to the first power voltage.

During the fifth period t5, the k-th emission signal Ek of the gate-on voltage Von may be supplied to the k-th emission control line Ek. As a result, the fifth and sixth transistors T5' and T6' may be turned on during the fifth period t5.

Due to the fifth and sixth transistors T5' and T6' being turned on, the driving current Ids' may flow via the first transistor T1 according to the voltage of the control electrode. The control electrode of the first transistor T1' may maintain "Vdata+Vth" due to the storage capacitor Cst. Here, the driving current Ids' flowing via the first transistor T1' may be defined as Formula 2. Also, Formula 3 may be derived from Formula 2.

Eventually, the driving current Ids' may not depend on the threshold voltage Vth of the first transistor T1' as shown in Formula 3. That is, the threshold voltage Vth of the first transistor T1' may be compensated.

Also, the voltage V_EMk+1_QB of the pull-down control node of the (k+1)-th emission stage of the gate-on voltage Von may be supplied during the fifth period t5. During the fifth period t5, since the control electrode of the discharge transistor DT may maintain "Von+Vth_DCT2" or "Von+Vth_DCT1", the first discharge control transistor DT1 and the discharge transistor DT may be turned on. As a result, during the fifth period t5, the auxiliary line RL may be discharged to the first power voltage VIN1 since it is coupled to the first power voltage line VINL1. Therefore, during the fifth period t5, the driving current Ids' of the auxiliary pixel driver 210 may be discharged to the first power voltage line VINL1 via the discharge transistor DT. Therefore, during the fifth period t5, the organic light emitting diode OLED of the j-th display pixel DPj may not emit light.

Meanwhile, since the auxiliary line RL may overlap the anode electrodes of the organic light emitting diode OLED of the display pixels DP1, parasitic capacitance PC may be formed between the auxiliary line RL and the anode electrodes of the organic light emitting diodes OLED of the display pixels DP1 as shown in FIG. 13. The voltage change of the anode electrodes of the organic light emitting diodes OLED may be reflected in the auxiliary line RL due to parasitic capacitance PC. Since the driving currents are supplied to the anode electrodes of the organic light emitting diodes OLED of the display pixels DP1 due to the k-th emission control signal EMk of the gate-on voltage during the fifth period t5, the voltage of the auxiliary line RL may increase by ΔV2 as the voltage change of the anode electrodes of the organic light emitting diodes OLED of the display pixels DP1 due to the parasitic capacitance PC is reflected. However, since the auxiliary line RL is coupled to the first power voltage line VINL1 during the fifth period t5, even if voltage change of the anode electrodes of the organic light emitting diodes OLED of the display pixels DP1 is reflected due to the parasitic capacitance PC, the auxiliary line RL is discharged to the first power voltage VIN1.

Sixth, the sixth period t6 refers to a period during which the organic light emitting diode OLED may emit light.

During the sixth period t6, the voltage V_EMk+1_QB of the pull-down control node of the (k+1)-th emission stage of the gate-off voltage Voff may be supplied. Accordingly, the gate-off voltage Voff may be supplied to the control electrode of the discharge transistor DT. As a result, the first discharge control transistor DCT1 and the discharge transistor DT may be turned off during the sixth period t6.

Due to the fifth and sixth transistor T5' and T6' being turned on, the driving current Ids' of the auxiliary pixel driver 210 may be supplied to the organic light emitting diode OELD of the j-th display pixel DPj via the auxiliary line RL. Therefore, the organic light emitting diode OLED of the j-th display pixel DPj may emit light.

As discussed above, according to an exemplary embodiment, the voltage of the auxiliary line RL may be prevented or substantially prevented from changing due to parasitic capacitances PC and the fringe capacitance FC. As a result, the organic light emitting diode OLED of the j-th display pixel DPj may be prevented or substantially prevented from erroneously emitting light due to the parasitic capacitances PC and the fringe capacitance FC.

Figure 16:
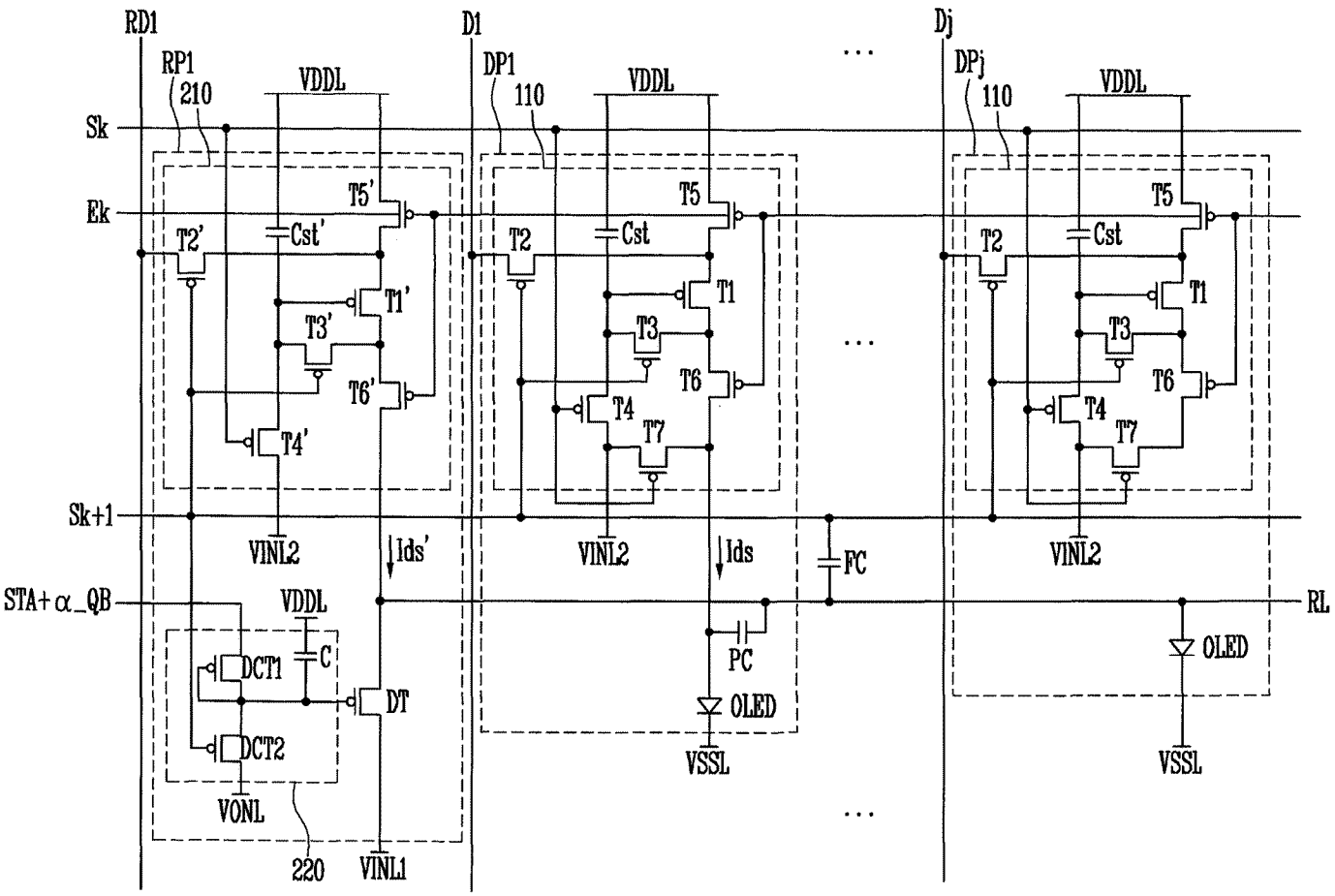
FIG. 16 is a circuit diagram showing in detail display pixels and an auxiliary pixel according to another exemplary embodiment.

FIG. 16 is a circuit diagram showing in detail display pixels and an auxiliary pixel according to another exemplary embodiment. For convenience of illustration, in FIG. 16, only the k-th and (k+1)-th scan lines Sk and Sk+1, the first auxiliary data line RD1, the first and j-th data lines D1 and Dj, the k-th emission control line Ek, and a pull-down control node (STAk+α_QB) of the (k+α)-th emission stage are shown. A detailed description of the pull-down control node STAk+α_QB of the (k+α)-th emission stage was provided above with reference to FIG. 14. Also, for convenience of illustration, in FIG. 16, the first auxiliary pixel RP1 coupled to the first auxiliary data line RD1, the first display pixel DP1 coupled to the first data line D1, and the j-th display pixel DPj coupled to the j-th data line Dj are shown. In FIG. 16, the first display pixel DP1 is a pixel at which no defect occurred during a manufacturing process, and the j-th display pixel DPj is a repaired pixel RDP at which defects occurred during the manufacturing process and has been repaired.

Referring to FIG. 16, the first auxiliary pixel RP1 may be coupled to the j-th display pixel DPj corresponding to the repaired pixel RDP via the auxiliary line RL. For example, the auxiliary line RL may be formed by extending into the display area DA from the first auxiliary pixel RP1. The auxiliary line RL may be coupled to the organic light emitting diode OLED of the j-th display pixel DPj.

Each of the display pixels DP1 and DPj may include the organic light emitting diode OLED and the display pixel driver 110. The display pixels DP1 and DPj shown in FIG. 16 may be substantially the same as the display pixels DP1 and DPj shown in FIG. 5. Therefore, a detailed description of the display pixels DP1 and DPj shown in FIG. 16 will be omitted.

The first auxiliary pixel RP1 may include the auxiliary pixel driver 210, the discharge transistor DT, and the discharge transistor controller 220. The first auxiliary pixel RP1 may not include an organic light emitting diode OLED.

The auxiliary pixel driver 210 and the discharge transistor DT of the first auxiliary pixel RP1 shown in FIG. 16 may be substantially the same as the auxiliary pixel driver 210 and the discharge transistor DT of the first auxiliary pixel RP1 shown in FIG. 5. Therefore, a detailed description of the auxiliary pixel driver 210 and the discharge transistor DT of the first auxiliary pixel RP1 shown in FIG. 16 will be omitted.

The discharge transistor controller 220 may control turning on and turning off of the discharge transistor DT. The discharge transistor controller 220 may include a plurality of transistors. Also, the discharge transistor controller 220 may include a capacitor. The discharge transistor controller 220 may include the first and second discharge control transistors DCT1 and DCT2 and the capacitor C as shown in FIG. 16.

Each of the first and second discharge control transistors DCT1 and DCT2 may be coupled to the control electrode of the discharge transistor DT. Here, the control electrode of the first discharge control transistor DCT1 and the control electrode of the second discharge control transistor DCT2 may be coupled to different lines.

For example, the first discharge control transistor DCT1 may be coupled to the control electrode of the discharge transistor DT and the pull-down control node STAk+α_QB of the (k+α)-th emission stage. The control electrode of the first discharge control transistor DCT1 and the second electrode may be coupled to the control electrode of the discharge transistor DCT, and the first electrode may be coupled to the pull-down control node STAk+α_QB of the (k+α)-th emission stage. The a in the pull-down control node STAk+α_QB of the (k+α)-th emission stage is substantially the same as the description previously provided with reference to FIG. 5.

The second discharge control transistor DCT2 may be coupled to the control electrode of the discharge transistor DT and the gate-on voltage line VONL to which the gate-on voltage is supplied. The control electrode of the second discharge control transistor DCT2 may be coupled to the (k+1)-th scan line Sk+1, the first electrode may be coupled to the control electrode of the discharge transistor DT, and the second electrode may be coupled to the gate-on voltage line VONL.

The capacitor C may be coupled to the control electrode of the discharge transistor DT and the second power voltage line VDDL and maintain the voltage of the control electrode of the discharge transistor DT. The electrode on one side (e.g., a first terminal) of the capacitor C may be coupled to the control electrode of the discharge transistor DT, and the electrode on the other side (e.g., a second terminal) of the capacitor C may be coupled to the second power voltage line VDDL. The capacitor C may be omitted in some embodiments.

The signals supplied to the display pixels DP1 and DPj and the auxiliary pixel RP1 as shown in FIG. 16 are substantially the same as what is shown in FIG. 15. Also, the method for driving the display pixels DP1 and DPj and the auxiliary pixel RP1 may be substantially the same as the description provided with reference to FIGS. 13 and 15. Therefore, a detailed description of the method for driving the display pixels DP1 and DPj and the auxiliary pixel RP1 as shown in FIG. 16 will be omitted.

By way of summation and review, according to an exemplary embodiment, an auxiliary line is discharged to a first power voltage using a discharge transistor. As a result, according to an exemplary embodiment, the voltage of the auxiliary line may be prevented or substantially prevented from changing due to parasitic capacitances between the auxiliary line and the anode electrodes of the organic light emitting diodes OLED of the display pixels and fringe capacitance between the auxiliary line and the adjacent scan line. Therefore, the organic light emitting diode OLED may be prevented or substantially prevented from erroneously emitting light according to an exemplary embodiment.

Also, according to an exemplary embodiment, auxiliary data may be calculated from digital video data corresponding to a coordinate value of a repaired pixel. As a result, according to an exemplary embodiment, an auxiliary data voltage that is the same or substantially the same as a data voltage to be supplied to the repaired pixel may be supplied to the auxiliary pixel coupled to the repaired pixel.

Also, according to an exemplary embodiment, initialization data may be supplied to auxiliary pixels that are not coupled to the repaired pixel. As a result, according to an exemplary embodiment, the display pixels of the display may be prevented or substantially prevented from being affected by the change in voltage of the auxiliary lines coupled to the auxiliary pixels that are not coupled to the repaired pixels.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. An organic light emitting display device comprising:

data lines and an auxiliary data line;

scan lines and emission control lines crossing the data lines and the auxiliary data line;

a scan driver configured to supply scan signals to the scan lines, and to supply emission control signals to the emission control lines;

display pixels at crossing regions of the data lines, the scan lines and the emission control lines, and each comprising an organic light emitting diode;

auxiliary pixels at crossing regions of the auxiliary data line, the scan lines and the emission control lines, and configured to supply a driving current to one of the organic light emitting diodes of the display pixels; and auxiliary lines coupled to the auxiliary pixels, wherein each of the auxiliary pixels comprises:

a discharge transistor coupled to one of the auxiliary lines and a first power voltage line configured to receive a first power voltage and configured to discharge the one of the auxiliary lines to the first power voltage; and a discharge transistor controller comprising a plurality of transistors, and configured to control the discharge transistor such that the discharge transistor is off during a period in which the one of the organic light emitting diodes emits light.

2. The device of claim 1, wherein the discharge transistor controller comprises first and second discharge control transistors coupled to a control electrode of the discharge transistor, wherein a control electrode of the first discharge control transistor and a control electrode of the second discharge control transistor are coupled to different lines.

3. The device of claim 2, wherein the control electrode of the first discharge control transistor is coupled to one of the emission control lines, a first electrode of the first discharge control transistor is coupled to one of the scan lines, and a second electrode of the first discharge control transistor is coupled to the control electrode of the discharge transistor, wherein the control electrode of the second discharge control transistor and a second electrode of the second discharge control transistor are coupled to one of the scan lines, and a first electrode of the second discharge control transistor is coupled to the control electrode of the discharge transistor.

4. The device of claim 2, wherein the discharge transistor controller comprises a capacitor coupled to the control electrode of the discharge transistor and a second power voltage line configured to receive a second power voltage.

5. The device of claim 2, wherein the control electrode of the first discharge control transistor is coupled to one of the emission control lines, a first electrode of the first discharge control transistor is coupled to a gate-off voltage line configured to receive a gate-off voltage, and a second electrode of the first discharge control transistor is coupled to the control electrode of the discharge transistor, and wherein the control electrode of the second discharge control transistor is coupled to one of the scan lines, a first electrode of the second discharge control transistor is coupled to the control electrode of the discharge transistor, and a second electrode of the second discharge control transistor is coupled to a gate-on voltage line configured to receive a gate-on voltage.

6. The device of claim 2, wherein the discharge transistor controller comprises a capacitor coupled to the control electrode of the discharge transistor and a gate-off voltage line configured to receive a gate-off voltage, or coupled to the control electrode of the discharge transistor and a gate-on voltage line configured to receive a gate-on voltage.

7. The device of claim 2, wherein the discharge transistor controller further comprises a third discharge control transistor coupled to the control electrode of the discharge transistor, wherein the control electrode of the first discharge control transistor, the control electrode of the second discharge control transistor, and a control electrode of the third discharge control transistor are coupled to different lines.

8. The device of claim 7, wherein the control electrode of the first discharge control transistor is coupled to one of the emission control lines, a first electrode of the first discharge control transistor is coupled to one of the scan lines, and a second electrode of the first discharge control transistor is coupled to the control electrode of the discharge transistor, wherein the control electrode of the second discharge control transistor and a second electrode of the second discharge control transistor are coupled to one of the scan lines, and a first electrode of the second discharge control transistor is coupled to the control electrode of the discharge transistor, and wherein the control electrode of the third discharge control transistor and a second electrode of the third discharge control transistor are coupled to another one of the scan lines and a first electrode of the third discharge control transistor is coupled to the control electrode of the discharge transistor.

9. The device of claim 7, wherein the control electrode of the first discharge control transistor is coupled to one of the emission control lines, a first electrode of the first discharge control transistor is coupled to a gate-off voltage line configured to receive a gate-off voltage, and a second electrode of the first discharge control transistor is coupled to the control electrode of the discharge transistor, wherein the control electrode of the second discharge control transistor is coupled to one of the scan lines, a first electrode of the second discharge control transistor is coupled to the control electrode of the discharge transistor, and a second electrode of the second discharge control transistor is coupled to a gate-on voltage line configured to receive a gate-on voltage, and wherein the control electrode of the third discharge control transistor is coupled to another one of the scan lines, a first electrode of the third discharge control transistor is coupled to the control electrode of the discharge transistor, and a second electrode of the third discharge control transistor is coupled to the gate-on voltage line.

10. The device of claim 2, wherein the control electrode of the first discharge control transistor and a second electrode of the first discharge control transistor are coupled to the control electrode of the discharge transistor, and a first electrode of the first discharge control transistor is coupled to a pull-down control node of an emission stage configured to output an emission control signal to one of the emission control lines, and wherein the control electrode of the second discharge control transistor and a second electrode of the second discharge control transistor are coupled to one of the scan lines, and a first electrode of the second discharge control transistor is coupled to the control electrode of the discharge transistor.

11. The device of claim 2, wherein the control electrode of the first discharge control transistor and a second electrode of the first discharge control transistor are coupled to the control electrode of the discharge transistor, and a first electrode of the first discharge control transistor is coupled to a pull-down control node of an emission stage configured to output an emission control signal to one of the emission control lines, and wherein the control electrode of the second discharge control transistor is coupled to one of the scan lines, a first electrode of the second discharge control transistor is coupled to the control electrode of the discharge transistor, and a second electrode of the second discharge control transistor is coupled to a gate-on voltage line configured to receive a gate-on voltage.

12. The device of claim 1, wherein one of the auxiliary lines couples one of the auxiliary pixels and one of the display pixels.

13. The device of claim 1, wherein each of the display pixels further comprises a display pixel driver comprising a plurality of transistors and configured to supply a driving current to the organic light emitting diode.

14. The device of claim 13, wherein the display pixel driver comprises:

a first transistor configured to control the driving current according to a voltage of a control electrode of the first transistor;

a second transistor coupled to one of the data lines and a first electrode of the first transistor;

a third transistor coupled to the control electrode of the first transistor and a second electrode of the first transistor;

a fourth transistor coupled to the control electrode of the first transistor and a third power voltage line configured to receive a third power voltage;

a fifth transistor coupled between the first electrode of the first transistor and a second power voltage line configured to receive a second power voltage;

a sixth transistor coupled between the second electrode of the first transistor and an anode electrode of the organic light emitting diode;

a seventh transistor coupled to the anode electrode of the organic light emitting diode and the third power voltage line; and a storage capacitor coupled between the control electrode of the first transistor and the second power voltage line.

15. The device of claim 14, wherein control electrodes of the second and third transistors are coupled to one of the scan lines, control electrodes of the fourth and seventh transistors are coupled to another one of the scan lines, and control electrodes of the fifth and sixth transistors are coupled to one of the emission control lines.

16. The device of claim 1, wherein each of the auxiliary pixels further comprises an auxiliary pixel driver comprising a plurality of transistors and configured to supply a driving current to one of the auxiliary lines.

17. The device of claim 16, further comprising another auxiliary data line, wherein the auxiliary pixel driver comprises:

a first transistor configured to control the driving current according to a voltage of a control electrode of the first transistor;

a second transistor coupled to one of the auxiliary data line or the another auxiliary data line and a first electrode of the first transistor;

a third transistor coupled to the control electrode of the first transistor and a second electrode of the first transistor;

a fourth transistor coupled to the control electrode of the first transistor and a third power voltage line configured to receive a third power voltage;

a fifth transistor coupled to the first electrode of the first transistor and a second power voltage line configured to receive a second power voltage;

a sixth transistor coupled to the second electrode of the first transistor, and the one of the auxiliary data line or the another auxiliary data line; and a storage capacitor coupled to the control electrode of the first transistor and the second power voltage line.

18. The device of claim 17, wherein control electrodes of the second and third transistors are coupled to one of the scan lines, a control electrode of the fourth transistor is coupled to another one of the scan lines, and control electrodes of the fifth and sixth transistors are coupled to one of the emission control lines.

19. The device of claim 1, further comprising:

a first data driver configured to supply data voltages to the data lines; and a second data driver configured to supply auxiliary data voltages to the auxiliary data line.

20. The device of claim 19, wherein the second data driver comprises:

an auxiliary data calculator configured to calculate auxiliary data from digital video data corresponding to a coordinate value of a repaired pixel from among the display pixels;

a memory configured to store the auxiliary data and to be periodically updated with initialization data; and an auxiliary data voltage converter configured to receive the auxiliary data or the initialization data from the memory, to convert the auxiliary data or the initialization data into an auxiliary data voltage, and to output the auxiliary data voltage.

* * * * *